US012383025B2

(12) United States Patent
Andrews et al.

(10) Patent No.: US 12,383,025 B2
(45) Date of Patent: Aug. 12, 2025

(54) ARTICLE OF FOOTWEAR HAVING A GEOMETRIC CUSHIONING SYSTEM

(71) Applicant: Reebok International Limited, Altrincham (GB)

(72) Inventors: Michael Andrews, East Falmouth, MA (US); Daniel R. Hobson, Waltham, MA (US); Jeffrey J. Acheson, Canton, MA (US)

(73) Assignee: Reebok International Limited, Altrincham (GB)

( * ) Notice: Subject to any disclaimer, the term of this patent is extended or adjusted under 35 U.S.C. 154(b) by 139 days.

(21) Appl. No.: 17/739,525

(22) Filed: May 9, 2022

(65) Prior Publication Data

US 2023/0354959 A1 Nov. 9, 2023

(51) Int. Cl.
*A43B 13/18* (2006.01)
*A43B 7/32* (2006.01)

(52) U.S. Cl.
CPC ..... *A43B 13/181* (2013.01); *A43B 7/32* (2013.01)

(58) Field of Classification Search
CPC ..... A43B 13/181; A43B 13/20; A43B 13/18; A43B 13/14; A43B 13/12; A43B 7/32
See application file for complete search history.

(56) References Cited

U.S. PATENT DOCUMENTS 4,223,456 A * 9/1980 Cohen ..... A43B 13/206 36/32 R
5,572,804 A * 11/1996 Skaja ..... A43B 13/20 36/35 B
6,209,226 B1 * 4/2001 Squadroni ..... A43B 7/08 36/141
11,464,280 B2 * 10/2022 Sung ..... A43B 7/32
2013/0167402 A1 * 7/2013 Christensen ..... A43B 13/184 36/29

(Continued)

FOREIGN PATENT DOCUMENTS

EP 0875163 A2 11/1998
EP 3632252 A1 4/2020
KR 102184410 B1 11/2020

(Continued)

OTHER PUBLICATIONS

European Search Report and Written Opinion for EP 23169361.5, mailed on Dec. 15, 2023, 8 pages.

*Primary Examiner* — Patrick J. Lynch
*Assistant Examiner* — Brianna T. Duckworth
(74) *Attorney, Agent, or Firm* — STERNE, KESSLER, GOLDSTEIN & FOX P.L.L.C.

(57) ABSTRACT

An article of footwear includes an upper and a sole coupled to the upper. The sole includes an insole for receiving a foot of a wearer and a sole member disposed below the insole to support the foot of the wearer. The sole member includes a web extending along a length of the sole and a plurality of pillars projecting upwardly from the web toward the insole. Each of the pillars includes a curved sidewall and a lid extending from an upper end of the curved sidewall. The curved sidewall and the lid define a cavity. The web and the plurality of pillars of the sole member are unitary and made of an elastomeric material that allows the pillars to flex or deform at a compressed state and return to an upright position at a relaxed state.

15 Claims, 48 Drawing Sheets

(56) References Cited

U.S. PATENT DOCUMENTS

| | | | | |
|---|---|---|---|---|
| 2020/0359737 | A1* | 11/2020 | Sung | A43B 13/181 |
| 2023/0329392 | A1* | 10/2023 | Sung | A43B 13/181 |

FOREIGN PATENT DOCUMENTS

| | | | |
|---|---|---|---|
| TW | M382739 | U | 6/2010 |
| WO | 2004004502 | A1 | 1/2004 |
| WO | 2012136072 | A1 | 10/2012 |

* cited by examiner

SEC E–E'

ARTICLE OF FOOTWEAR HAVING A GEOMETRIC CUSHIONING SYSTEM

BACKGROUND

Field of the Invention

The present disclosure relates to footwear, and more particularly relate to a sole and article of footwear having a resilient sole member for supporting a foot of a wearer.

Background Art

The human foot possesses natural cushioning and rebounding characteristics.

However, the foot alone is incapable of effectively overcoming many of the forces encountered during every day activity. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole, which absorbs shocks. Therefore, a continuing need exists for innovations in providing cushioning to articles of footwear.

BRIEF SUMMARY OF THE INVENTION

The present disclosure includes various embodiments of a sole for an article of footwear that provides a desired cushioning effect to a wearer's foot.

In accordance with one embodiment, an article of footwear comprises an upper and a sole coupled to the upper. In some embodiments, the sole comprises an insole configured to receive a foot of a wearer. In some embodiments, the sole comprises a first sole member disposed below the insole and configured to support the foot of the wearer. In some embodiments, the first sole member comprises a first web extending along a length of the sole. In some embodiments, the first sole member comprises a plurality of first pillars projecting upwardly from the first web toward the insole. In some embodiments, the plurality of first pillars each include a curved sidewall, a lid extending from an upper end of the curved sidewall, wherein the curved sidewall and the lid define a cavity, and an aperture disposed at a center of the lid and opening into the cavity. In some embodiments, the first web and the plurality of first pillars of the first sole member are unitary and made of a first elastomeric material having a first modulus of elasticity configuring the plurality of first pillars to flex or deform upon an application of a compressive force by the wearer and return to their original shape upon a removal of the compressive force.

In some embodiments, the first web comprises a plurality of strips interconnecting the plurality of first pillars.

In some embodiments, the first web comprises a plate, and the sidewall of each first pillar projects upwardly from an upper surface of the plate.

In some embodiments, the lid of each first pillar is dome-shaped, and the aperture of each first pillar is disposed at an apex of the dome-shaped lid.

In some embodiments, the cavity of each first pillar is filled with ambient air.

In some embodiments, the sole further comprises an outsole coupled to the first web of the first sole member, and the outsole is made of a second elastomeric material having a second modulus of elasticity that is greater than the first modulus of elasticity.

In some embodiments, the outsole comprises a base extending along the length of the sole and configured to contact the ground and a sidewall projecting upwardly from the base and extending along a perimeter of the sole. In some embodiments, the base and the sidewall of the outsole define a chamber, and the first sole member is received in the chamber of the outsole.

In some embodiments, a second sole member disposed below the insole and above the first sole member. In some embodiments, the second sole member comprises a second web coupled to the insole and extending along the length of the sole, and a plurality of second pillars projecting downwardly from the second web toward the first sole member. In some embodiments, the plurality of second pillars each include a curved sidewall, and a base extending from a lower end of the curved sidewall. In some embodiments, the second web and the plurality of second pillars of the second sole member are unitary. In some embodiments, the plurality of second pillars are axially aligned with respect to the plurality of first pillars, and the base of each second pillar engages the lid of a respective first pillar. In some embodiments, the plurality of second pillars each include a pin projecting downwardly from a center of the base and received in the aperture of the respective first pillar.

In accordance with one embodiment, a sole for an article of footwear comprises an insole configured to receive a foot of a wearer. In some embodiments, the sole comprises a first sole member disposed below the insole and configured to support the foot of the wearer.

In some embodiments, the first sole member comprises a first web comprising a plate extending along a length of the sole. In some embodiments, the first sole member comprises a plurality of first pillars projecting upward from an upper surface of the plate toward the insole. In some embodiments, the plurality of first pillars each include a curved sidewall and a lid extending from an upper end of the curved sidewall. In some embodiments, the curved sidewall and the lid define a cavity. In some embodiments, the plurality of first pillars each include an aperture disposed at a center of the lid and opening into the cavity. In some embodiments, the first web and the plurality of first pillars of the first sole member are unitary and made of a first elastomeric material having a first modulus of elasticity configuring the plurality of first pillars to flex or deform upon an application of a compressive force by the wearer and return to their original shape upon a removal of the compressive force.

In some embodiments, the first web comprises a plurality of bosses projecting from a bottom surface of the plate, and the plurality of bosses are axially aligned with respect to the plurality of first pillars.

In some embodiments, the plate of the first web comprises a plurality of holes each opening into the cavity of a respective first pillar.

In some embodiments, the first web comprises a first lateral sidewall disposed on a lateral side of the plate of the first web, and a first medial sidewall disposed on a medial side of the plate of the first web.

In some embodiments, the plurality of first pillars are arranged in a series of rows, and at least one of the rows of the first pillars are disposed between the first lateral sidewall and the first medial sidewall of the first web.

In some embodiments, the sole further comprises a midsole made from a foam-based material and coupled to the insole and the first sole member.

In some embodiments, the midsole comprises a sidewall extending along a perimeter of the sole and defining a chamber, and the plurality of first pillars are received in the chamber of the midsole.

In some embodiments, the lid of at least one of the plurality of first pillars engages a bottom surface of the insole.

In some embodiments, the lid of at least one of the plurality of first pillars engages a bottom surface of the midsole.

In some embodiments, the sole further comprises a second sole member disposed below the insole and above the first sole member. In some embodiments, the second sole member comprises a second web coupled to the insole. In some embodiments, the second web comprising a plate extending along the length of the sole and a plurality of second pillars projecting downwardly from a lower surface of the plate of the second web toward the first sole member. In some embodiments, the plurality of second pillars each include a curved sidewall and a base extending from a lower end of the curved sidewall. In some embodiments, the second web and the plurality of second pillars of the second sole member are unitary. In some embodiments, the plurality of second pillars are axially aligned with respect to the plurality of first pillars. In some embodiments, the base of each second pillar is interlocked with the lid of a respective first pillar.

In some embodiments, the second web comprises a second lateral sidewall disposed on a lateral side of the plate of the second web. In some embodiments, the second web comprises a second medial sidewall disposed on a medial side of the plate of the second web. In some embodiments, a bottom surface of the second lateral sidewall engages an upper surface of the first lateral sidewall, and a bottom surface of the second medial sidewall engages an upper surface of the first medial sidewall.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1:
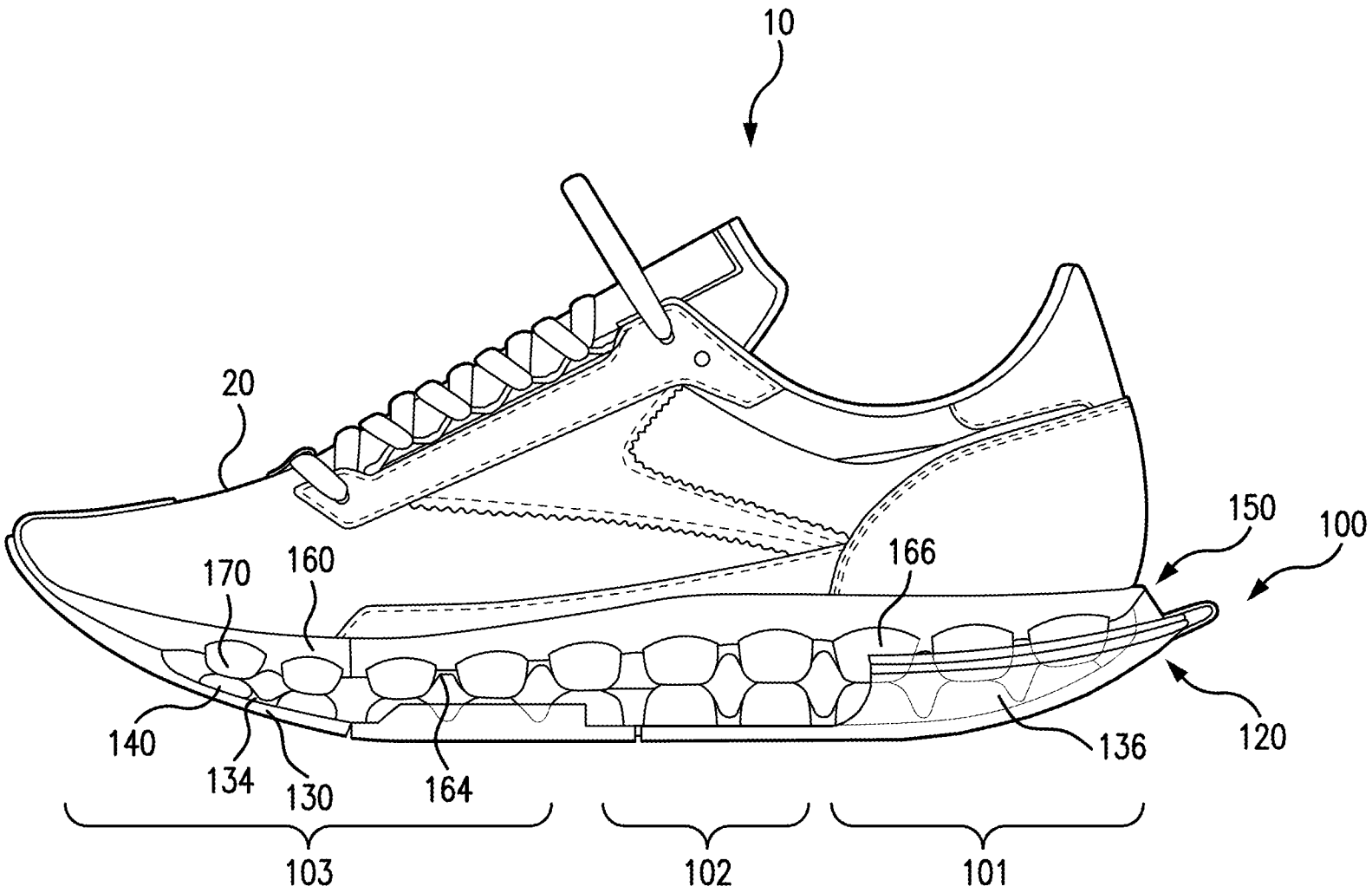
FIG. 1 shows a side view of an article of footwear according to embodiments.
Figure 2:
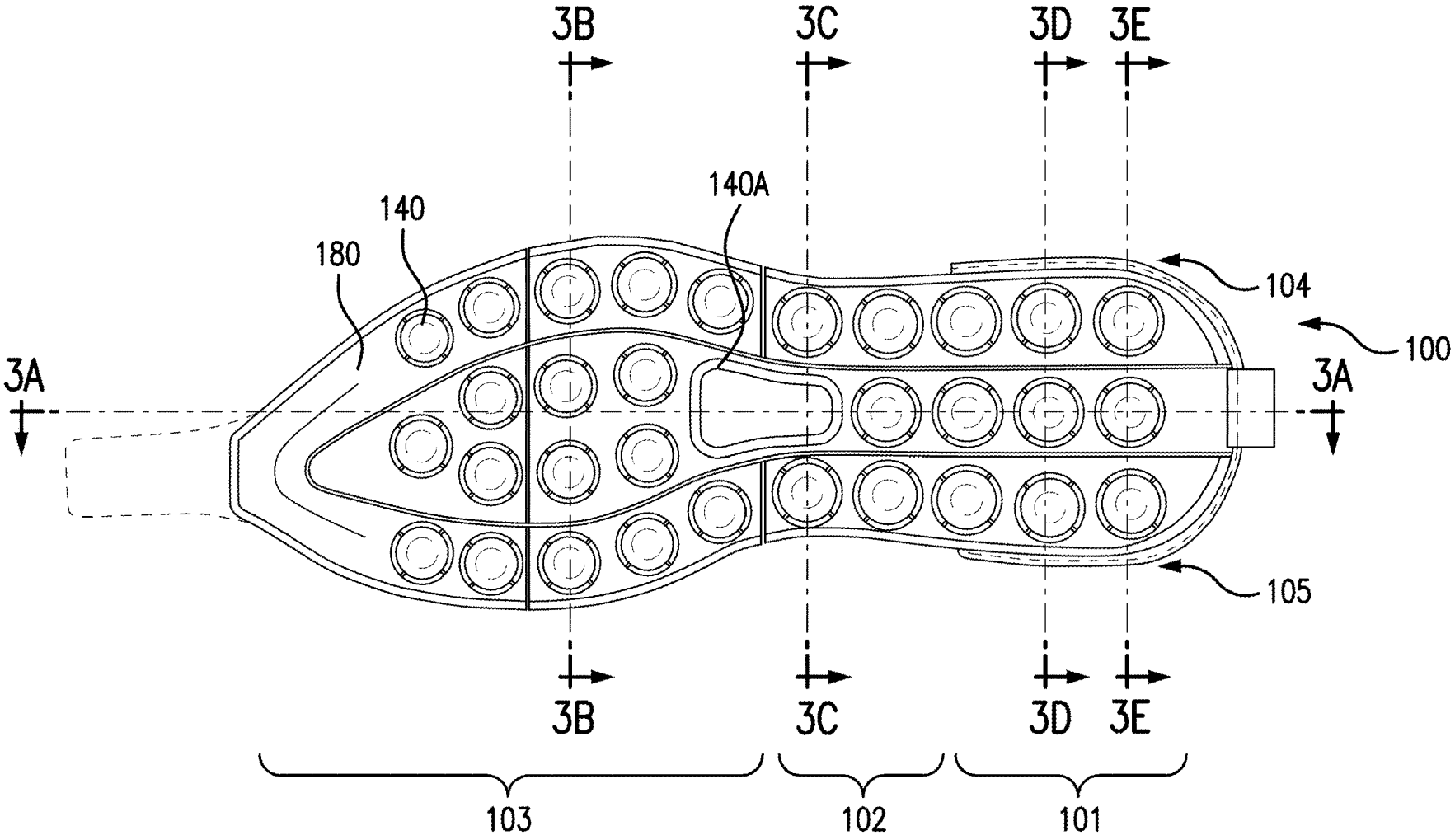
FIG. 2 shows a bottom view of the article of footwear shown in FIG. 1 according to embodiments.

The present inventions will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present inventions. Other suitable modifications and adaptations of the variety of conditions and parameters normally encountered in the field, and which would be apparent to those skilled in the art, are within the spirit and scope of the inventions.

One attempt over the years to improve cushioning and resiliency of shoes, particularly athletic shoes, is incorporating a midsole component formed primarily from a polymer foam material due to the polymer foam material's ability to compress resiliently under an applied load, which attenuates forces impacted by the sole striking the ground during the wearer's gait cycle. However, the performance of foam-based midsoles suffers over time due to dynamic fatigue. That is, the polymer foam losses its initial elasticity and firmness as the polymer foam midsole is subjected to stress inhibited by the daily use of the shoe. Furthermore, including foam-based materials in the sole increases the cost of manufacturing.

Accordingly, there is a need for an improved sole that minimizes or eliminates the use of polymer foam, while still providing adequate support and cushioning to the wearer's foot.

According to various embodiments described herein, the sole of the present disclosure may overcome one or more of the deficiencies noted above by comprising a sole member having a web extending along a length of the sole and a plurality of pillars projecting upwardly from the web toward an insole that receives the wearer's foot. In some embodiments, the plurality of pillars may each include a curved sidewall and a lid extending from an upper end of the curved sidewall, where the curved sidewall and the lid define a cavity. In some embodiments, the web and the plurality of pillars of the sole member are unitary and made of a elastomeric material having a modulus of elasticity configuring the plurality of pillars to flex or deform upon an application of a compressive force by the wearer (e.g., a compressed state) and return to their original shape and/or upright position upon a removal of the compressive force (e.g., a relaxed state). The resiliency of the pillars allows the sole member to absorb a significant amount of shock that occurs when the sole strikes the ground, thereby providing a desirable cushioning effect to wearer's foot with minimal use of material.

FIGS. 1-3E illustrate an article of footwear 10 having an upper 20 and a sole 100 coupled to the upper 20 according to one embodiment of the present disclosure. In various embodiments, sole 100 may include a heel region 101, a midfoot or arch region 102, and a forefoot region 103 extending between a lateral side 104 and a medial side 105 of sole 100. In some embodiments, sole 100 may include an insole and/or sockliner 110 configured to receive a wearer's foot. In some embodiments, sole 100 may include a first sole member 120 disposed below insole 110 and configured to support the foot of the wearer. In some embodiments, sole 100 may include a second sole member 150 disposed below insole 110 and above first sole member 120. In some embodiments, sole 100 may include an outsole 180 coupled to a bottom of first sole member 120.

In some embodiments, first sole member 120 may include a first web 130 extending along a length of sole 100. In some embodiments, first web 130 may extend from heel region 101 to forefoot region 103 of sole 100. In some embodiments, first web 130 may extend from heel region 101 to arch region 102 of sole 100. In some embodiments, first web 130 may extend from forefoot region 103 to arch region 102 of sole 100. In some embodiments, first web 130 may be disposed only in heel region 101 of sole 100. In some embodiments, first web 130 may be disposed only in arch region 102 of sole 100. In some embodiments, first web 130 may be disposed only in forefoot region 103 of sole 100.

In some embodiments, first sole member 120 may include a plurality of first pillars 140 projecting upwardly from first web 130 toward insole 110 to provide support for the wearer's foot. The plurality of first pillars 140 are configured to compress, deflect, flex, bend and/or deform upon an application of a compressive force by the wearer's foot (e.g., when sole 100 strikes the ground during a the wearer's gait cycle) and return to their original shape (e.g., stand upright) upon a removal of the compressive force, such that the plurality of first pillars 140 absorb shock imparted from the ground surface during the wearer's gait cycle. For example, in some embodiments, the plurality of first pillars 140 may be configured to compress, deflect, flex, bend, and/or deform at a compressed state (e.g., when sole 100 strikes the ground) and configured to stand upright at a relaxed state (e.g., when sole 100 elevates above the ground). In some embodiments, the plurality of first pillars 140 are configured to return from the compressed state to the relaxed state without incurring permanent buckling or plastic deformation. By demonstrating high resiliency—flexing or bending at a compressed state and returning to stand upright at a relaxed state—the plurality of first pillars 140 absorb a significant amount of shock that provides a desirable cushioning effect to wearer's foot.

The shape of first pillars 140 may be tuned to achieve optimum cushioning and support to the foot of the wearer. For example, in some embodiments, the plurality of first pillars 140 may each include a curved sidewall 142, such as a cylindrical-shaped sidewall. In some embodiments, the plurality of first pillars 140 may each include a lid 144 extending from an upper end of the curved sidewall 142. In some embodiments, curved sidewall 142 and lid 144 collectively define a cavity 148. In some embodiments, the plurality of first pillars 140 may be hollow such that cavity 148 is filled with ambient air. By compressing or flexing at a compressed state, the plurality of first pillars 140 may be configured to pump flow of ambient air held in cavity 148 in a manner complementary to the wearer's stride and to the forces applied to the anatomical structure of the wearer's foot. In some embodiments, cavity 148 may be filled with a pressurized gas having a pressure greater than ambient air (e.g., 4 PSI to 10 PSI above ambient pressure). In some embodiments, cavity 148 may be filled with a fluid containing a gel, a paste, particles (e.g., polymer particles, foam particles, cellulose particles, rock or mineral particles, rubber particles, and the like). In some embodiments, cavity 148 may be filed with a solid material, such as, a foam-based material or elastomeric-based material.

In some embodiments, the plurality of first pillars 140 may each include an aperture 146 disposed at a center of lid 144 and opening into cavity 148. Locating aperture 146 at the center of lid 144 provides more flexibility to a section of lid 144 surrounding aperture 146, thereby allowing the plurality of first pillars 140 to be deflect force away more effectively, ultimately increasing the resiliency of first pillars 140. In some embodiments, lid 144 may have a curved-shaped profile, such as, for example, being dome-shaped. By having a curved-shaped profile, such as a dome shape, lid 144 may dissipate applied forces in a direction tangential to a radius of curvature of lid 144, thereby increasing the resiliency of first pillars 140. The radius of curvature defined by the profile of lid 144 may be increased or decreased to adjust the quantity of force dissipated by the plurality of pillars 140 and the quantity of surface area of lid 144. For example, in some embodiments, the radius of curvature defined by the profile of lid 144 may be reduced to flatten lid 144, thereby providing a larger surface area on lid 144 to engage an object, such as insole 110 and/or an opposing pillar (e.g., second pillar 170) of second sole member 150.

The arrangement and number of first pillars 140 may be tuned to provide a desired cushioning effect to the wearer's foot. In some embodiments, two or more first pillars 140 may be disposed in a linear arrangement extending from lateral side 104 to medial side 105 of sole 100. In some embodiments, the plurality of first pillars 140 may be arranged in a series of rows arranged from heel region 101 to forefoot region 103 of sole 100. In some embodiments, two or more first pillars 140 may be disposed in a linear arrangement extending from heel region 101 to forefoot region 103 of sole 100. The spacing between adjacent pillars 140 may be varied to provide a desired cushioning effect to wearer's foot. For example, in some embodiments, the spacing between adjacent pillars 140 along the length of sole 100 may be uniform. In some embodiments, the spacing between adjacent first pillars 140 located in forefoot region 103 of sole 100 may be less than the spacing between adjacent first pillars 140 located in heel region 101 of sole 100, such that there is a greater number of first pillars 140 in forefoot region 103 of sole 100 than heel region 101 of sole 100. In some embodiments, the spacing between adjacent first pillars 140 located in heel region 101 of sole 100 may be less than the spacing between adjacent first pillars 140 located in forefoot region 103 of sole 100, such that there is a greater number of first pillars 140 in heel region 101 of sole 100 than heel region 103 of sole 100.

Figure 3A:
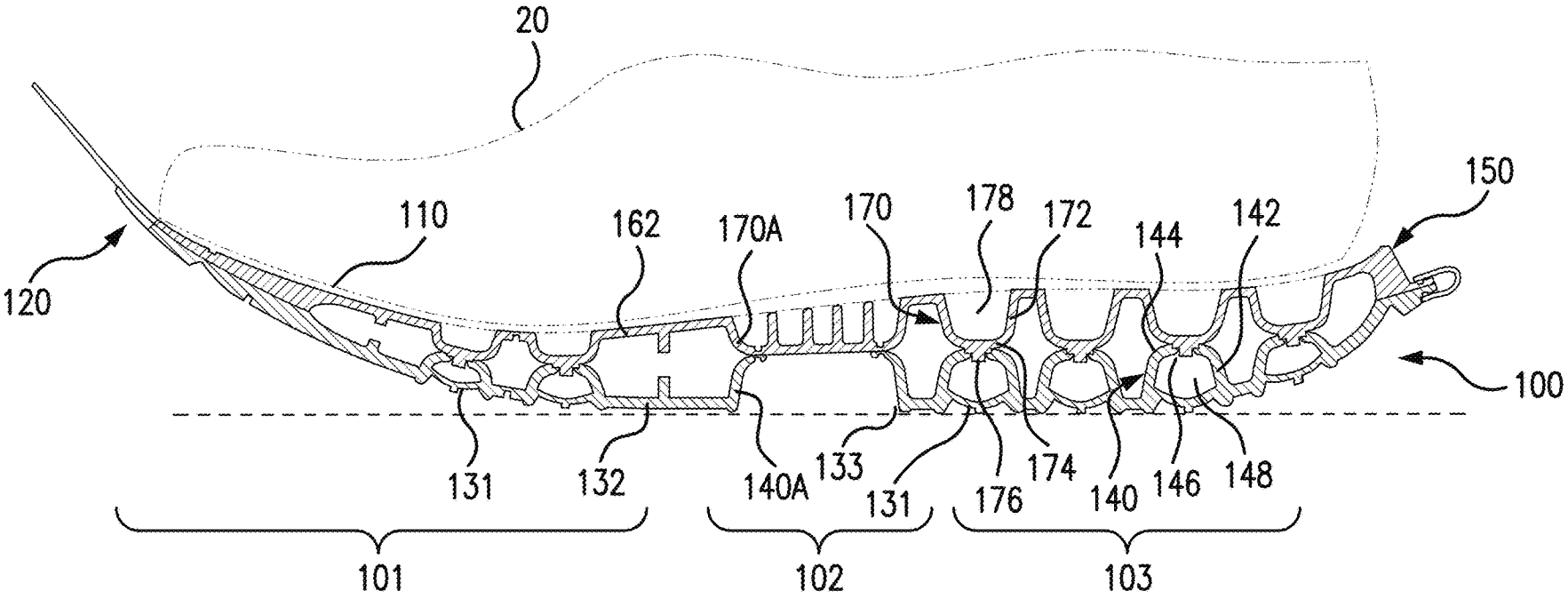
FIG. 3A shows a cross-section view of the article of footwear taken along line 3A-3A in FIG. 2 according to embodiments.
Figure 3B:
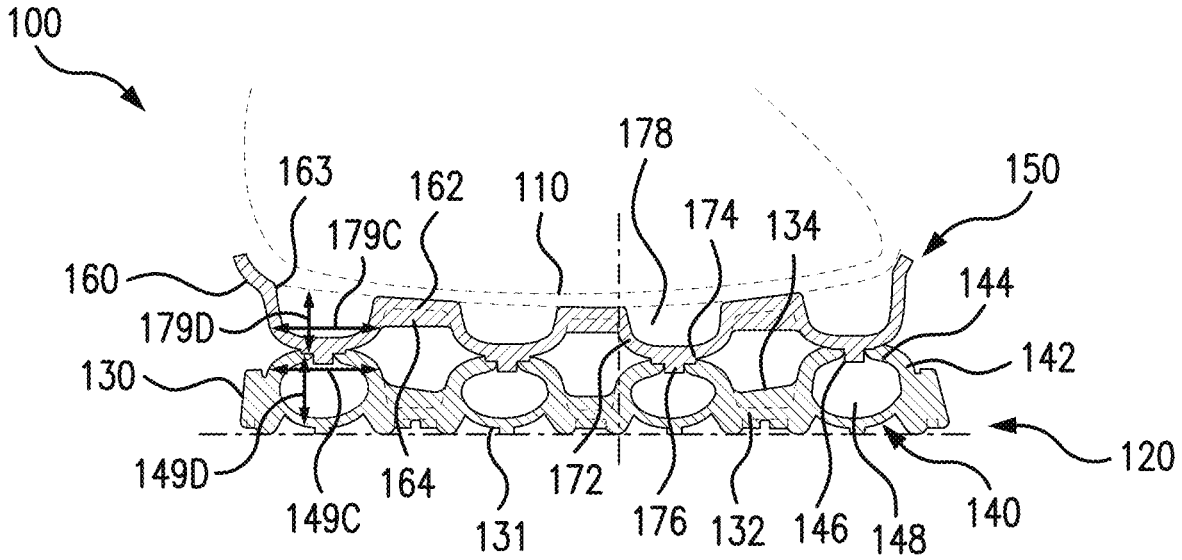
FIG. 3B shows a cross-section view of the article of footwear taken along line 3B-3B in FIG. 2 according to embodiments.
Figure 3C:
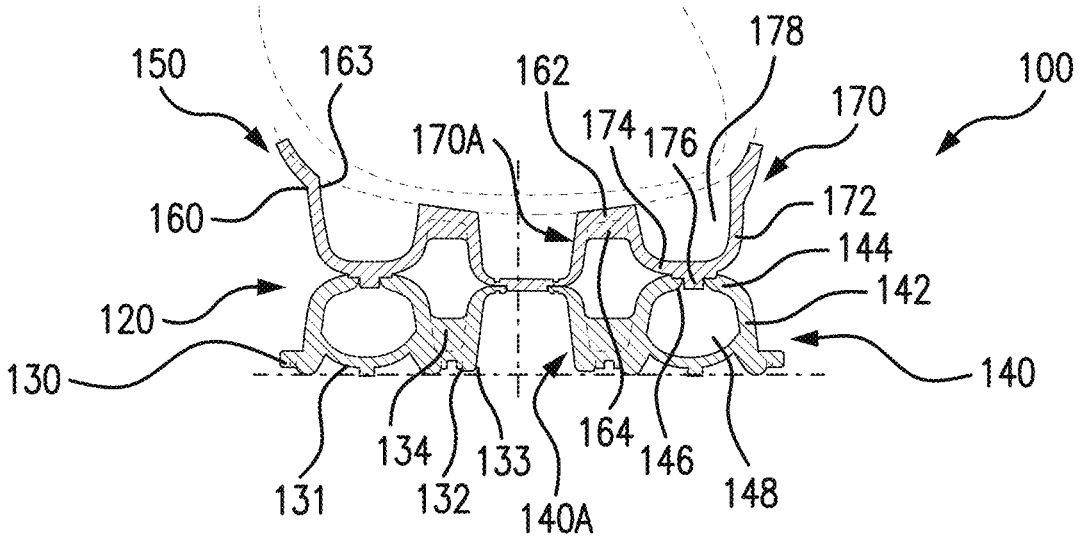
FIG. 3C shows a cross-section view of the article of footwear taken along line 3C-3C in FIG. 2 according to embodiments.
Figure 3D:
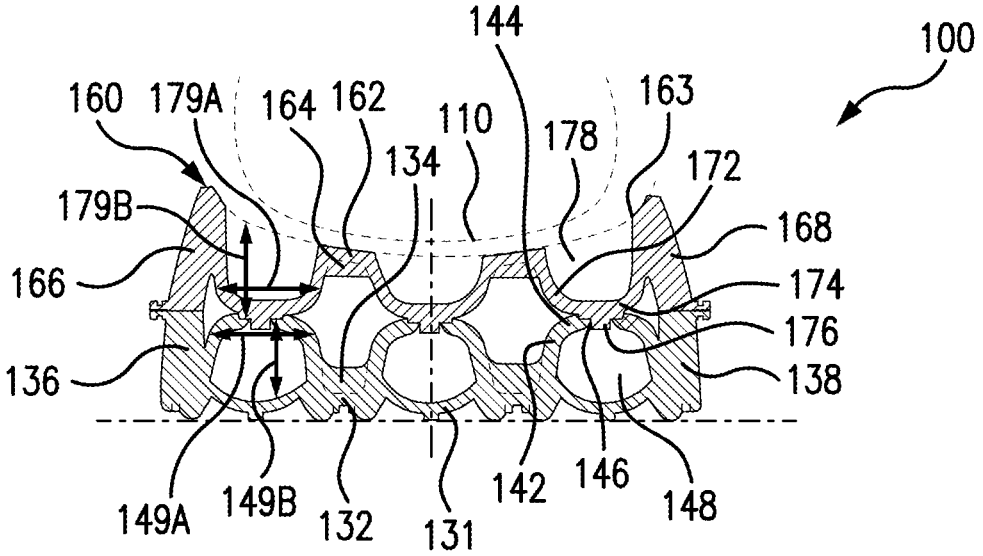
FIG. 3D shows a cross-section view of the article of footwear taken along line 3D-3D in FIG. 2 according to embodiments.

The size (e.g., diameter and height) of first pillars 140 may be varied to provide a desired cushioning effect to the wearer's foot. For example, in some embodiments, the diameter and/or width of first pillars 140 may generally decrease from the heel region 101 to the forefoot region 103. For example, as shown in FIG. 3D, first pillars 140 in heel region 101 may include a first width 149A and a first height 149B, and as shown in FIG. 3B, first pillars 140 in forefoot region 103 may include a second width 149C that is less than the first width 149A and a second height 149D that is less than the first height 149B. In the context of the present disclosure, a width corresponds to the transverse dimension defined between opposing exterior surfaces of the pillar, and a height corresponds to the vertical dimension defined from an exterior surface of the dome of the pillar to a plane defined by the upper surface of the plate of the web. In some embodiments, at least two of first pillars 140 have generally the same diameter and/or width. For example, in some embodiments, at least adjacent two first pillars 140 oriented in a lateral direction along sole 100 from lateral side 104 to medial side 105, have generally the same diameter and/or width. In some embodiments, the height of first pillars 140 may generally decrease from heel region 101 to forefoot region 103. In other embodiments, at least two of first pillars 140 have generally the same height. For example, in some embodiments, at least adjacent two first pillars 140, oriented in a lateral direction along sole 100 from lateral side 104 to medial side 105, have generally the same height. In some embodiments, at least two of first pillars 140 define cavities 148 that generally have the same volume. For example, in some embodiments, at least adjacent first pillars 140, oriented in a lateral direction along sole 100 from lateral side 104 to medial side 105, define cavities 148 having generally the same volume. In one embodiment, generally larger (e.g., diameter, width, volume, or height) first pillars 140 may be disposed in heel region 101 to provide for increased cushioning at the point of heel strike. In other embodiments, generally larger (e.g., by diameter, width, volume, or height) first pillars 140 may be disposed in forefoot region 103. In yet other embodiments, generally larger diameter, width, volume, or height) first pillars 140 may be disposed in both heel region 101 and in forefoot region 103.

In some embodiments, the height of first pillars 140 at a relaxed state (e.g., when no loads are applied to first pillar 140) may be greater than the height of a chamber defined within a sole, such as the height defined between a bottom surface of an insole and an upper surface of an outsole. By setting the height of first pillars 140 to be greater than the height defined between outsole 180 and insole 110, first pillars 140 are configured to sink to a profile of the bottom of the wearer's foot at a compressed state (e.g., when a load is applied by the wearer's foot to sole 100), thereby providing more cushioning to the wearer's foot. The height of first pillars 140 at the compressed state is less than the height of first pillars 140 at the relaxed state.

In some embodiments, the spacing between adjacent first pillars 140 may be varied according to the size of first pillars 140. For example, in some embodiments, the spacing between adjacent first pillars 140 may be reduced as the size of first pillars 140 (e.g., height or diameter) increases. In some embodiments, first pillars 140 disposed in heel region 101 of sole 100 may be larger (e.g., by height, diameter, or volume) than first pillars 140 disposed in forefoot region 103 of sole 100, and the spacing between adjacent first pillars 140 in heel region 101 of sole 100 is less than the spacing between adjacent first pillars 140 in forefoot region 103 of sole 100.

In some embodiments, first web 130 may include a plate 132 interconnecting the plurality of first pillars 140. For example, in some embodiments, the plurality of first pillars 140 may each extend from an upper surface of plate 132 toward insole 110. In some embodiments, plate 132 may extend from heel region 101 to forefoot region 103 of sole 100. In some embodiments, plate 132 may be curved along a length of sole 100 to promote forefoot strike by the wearer and help generate lift as the wearer's foot strikes the ground. For example, as shown in FIGS. 1 and 3A, plate 132 may be arch-shaped in a longitudinal direction such that plate 132 includes a curved segment disposed along heel region 101 and forefoot region 103 of sole 100 and a flat segment disposed along the arch region 102 of sole 100. In some embodiments, plate 132 may be curved in a lateral direction of sole 100. In some embodiments, plate 132 may be generally flat along a length of sole 100.

In some embodiments, first web 130 may include a plurality of strips 134 interconnecting the plurality of first pillars 140. For example, in some embodiments, a strip 134 can extend between a pair of adjacent first pillars 140 such that first pillars 140 are supported adequately in an upright position. In some embodiments, a strip 134 can extend from a first pillar 140 to a sidewall of sole 100 to support first pillar 140 in an upright position. The number and placement of strips 134 can be modified to adjust the support of first pillars 140. For example, in some embodiments, strips 134 may be disposed between every pair of adjacent first pillars 140. In some embodiments, strips 134 may be disposed between only the sidewall of sole 100 and first pillars 140 located proximate to the sidewall of sole 100. In some embodiments, strips 134 may be disposed between adjacent first pillars 140 disposed only in heel region 101 of sole 100. In some embodiments, strips 134 may be disposed between adjacent first pillars 140 disposed only in arch region 102 of sole 100. In some embodiments, strips 134 may be disposed between adjacent first pillars 140 disposed only in forefoot region 103 of sole 100. In some embodiments, the height of strips 134 located between a sidewall of sole and a respective first pillar 140 may be greater than the height of strips 134 located between adjacent first pillars 140 to prevent thinning during the molding process.

In some embodiments, first web 130 and the plurality of first pillars 140 of first sole member 120 are unitary (e.g., a single-piece configuration), such that first web 130 and the plurality first pillars 140 are integrally made from the same material. In some embodiments, first sole member 120, including first web 130 and the plurality of first pillars 140, is made of a first elastomeric material having a first modulus of elasticity configuring the plurality of first pillars 140 to flex or deform upon an application of a compressive force by the wearer and return to their original shape upon a removal of the compressive force. In some embodiments, the first elastomeric material may include a natural rubber, an ethylene propylene diene monomer (EPDM) rubber, a neoprene rubber, a silicone rubber, a nitrile rubber, a styrene-butadiene rubber, a thermoplastic rubber/elastomer, and/or a combination thereof. For example, in some embodiments, the first elastomeric material may include a high concentration of natural rubber (e.g., greater than 50% by weight) so that first elastomeric material possesses greater resiliency.

In some embodiments, outsole 180 may be coupled to selected portions of a bottom surface of first web 130 of first sole member 120. In some embodiments, outsole 180 may be coupled to entire bottom surface of first web 130 of first sole member 120. In some embodiments, all or a portion of outsole 180 may be made of a wear-resistant material, such as, for example, a second elastomeric material having a second modulus of elasticity that is greater than the first modulus of elasticity of first elastomeric material of first sole member 120. That is, in some embodiments, the second elastomeric material of outsole 180 may possess less flexibility and resiliency compared to the first elastomeric material of first sole member 120. For example, the second elastomeric material for outsole 180 may include a synthetic or a natural rubber, thermoplastic polyurethane, a wear-resistant foam, or a combination thereof. In some embodiments, the second elastomeric material may include a lower concentration of natural rubber (e.g., less than 50% by weight) than the concentration of natural rubber in the first elastomeric material so that the second elastomeric material is more wear resistant.

In some embodiments, first sole member 120 may be molded using one or more molds. In some embodiments, first sole member 120 may be manufactured and combined with outsole 180 by any suitable process, such as compression molding, injection molding, expansion molding, thermoforming, and/or the combination thereof. For example, in some embodiments, first sole member 120 may be manufactured by compression molding the first elastomeric material with a pressing machine (e.g., a hydraulic press). In some embodiments, first sole member 120 may be molded directly on outsole 180 using a compression molding technique. For example, in some embodiments, a first mold containing a sole cavity may be used with a pressing machine to press the first elastomeric material for a first time period, and then, a second mold containing a sole cavity may be used with the pressing machine to press the molded first elastomeric material on a blank second elastomeric material for a second time period to combine first sole member 120 with outsole 180, thereby providing a single integral structure containing two types of elastomeric materials—the first elastomeric material for first sole member 120 and the second elastomeric material for outsole 180. In some embodiments, additional first elastomeric material may be added to the second mold, such as around the edge of the sole cavity, after the first pressing step, to form a sidewall out of the first elastomeric material. In some embodiments, undercuts may be provided in the molds to yield the shape of first web 130 and/or first pillars 140 of first sole member 120. In some embodiments, pressing pads may be used to form first pillars 140. In some embodiments, excess materials from the molding process material may be trimmed from first sole member 120 and/or outsole 180 to yield the final shape of sole 100. In some embodiments, other techniques may be used to combine first sole member 120 with outsole 180, such as, for example, adhesive bonding, welding, and/or stitching. In some embodiments, first sole member 120 may be manufactured by any suitable molding process, such as, for example, compression molding, as an insert to be received in sole 100.

In some embodiments, second sole member 150 may include a second web 160 coupled to a bottom surface of insole 110 and disposed above first sole member 120. In some embodiments, second web 160 may extend along a length of sole 100 in any way as described above with respect to first web 130. For example, in some embodiments, second web 160 may extend from heel region 101 to forefoot region 103 of sole 100. In some embodiments, second web 160 may extend from heel region 101 to arch region 102 of sole 100. In some embodiments, second web 160 may extend from forefoot region 103 to arch region 102 of sole 100. In some embodiments, second web 160 may be disposed only in heel region 101 of sole 100. In some embodiments, second web 160 may be disposed only in arch region 102 of sole 100. In some embodiments, second web 160 may be disposed only in forefoot region 103 of sole 100.

In some embodiments, second sole member 150 may include a plurality of second pillars 170 projecting downwardly from second web 160 toward first sole member 120 to provide support for the wearer's foot. Similar to first pillars 140, the plurality of second pillars 170 are configured to compress, deflect, flex, bend, and/or deform upon an application of a compressive force by the wearer's foot (e.g., when sole 100 strikes the ground during a the wearer's gait cycle) and return to their original shape (e.g., stand upright) upon a removal of the compressive force, such that the plurality of second pillars 170 absorb shock imparted from the ground surface during the wearer's gait cycle. For example, in some embodiments, the plurality of second pillars 170 may be configured to configured to compress, deflect, flex, bend, and/or deform at a compressed state (e.g., when sole 100 strikes the ground) and configured to stand upright at a relaxed state (e.g., when sole 100 elevates above the ground). In some embodiments, the plurality of second pillars 170 are configured to return from the compressed state to the relaxed state without incurring permanent buckling or plastic deformation. By demonstrating high resiliency—flexing or bending at a compressed state and returning to stand upright at a relaxed state—the plurality of second pillars 170 absorb a significant amount of shock that provides a desirable cushioning effect to wearer's foot.

The shape of second pillars 170 may be tuned in any way as described above with respect to first pillar 140 to achieve optimum cushioning and support to the foot of the wearer. For example, in some embodiments, the plurality of second pillars 170 may each include a curved sidewall 172, such as a cylindrical-shaped sidewall. In some embodiments, the plurality of second pillars 170 may each include a base 174 extending from a lower end of curved sidewall 172. In some embodiments, curved sidewall 172 and base 174 collectively define a cavity 178. In some embodiments, cavity 178 may be filled with ambient air. In some embodiments, cavity 178 may be filled with a pressurized gas having a pressure greater than ambient air. In some embodiments, cavity 178 may be filled with a fluid containing a gel, a paste, particles (e.g., polymer particles, foam particles, cellulose particles, rock or mineral particles, rubber particles, and the like). In some embodiments, cavity 178 may be filed with a solid material, such as, a foam-based material or elastomeric-based material. In some embodiments, the shape of second pillars 170 may be the same as the shape of first pillars 140. In some embodiments, the shape of second pillars 170 may be different than the shape of first pillars 140.

The arrangement and number of second pillars 170 may be tuned in any way as described above with respect to first pillar 140 to provide a desired cushioning effect to the wearer's foot. For example, in some embodiments, the plurality of second pillars 170 may be axially aligned with respect to the plurality of first pillars 140. In some embodiments, base 174 of each second pillar 170 may engage lid 144 of a respective first pillar 140 such that each pair of vertically aligned first pillar 140 and second pillar 170 are engaged against each other. In some embodiments, the plurality of second pillars 170 may each be interlocked to a respective first pillar 140. For example, in some embodiments, the plurality of second pillars 170 may each include a pin 176 projecting downwardly from a center of base 174 and is received in aperture 146 of a respective first pillar 140. In some embodiments, base 174 of second pillars 170 may be bonded (e.g., using an adhesive) with lid 144 of first pillars 140 to provide an interlock arrangement. The interlock arrangement between first pillars 140 and second pillars 170 provides more stability to sole 100 and allows first pillars 140 and second pillars 170 to flex, bend, deflect, and/or deform in a similar motion, thereby absorbing more shock from sole 100 contacting the ground.

In some embodiments, second web 160 may include a plate 162 interconnecting the plurality of second pillars 170 in any way as described above with respect to plate 132 and first pillars 140. For example, in some embodiments, the plurality of second pillars 170 may each extend from a lower surface of plate 162 toward insole 110. In some embodiments, plate 162 may extend from heel region 101 to forefoot region 103 of sole 100. In some embodiments, plate 162 may be curved along a length of sole 100 to promote forefoot strike by the wearer and help generate lift as the wearer's foot strikes the ground. For example, as shown in FIGS. 1 and 3A, plate 162 may include a curved segment disposed along forefoot region 103 and arch region 102 of sole 100 and a flat segment disposed along heel region 101 of sole 100 to promote toe drop during the wearer's gait cycle. In some embodiments, plate 162 may be curved in a lateral direction of sole 100 so that plate 162 is configured to receive insole 110. In some embodiments, plate 162 may be generally flat along a length of sole 100.

In some embodiments, second web 160 may include a plurality of strips 164 interconnecting the plurality of second pillars 170. The plurality of strips 164 may be arranged in any way as described above with respect to strips 134 of first web 130. For example, in some embodiments, a strip 164 can extend between a pair of adjacent second pillars 170 such that second pillars 170 are supported adequately in an upright position. In some embodiments, a strip 164 can extend from a second pillar 170 to a sidewall of sole 100 to support second pillar 170 in an upright position. The number and placement of strips 164 can be modified to adjust the support of second pillars 170. For example, in some embodiments, strips 164 may be disposed between every pair of adjacent second pillars 170. In some embodiments, strips 164 may be disposed between only the sidewall of sole 100 and second pillars 170 located proximate to the sidewall of sole 100. In some embodiments, strips 164 may be disposed between adjacent second pillars 170 disposed only in heel region 101 of sole 100. In some embodiments, strips 164 may be disposed between adjacent second pillars 170 disposed only in arch region 102 of sole 100. In some embodiments, strips 164 may be disposed between adjacent second pillars 170 disposed only in forefoot region 103 of sole 100.

In some embodiments, second web 160 and the plurality of second pillars 170 of second sole member 150 are unitary (e.g., a single-piece configuration), such that second web 160 and the plurality second pillars 170 are integrally made from the same material. In some embodiments, second sole member 150, including second web 160 and the plurality of second pillars 170, is made of an elastomeric material, such as, for example, the first elastomeric material described above with respect to first sole member 120, such that the plurality of second pillars 170 are configured to flex or deform upon an application of a compressive force by the wearer and return to their original shape upon a removal of the compressive force. In some embodiments, second sole member 150 may be made from an elastomeric material that includes a natural rubber, an ethylene propylene diene monomer (EPDM) rubber, a neoprene rubber, a silicone rubber, a nitrile rubber, a styrene-butadiene rubber, a thermoplastic rubber/elastomer, and/or a combination thereof. In some embodiments, second sole member 150 may be made from an elastomeric material that is different than the first elastomeric material. For example, in some embodiments, second sole member 150 may be made from an elastomeric material that includes a modulus of elasticity greater than the first modulus of elasticity so that second sole member 150 possesses less flexibility and resiliency than first sole member 120. In some embodiments, second sole member 150 may be made from a foam-based material, such as, for example, a foam made from ethyl-vinyl-acetate (EVA) and/or polyurethane.

In some embodiments, second sole member 150 may be manufactured by the same or similar techniques used for making first sole member 120, as described herein.

Various modifications can be made to first sole member 120, second sole member 150, and/or outsole 180 and additional materials, such as a midsole, can be implemented with sole 100 to provide a desirable cushioning effect to wearer's foot, while creating an attractive aesthetic appeal to article of footwear, as shown in the various embodiments described below.

In some embodiments, the sole may include a first sole member and a second sole member to provide two layers of corresponding pillars that eliminate the need for additional cushioning materials. For example, in accordance with the embodiment shown in FIGS. 1-3E, both first sole member 120 and second sole member 150 may be made entirely from an elastomeric-material, such as the first elastomeric-material. In some embodiments, sole 100 shown in FIGS. 1-3E may be devoid of any foam-based materials.

In some embodiments, second web 160 of second sole member 150 may include plate 162 shaped to receive insole 110 and a bottom of the wearer's foot. In some embodiments, second sole member 150 may include the plurality of second pillars 170 projecting downwardly from the bottom surface of plate 162. As shown in FIG. 3A, the size (e.g., height and/or diameter) of second pillars 170 in heel region 101 may be larger than the size (e.g., height and/or diameter) of second pillars 170 in forefoot region 103. For example, as shown in FIG. 3D, second pillars 170 in heel region 101 may include a first width 179A and a first height 179B, and as shown in FIG. 3B, second pillars 170 in forefoot region 103 may include a second width 179C that is less than the first width 179A and a second height 179D that is less than the first height 179B. In some embodiments, the plurality of second pillars 170 may include a central second pillar 170A disposed in a central position in arch region 102 of sole 100. In some embodiments, the size (e.g., height, length, or width) of central second pillar 170A may be larger than the size (e.g., height, length, or width) of the remaining second pillars 170, and the shape of central second pillar 170A may be different than the shape of the remaining second pillars 170.

In some embodiments, as shown in FIGS. 1 and 3A, for example, first web 130 of first sole member 120 may include plate 132 defining an arch-shaped profile along a longitudinal direction of sole 100. In some embodiments, first sole member 120 may include the plurality of first pillars 140 projecting upwardly from the upper surface of plate 132. As shown in FIG. 3A, the size (e.g., height and/or diameter) of first pillars 140 in heel region 101 may be larger than the size of first pillars 140 (e.g., height and/or diameter) in forefoot region 103. In some embodiments, the plurality of first pillars 140 may include a central first pillar 140A disposed in a central position in arch region 102 of sole 100. In some embodiments, the size (e.g., height, length, or width) of central first pillar 140A may be larger than the size (e.g., height, length, or width) of the remaining first pillars 140, and the shape of central first pillar 140A may be different than the shape of the remaining first pillars 140.

In some embodiments, the plurality of first pillars 140 are axially aligned with respect to the plurality of second pillars 170 in a vertical direction. With reference to FIGS. 3A-3E, lid 144 of each first pillar 140 may engage base 174 of a respective second pillar 170. In some embodiments, pin 176 of each second pillar 170 may be received in aperture 146 of a respective first pillar 140 so that first pillars 140 are interlocked with second pillars 170. In some embodiments, a set of first pillars 140 and second pillars 170 disposed adjacent to medial side 105 of sole 100 may aligned with respect to a set of first pillars and second pillars 170 disposed adjacent to lateral side 104 of sole 100. In some embodiments, a set of first pillars 140 and second pillars 170 disposed adjacent to medial side 105 of sole 100 may be offset with respect to a set of first pillars and second pillars 170 disposed adjacent to lateral side 104 of sole 100.

In some embodiments, as shown in FIGS. 3A-3E, first web 130 may include a plurality of bosses 131 projecting from a bottom surface of plate 132. In some embodiments, the plurality of bosses 131 may be axially aligned with respect to the plurality of first pillars 140. In some embodiments, plate 132 of first web 130 may include a hole 133 axially aligned with central first pillar 140A, and hole 133 may open into cavity 148 of central first pillar 140A. In some embodiments, plate 162 of second web 160 may include a plurality of holes 163 each opening into cavity 178 of a respective second pillar 170.

In some embodiments, as shown in FIGS. 1-3E, for example, first web 130 may include a first lateral sidewall 136 disposed on a lateral side of plate 132 and a first medial sidewall 138 disposed on a medial side of plate 132. In some embodiments, the plurality of first pillars 140 are arranged in a series of rows, where each row of first pillars 140 extends in a lateral direction along sole 100. In some embodiments, at least one of the rows of first pillars 140 are disposed between first lateral sidewall 136 and first medial sidewall 138. For example, as shown in FIG. 1, 3D, 3E, first lateral sidewall 136 and first medial sidewall 138 may be disposed only in heel region 101 of sole 100, and only the rows of first pillars 140 disposed in heel region 101 of sole 100 are disposed between first lateral sidewall 136 and first medial sidewall 138. In some embodiments, first lateral sidewall 136 and first medial sidewall 138 may be only in forefoot region 103 of sole 100, and only the rows of first pillars 140 disposed in forefoot region 103 of sole 100 are disposed between first lateral sidewall 136 and first medial sidewall 138. In some embodiments, first lateral sidewall 136 and first medial sidewall 138 may extend along the entire length of sole 100, and all the rows of first pillars 140 are disposed between first lateral sidewall 136 and first medial sidewall 138.

In some embodiments, as shown in FIGS. 1-3E, for example, second web 160 may include a second lateral sidewall 166 disposed on a lateral side of plate 162 and a second medial sidewall 168 disposed on a medial side of plate 162. In some embodiments, the plurality of second pillars 170 are arranged in a series of rows, where each row of second pillars 140 extends in a lateral direction along sole 100. In some embodiments, at least one of the rows of second pillars 170 are disposed between second lateral sidewall 166 and second medial sidewall 168. For example, as shown in FIG. 1, 3D, 3E, second lateral sidewall 166 and second medial sidewall 168 may be disposed only in heel region 101 of sole 100, and only the rows of second pillars 170 disposed in heel region 101 of sole 100 are disposed between second lateral sidewall 166 and second medial sidewall 168. In some embodiments, second lateral sidewall 166 and second medial sidewall 168 may be only in forefoot region 103 of sole 100, and only the rows of second pillars 170 disposed in forefoot region 103 of sole 100 are disposed between second lateral sidewall 166 and second medial sidewall 168. In some embodiments, second lateral sidewall 166 and second medial sidewall 168 may extend along the entire length of sole 100, and all the rows of second pillars 170 are disposed between second lateral sidewall 166 and second medial sidewall 168.

Figure 3E:
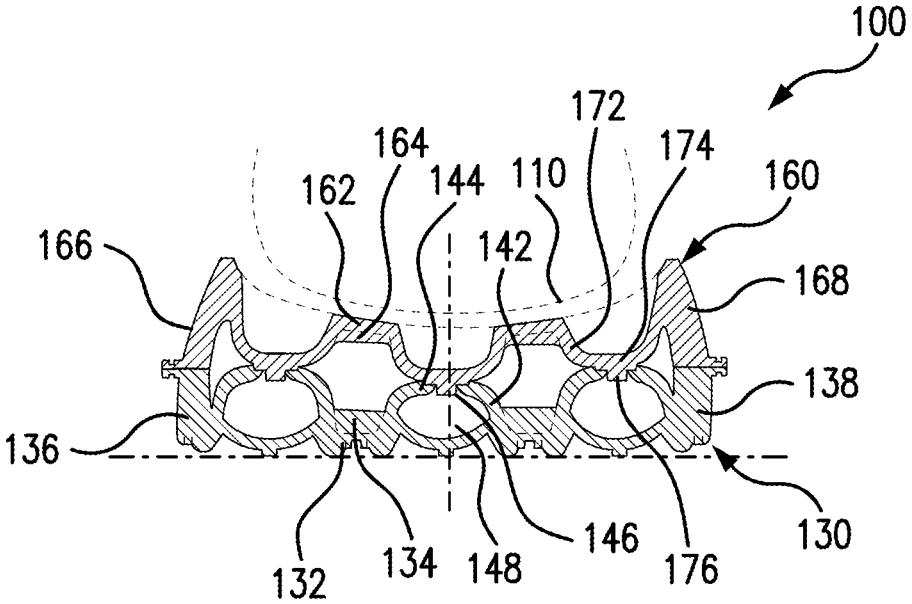
FIG. 3E shows a cross-section view of the article of footwear taken along line 3E-3E in FIG. 2 according to embodiments.
Figure 4:
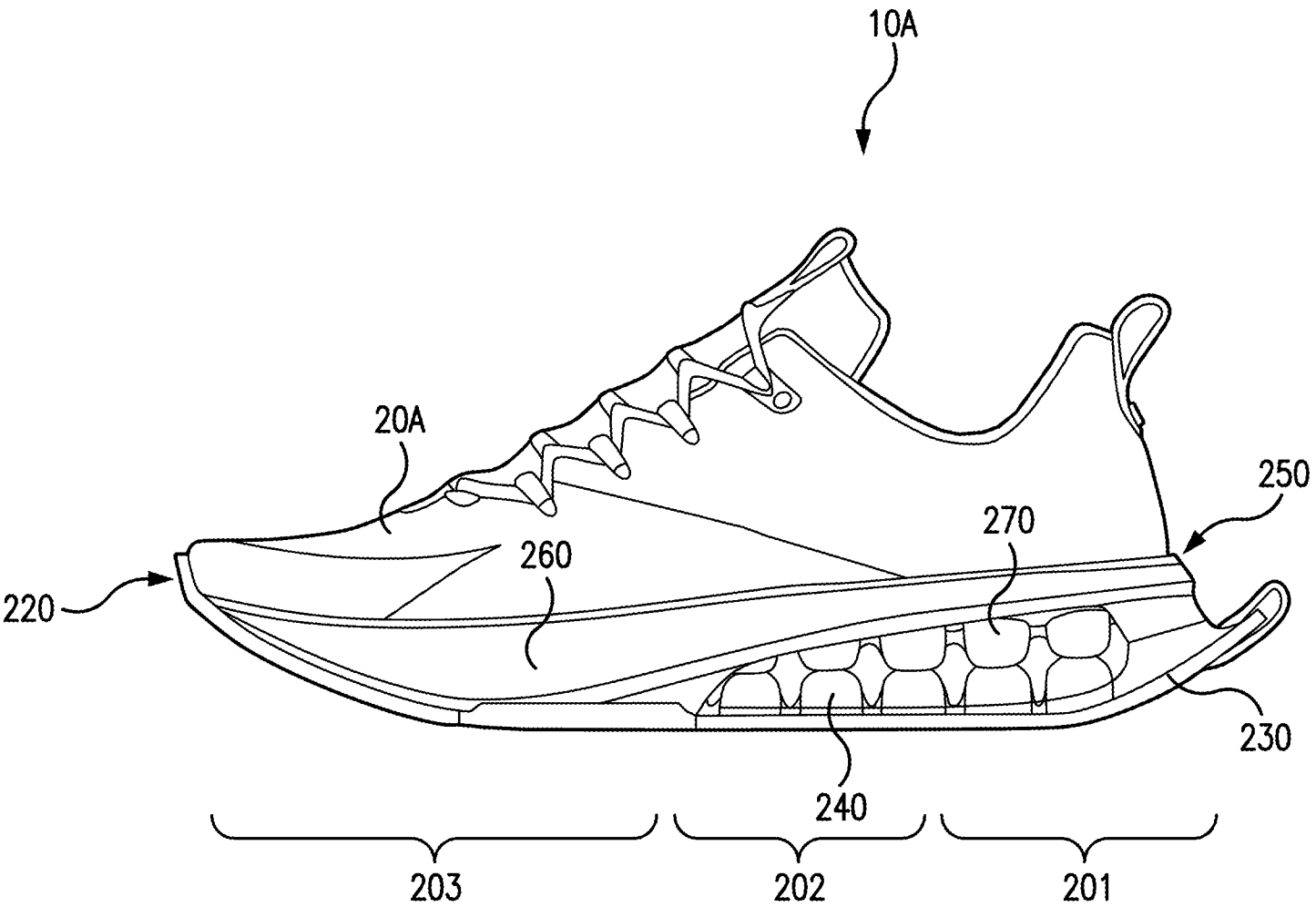
FIG. 4 shows a side view of an article of footwear according to embodiments.
Figure 5:
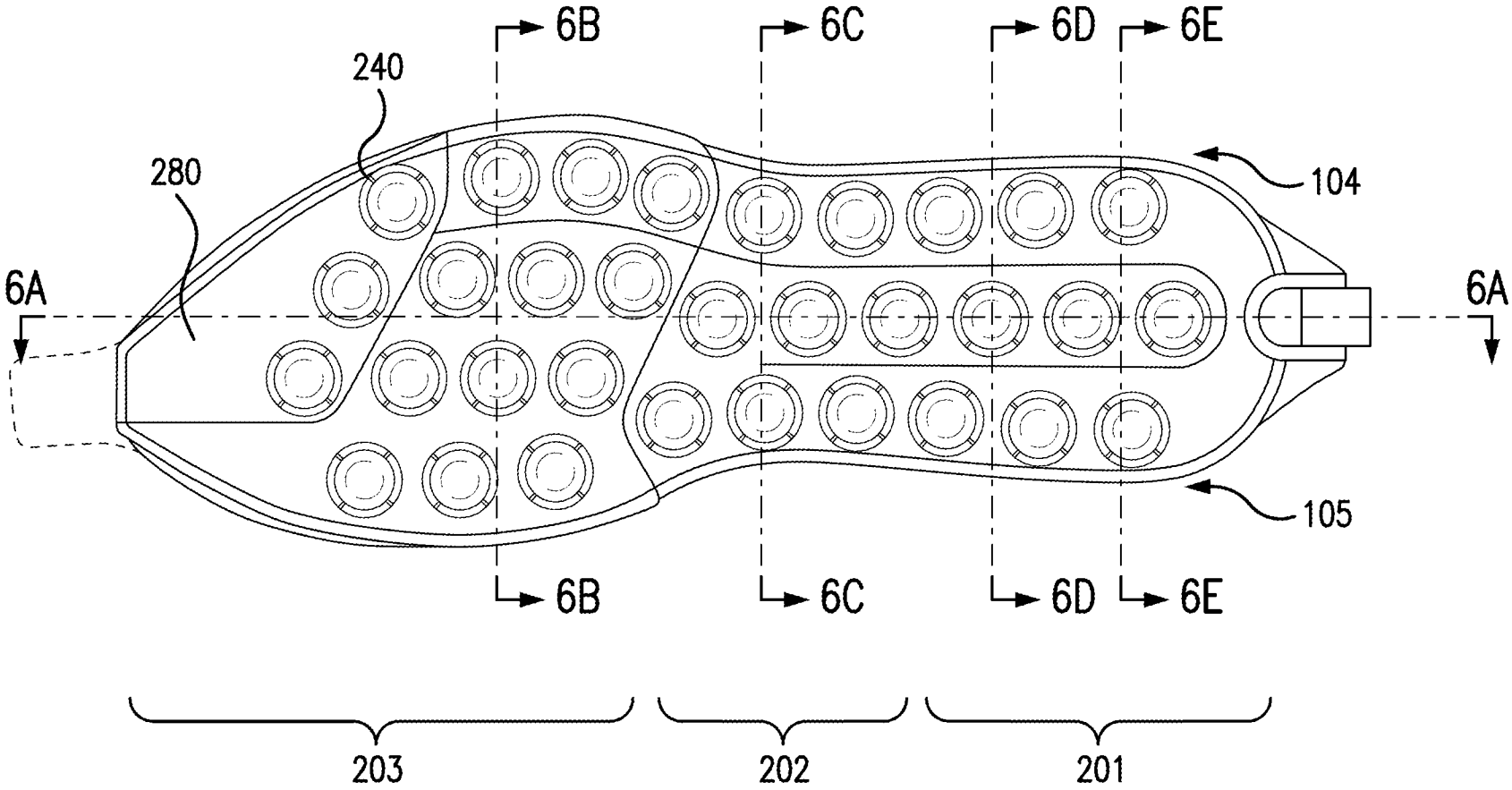
FIG. 5 shows a bottom view of the article of footwear shown in FIG. 4 according to embodiments.

In some embodiments, as shown in FIGS. 3D and 3E, first lateral sidewall 136 and second lateral sidewall 166 may terminate in a vertical direction approximately at a plane defined by lids 144 of first pillars 140 and/or by bases 174 of second pillars 170 such that a bottom surface of second lateral sidewall 166 engages an upper surface of first lateral sidewall 136. In some embodiments, first medial sidewall 138 and second medial sidewall 168 may terminate approximately at a plane defined by lids 144 of first pillars 140 and/or bases 174 of second pillars 170 such that a bottom surface of second medial sidewall 168 engages an upper surface of first medial sidewall 138. In some embodiments, first lateral sidewall 136 and first medial sidewall 138 may extend in a vertical direction from plate 132 of first web 130 to plate 162 of second web 160. In some embodiments, second lateral sidewall 166 and second medial sidewall 168 may extend in a vertical direction from plate 162 of second web 160 to plate 132 of first web 130. In some embodiments, the length of first lateral sidewall 136 and first medial sidewall 138 may correspond to the length of second lateral sidewall 166 and second medial sidewall 168. In some embodiments, the length of first lateral sidewall 136 and first medial sidewall 138 may be different than (e.g., shorter or longer) than the length of second lateral sidewall 166 and second medial sidewall 168. In some embodiments, first lateral and medial sidewalls 136, 138 and second lateral and medial sidewalls 166, 168 may terminate in a longitudinal direction at a space defined between adjacent first and/or second pillars 140, 1470.

In some embodiments, the second sole member may be made of a different material than the first elastomeric material of the first sole member and may include a different geometric configuration than the shape of the first sole member. For example, FIGS. 4-6E illustrate an article of footwear 10A having an upper 20A and a sole 200 coupled to the upper 20 according to one embodiment of the present disclosure. In some embodiments, sole 200 may include an insole 210, a first sole member 220, and a second sole member 250 disposed below insole 210 and above first sole member 220.

In some embodiments, first sole member 220 may include the same and/or similar features of first sole member 120 described herein. For example, in some embodiments, first sole member 220 may include a first web 230 having a plate 232 extending from a heel region 201 to a forefoot region 203 of sole 200, and first sole member 220 may include a plurality of first pillars 240 projecting upwardly from an upper surface of plate 232 to support the wearer's foot. In some embodiments, as shown in FIGS. 6A-6E, the plurality of first pillars 240 may each include a curved sidewall 242 and a dome-shaped lid 244 extending from an upper end of curved sidewall 242, in which sidewall 242 and lid 244 define a void cavity 248. In some embodiments, lid 244 may include a solid surface without including any apertures opening into cavity 248. In some embodiments, plate 232 of first web 230 may include a plurality of holes 233 that are axially aligned with the plurality of first pillars 240 and open into cavity 248. In some embodiments, first web 230 and the plurality of first pillars 240 of first sole member 220 are unitary (e.g., a single-piece configuration), such that first web 230 and the plurality first pillars 240 are integrally made from the same material, such as, for example, the first elastomeric-based material described herein.

Figure 6A:
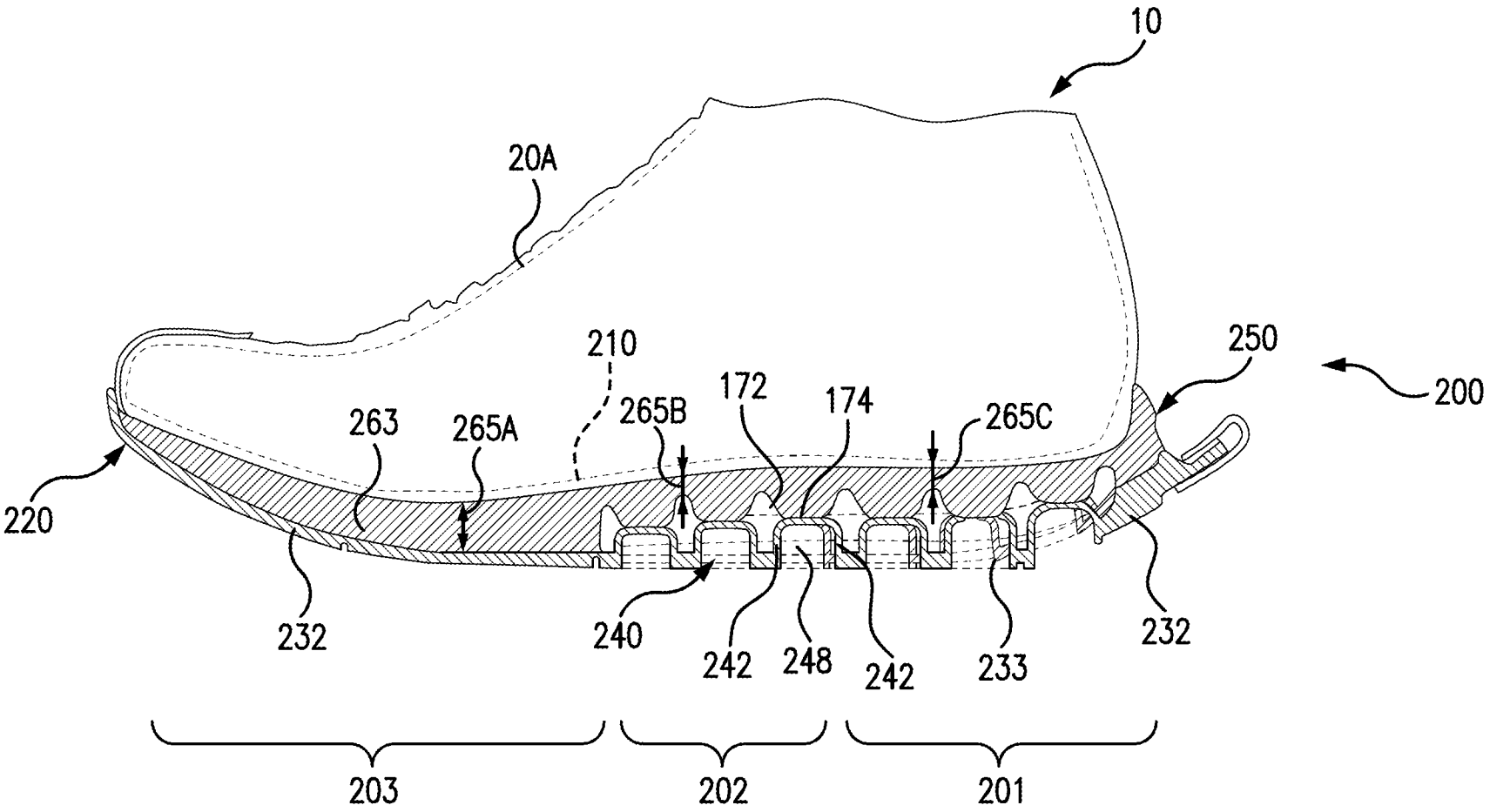
FIG. 6A shows a cross-section view of the article of footwear taken along line 6A-6A in FIG. 5 according to embodiments.
Figure 6B:
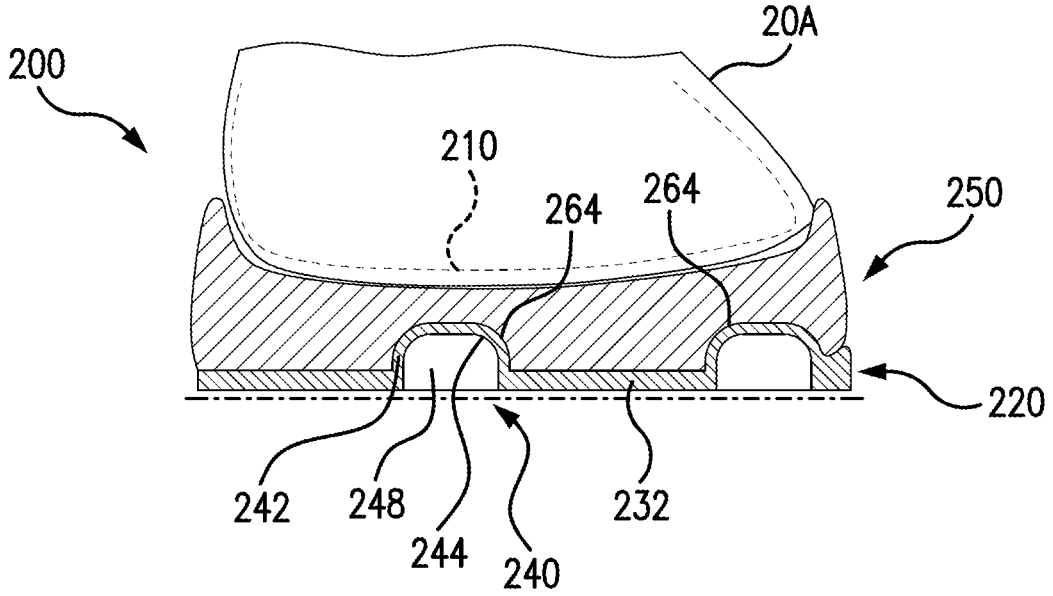
FIG. 6B shows a cross-section view of the article of footwear taken along line 6B-6B in FIG. 5 according to embodiments.
Figure 6C:
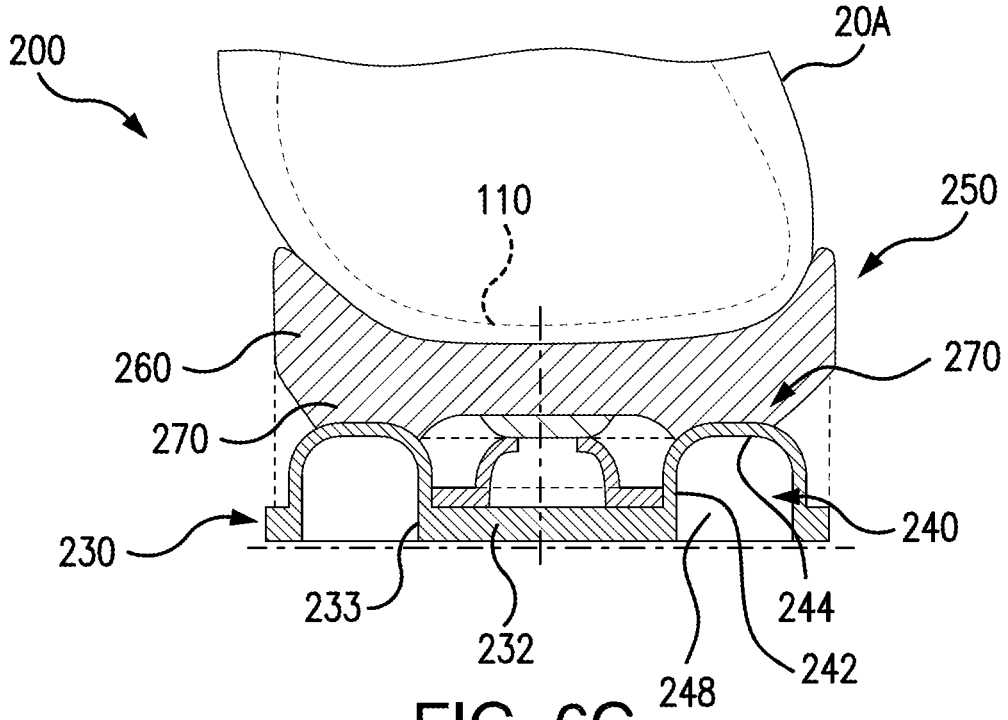
FIG. 6C shows a cross-section view of the article of footwear taken along line 6C-6C in FIG. 5 according to embodiments.
Figure 6D:
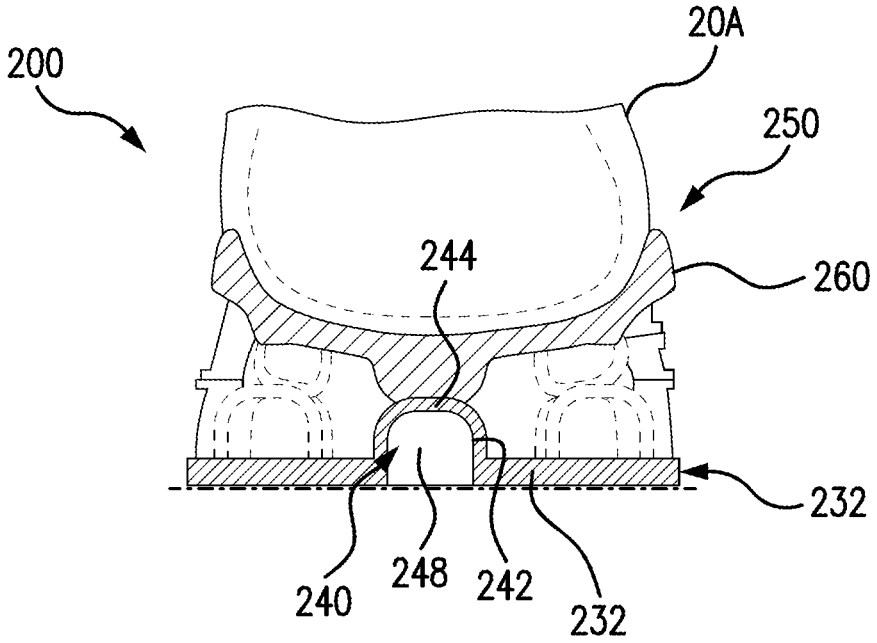
FIG. 6D shows a cross-section view of the article of footwear taken along line 6D-6D in FIG. 5 according to embodiments.
Figure 6E:
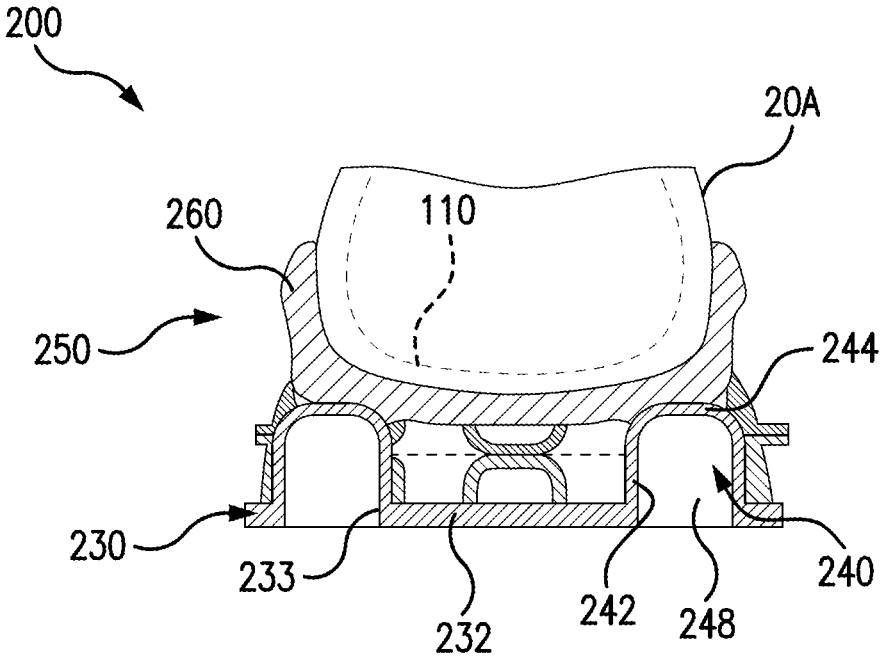
FIG. 6E shows a cross-section view of the article of footwear taken along line 6E-6E in FIG. 5 according to embodiments.
Figure 7:
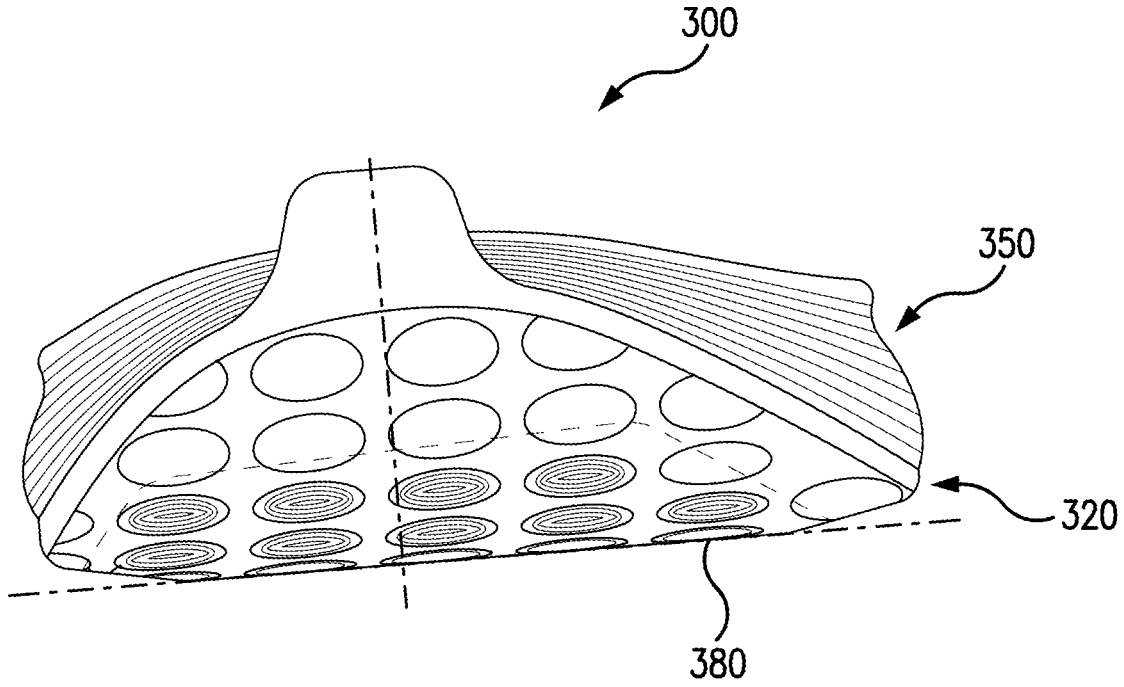
FIG. 7 shows a front perspective view of a sole for an article of footwear according to embodiments.
Figure 8:
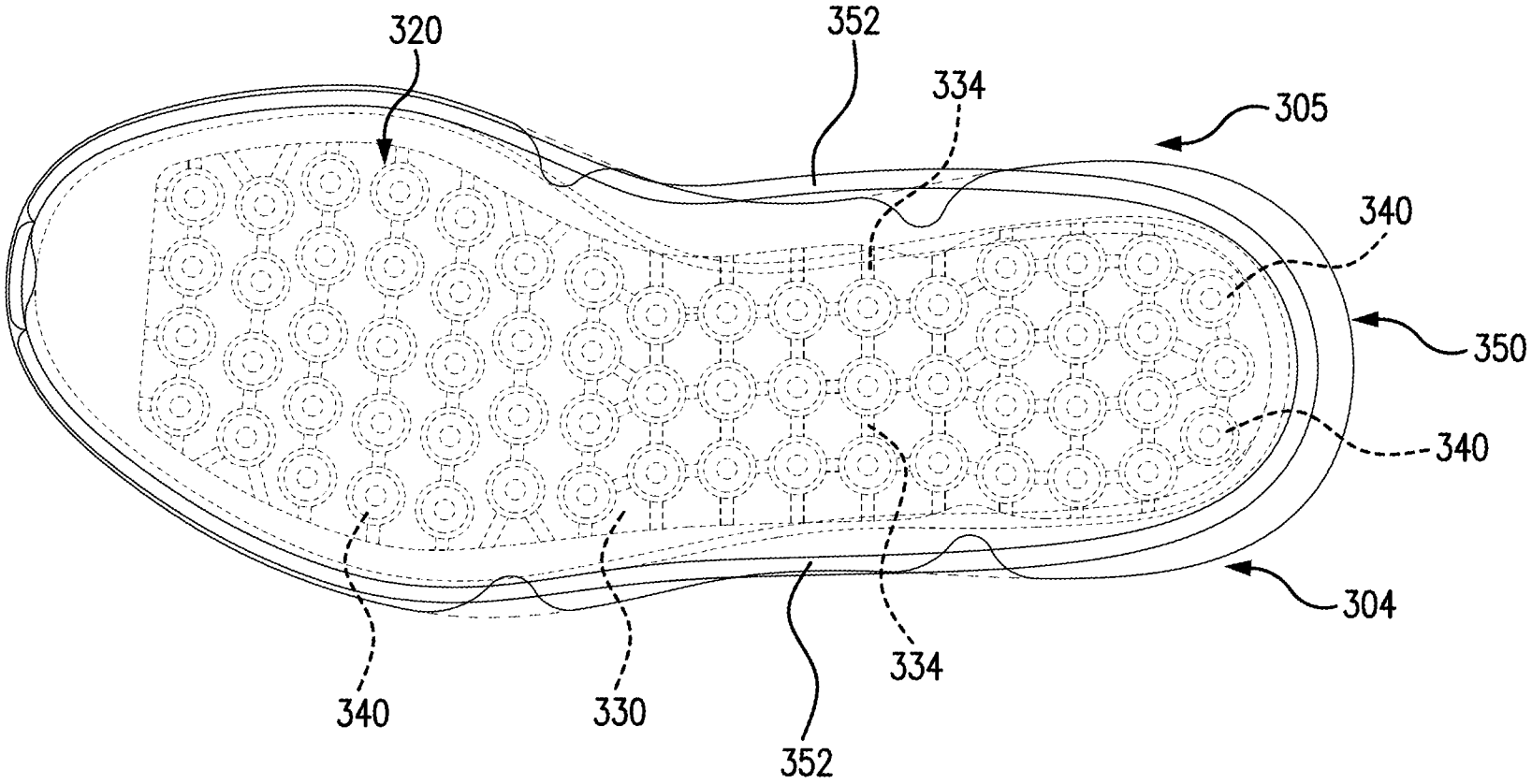
FIG. 8 shows a top view of the sole shown in FIG. 7 according to embodiments.
Figure 9:
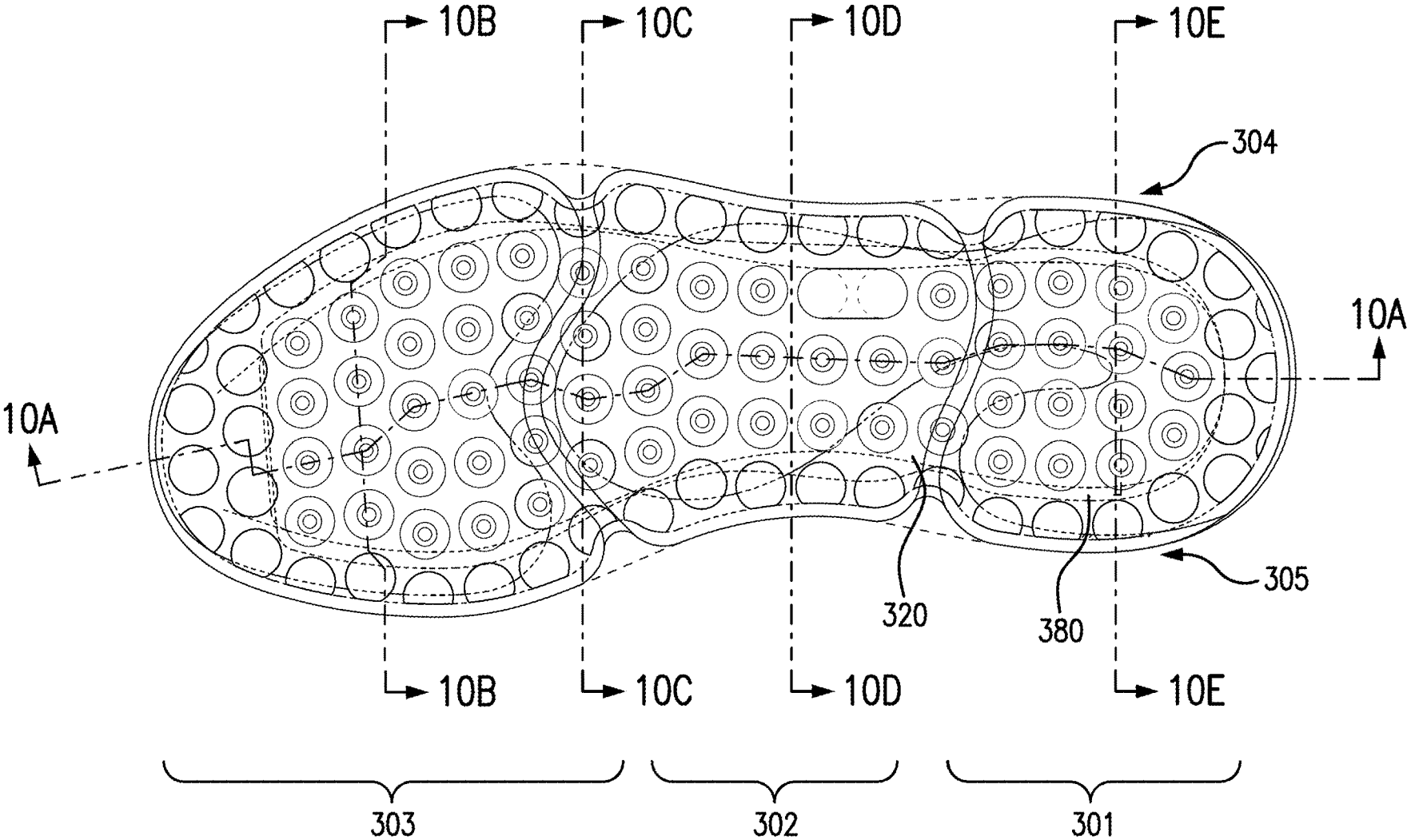
FIG. 9 shows a bottom view of the sole shown in FIG. 7 according to embodiments.

In some embodiments, second sole member 250 may include the same and/or similar features of second sole member 150 described herein. For example, in some embodiments, second sole member 250 may include a second web 260 having a plate 262 extending from a heel region 201 to a forefoot region 203 of sole 200, and second sole member 250 may include a plurality of second pillars 270 projecting downwardly from a lower surface of plate 262 to support the wearer's foot. In some embodiments, as shown in FIGS. 4-6A, for example, the plurality of second pillars 270 are disposed only in heel region 201 and arch region 202 of sole 200 and not disposed in forefoot region 203 of sole 200. In some embodiments, second sole member 250, including second web 260 and second pillars 270, may be solid formed from a material (e.g., an EVA foam material) different than the first elastomeric material of first sole member 220. For example, as shown in FIGS. 6A-6E, the plurality of second pillars 270 may be filled with a solid material, such as a foam-based material (e.g., EVA foam) and/or an elastomer-based material. In some embodiments, the height of plate 262 increases at a transition from arch region 202 to forefoot region 203 of sole 200 such that a forefoot section 263 of plate 262 includes a height 265A that is greater than a height 265B of plate 262 along arch region 202 and a height 265C of plate 262 along heel region 201 of sole 200. In some embodiments, as shown in FIG. 6B, forefoot section 263 of plate 262 may include a plurality of recesses 264 axially aligned with respect to the plurality of first pillars 240 disposed in forefoot region 203 of sole 200, and the plurality of recesses 264 each receive a respective first pillar 240 of first sole member 220.

In some embodiments, additional materials, such as a midsole made of a foam-based material, may be added to the sole with the first sole member to achieve a particular cushioning effect. For example, FIGS. 7-11E illustrate a sole 300 according to some embodiments of the present disclosure. In some embodiments, sole 300 may include an insole 310, a midsole 350 coupled to insole 310, a first sole member 320 coupled to midsole 350, and an outsole 380 coupled to first sole member 320 and midsole 350.

Figure 10A:
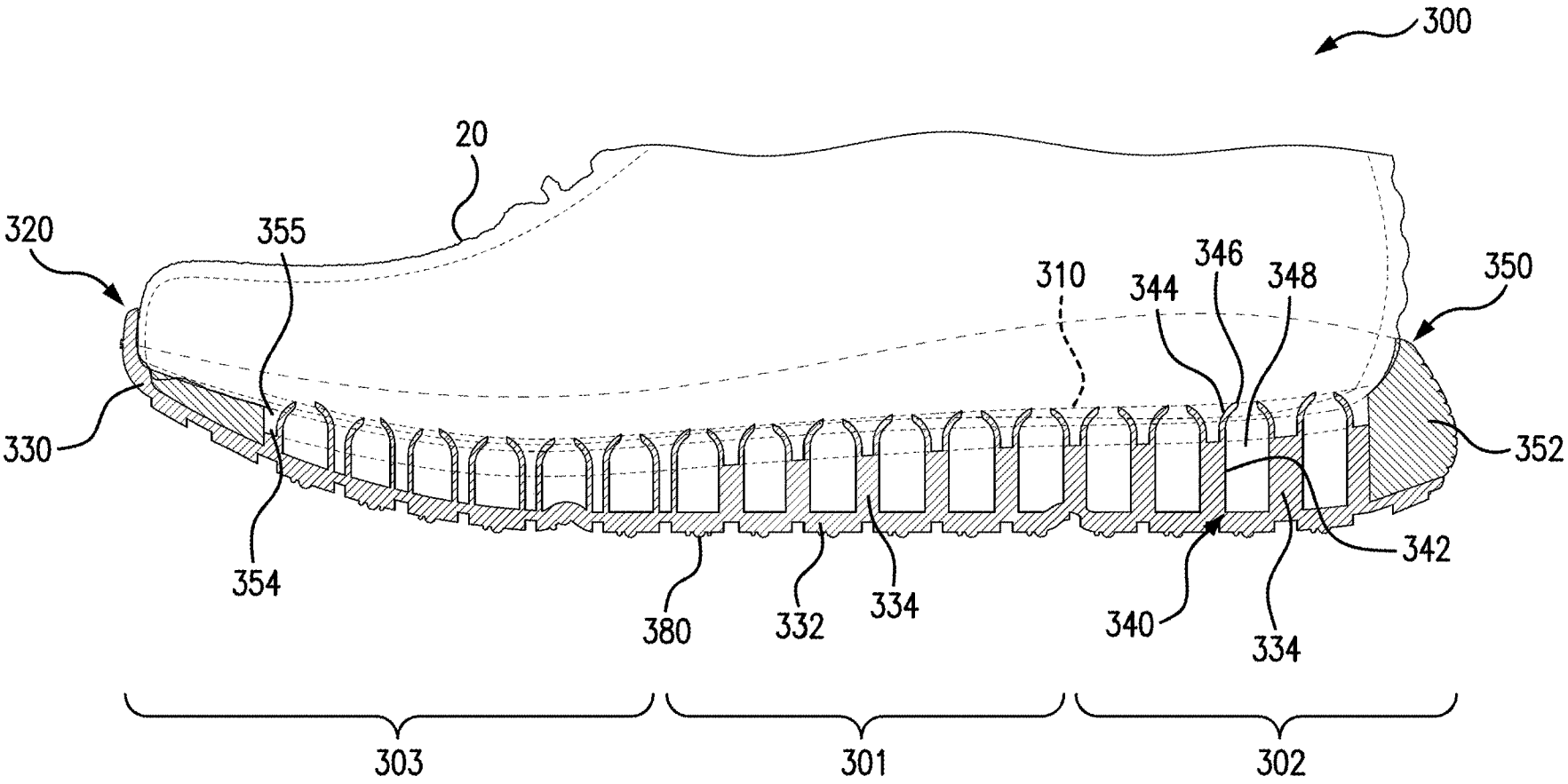
FIG. 10A shows a cross-section view of the sole taken along line 10A-10A in FIG. 9 according to embodiments.
Figure 10B:
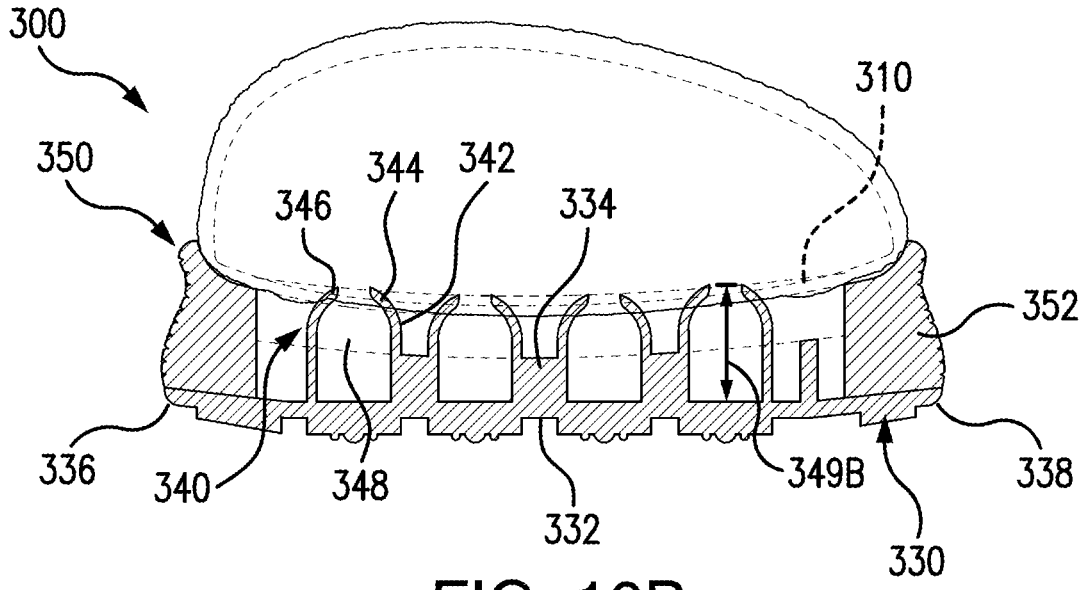
FIG. 10B shows a cross-section view of the sole taken along line 10B-10B in FIG. 9 according to embodiments.
Figure 10C:
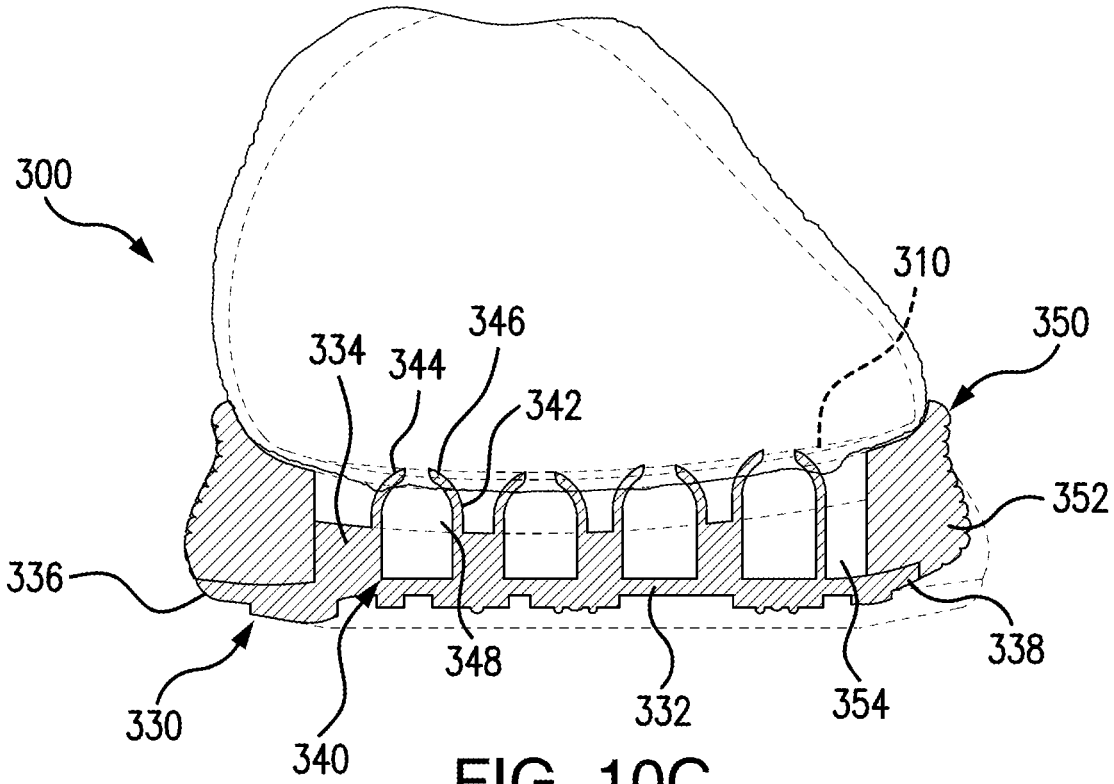
FIG. 10C shows a cross-section view of the sole taken along line 10C-10C in FIG. 9 according to embodiments.
Figure 10D:
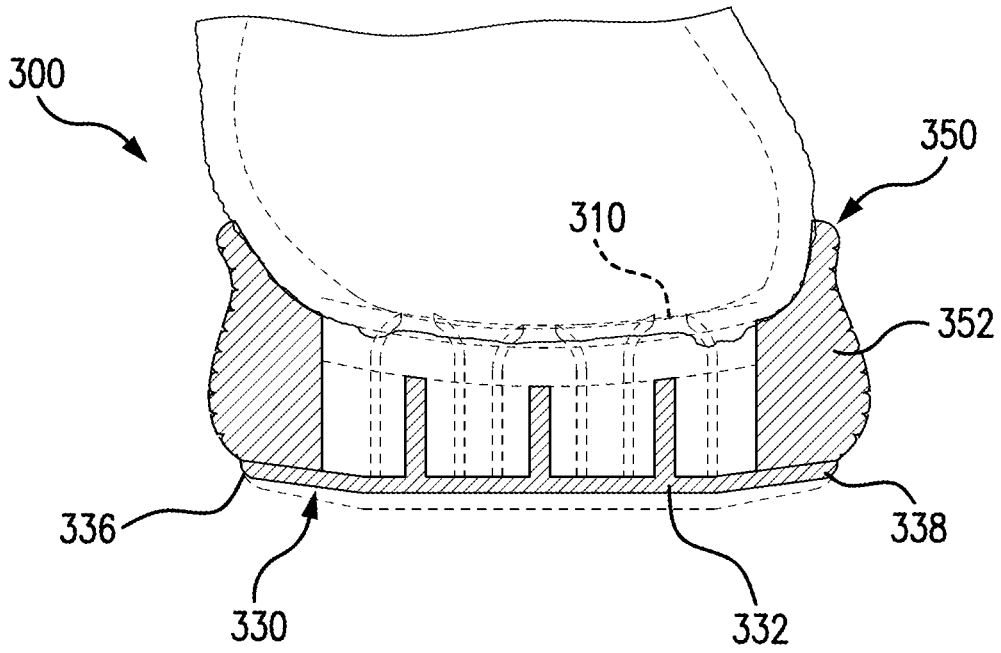
FIG. 10D shows a cross-section view of the sole taken along line 10D-10D in FIG. 9 according to embodiments.
Figure 10E:
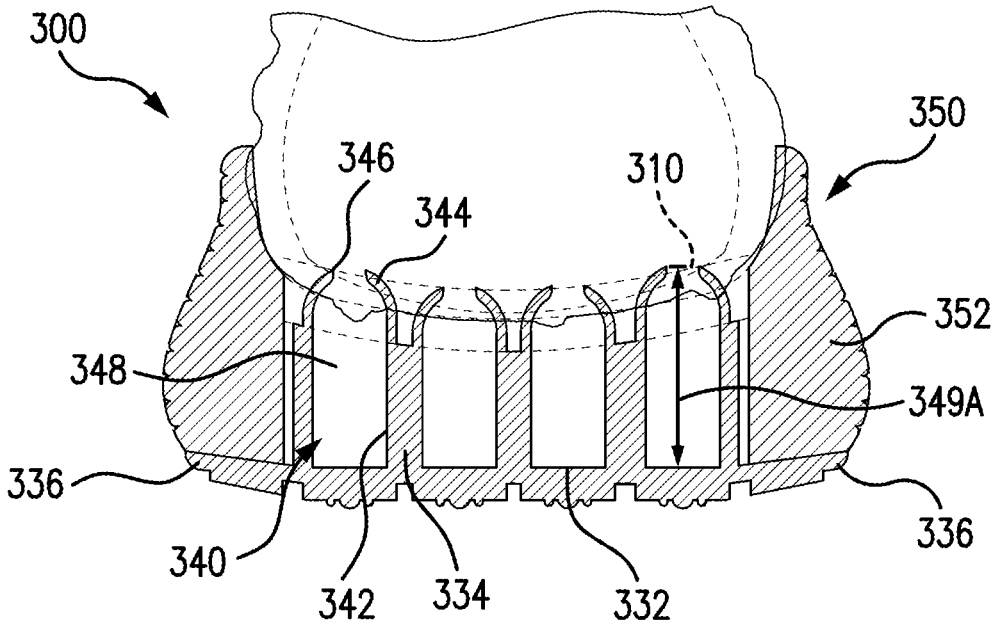
FIG. 10E shows a cross-section view of the sole taken along line 10E-10E in FIG. 9 according to embodiments.
Figure 11A:
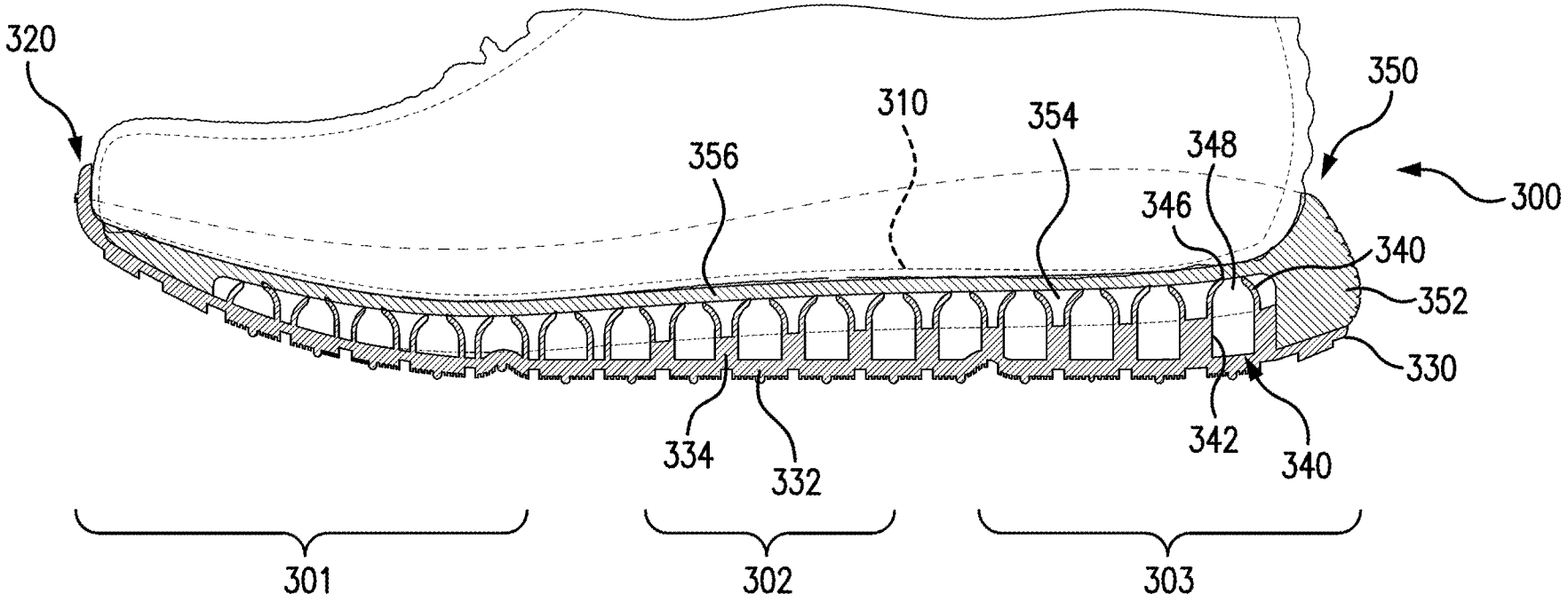
FIG. 11A shows a cross-section view of the sole taken along line 10A-10A in FIG. 9 according to embodiments.
Figure 11B:
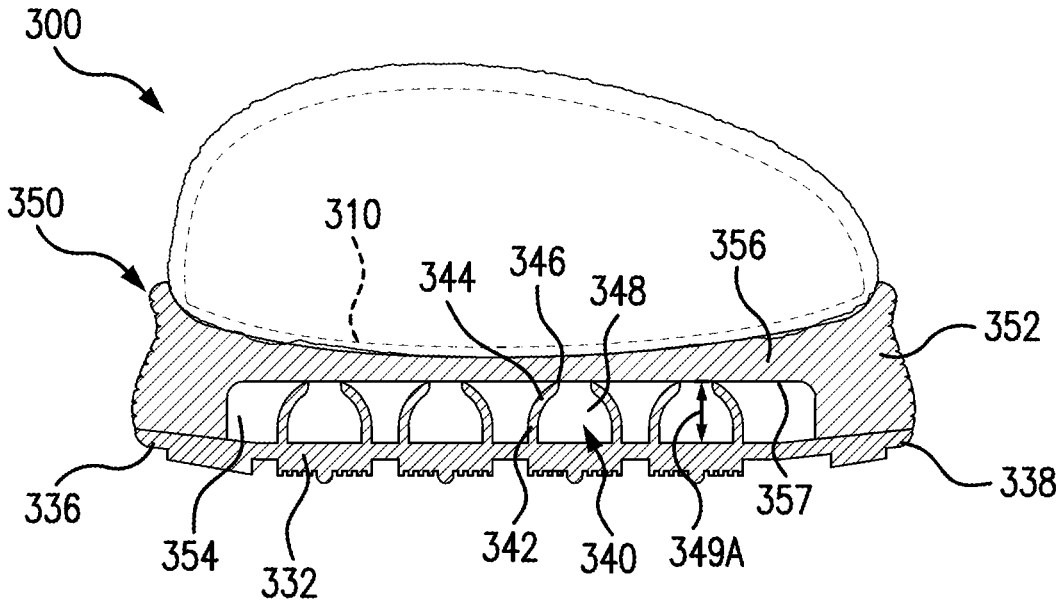
FIG. 11B shows a cross-section view of the sole taken along line 10B-10B in FIG. 9 according to embodiments.
Figure 11C:
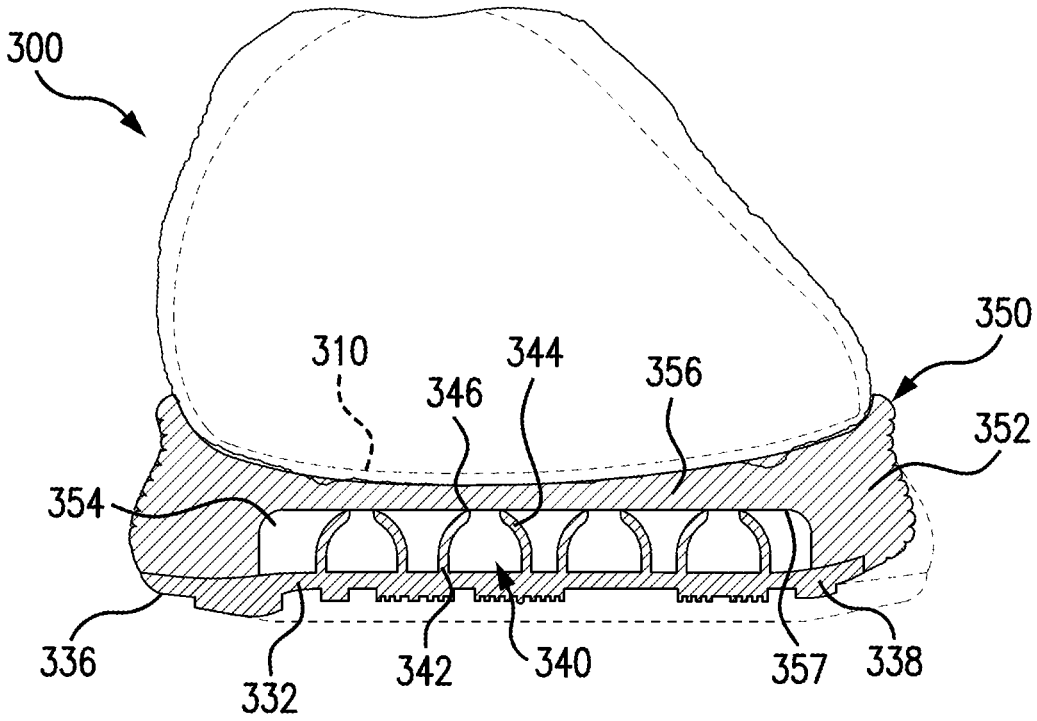
FIG. 11C shows a cross-section view of the sole taken along line 10C-10C in FIG. 9 according to embodiments.
Figure 11D:
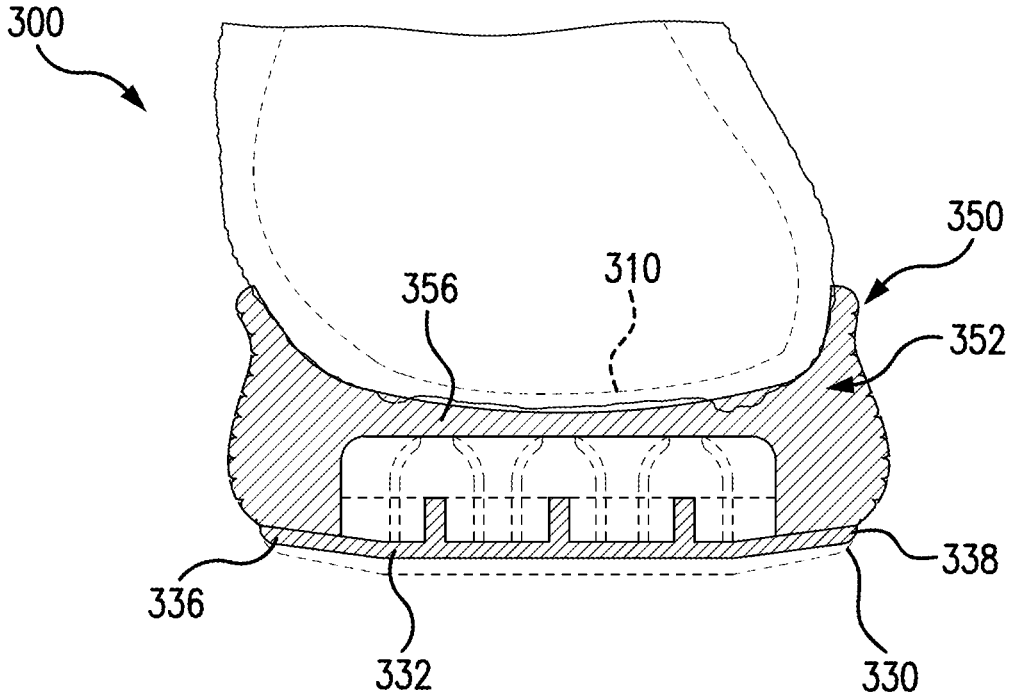
FIG. 11D shows a cross-section view of the sole taken along line 10D-10D in FIG. 9 according to embodiments.
Figure 11E:
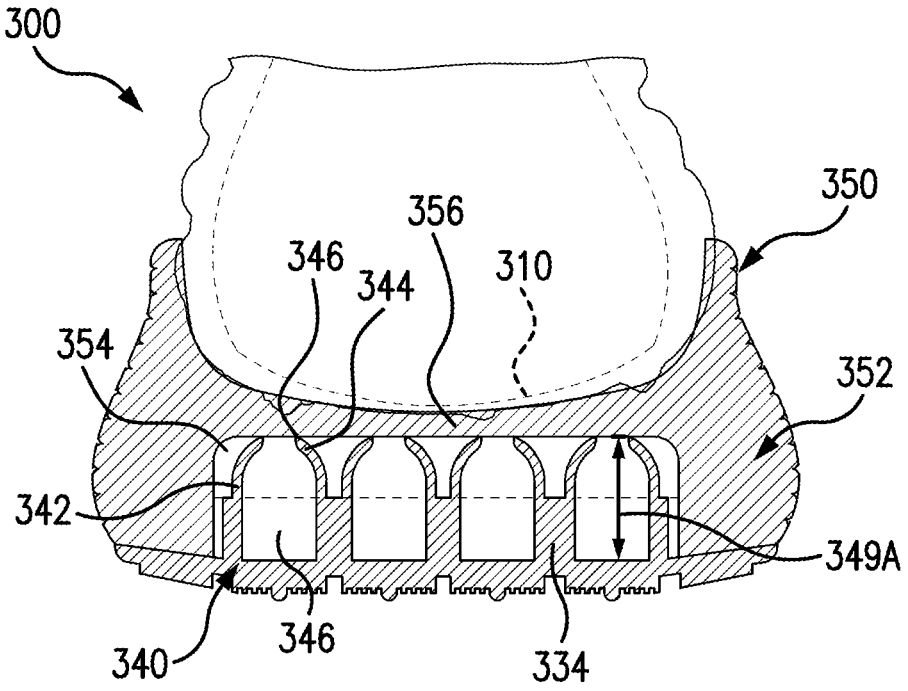
FIG. 11E shows a cross-section view of the sole taken along line 10E-10E in FIG. 9 according to embodiments.
Figure 12:
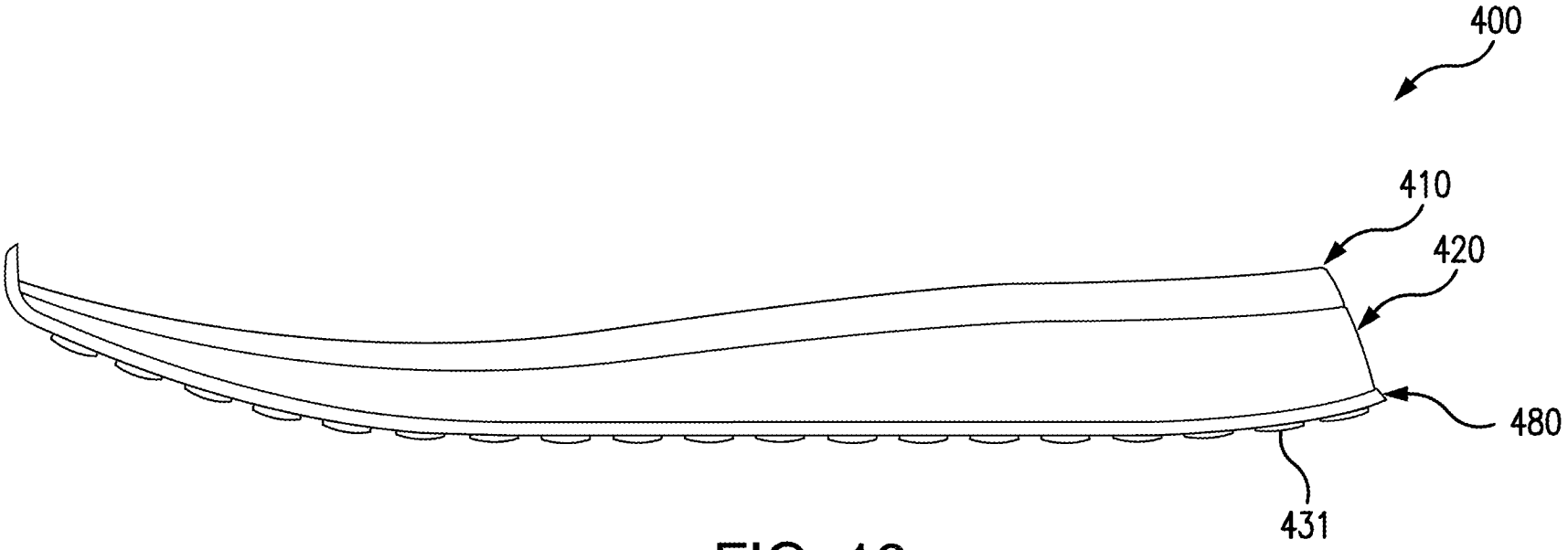
FIG. 12 shows a side view of a sole for an article of footwear according to embodiments.
Figure 13:
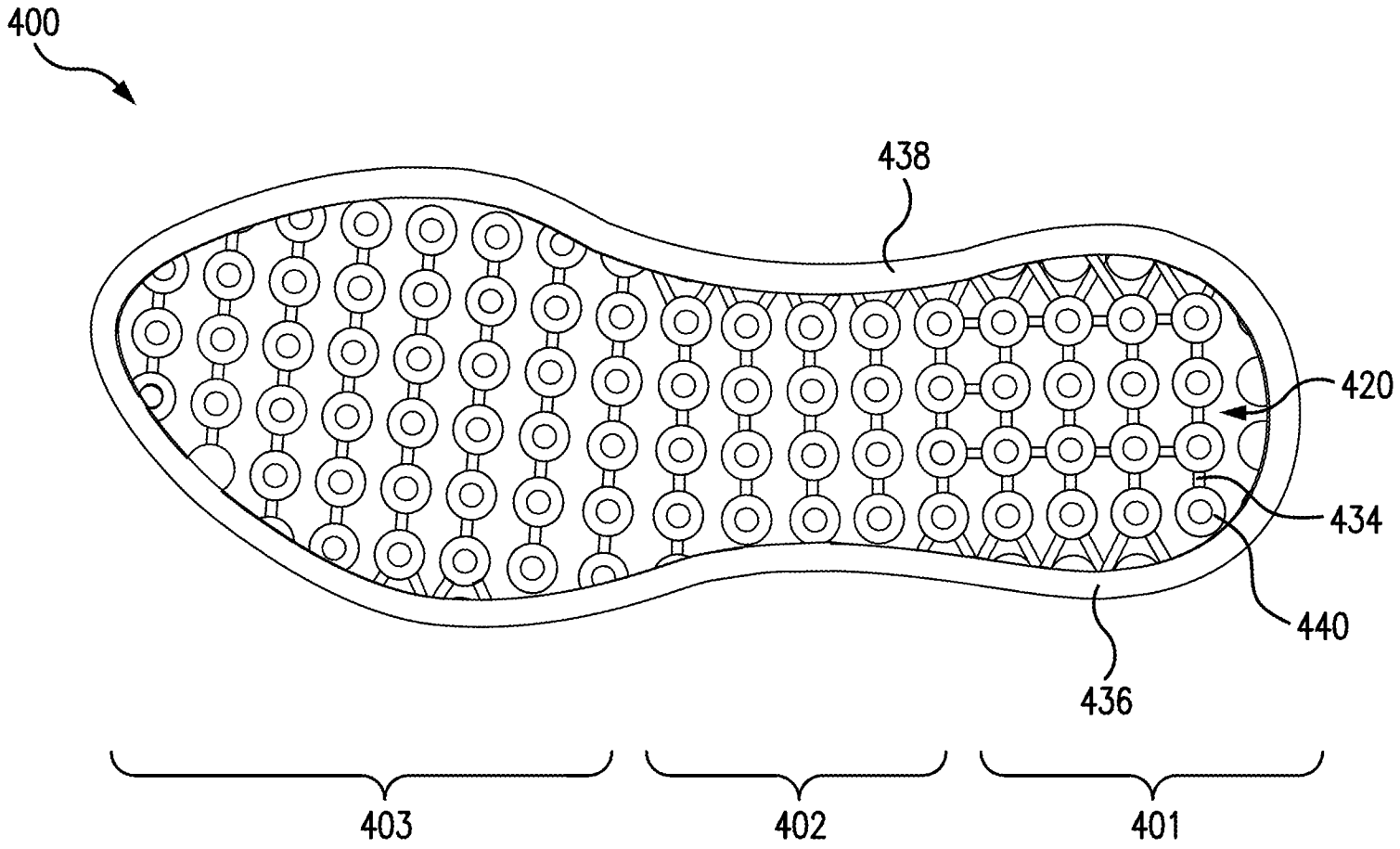
FIG. 13 shows a top view of the sole shown in FIG. 12 according to embodiments.
Figure 14:
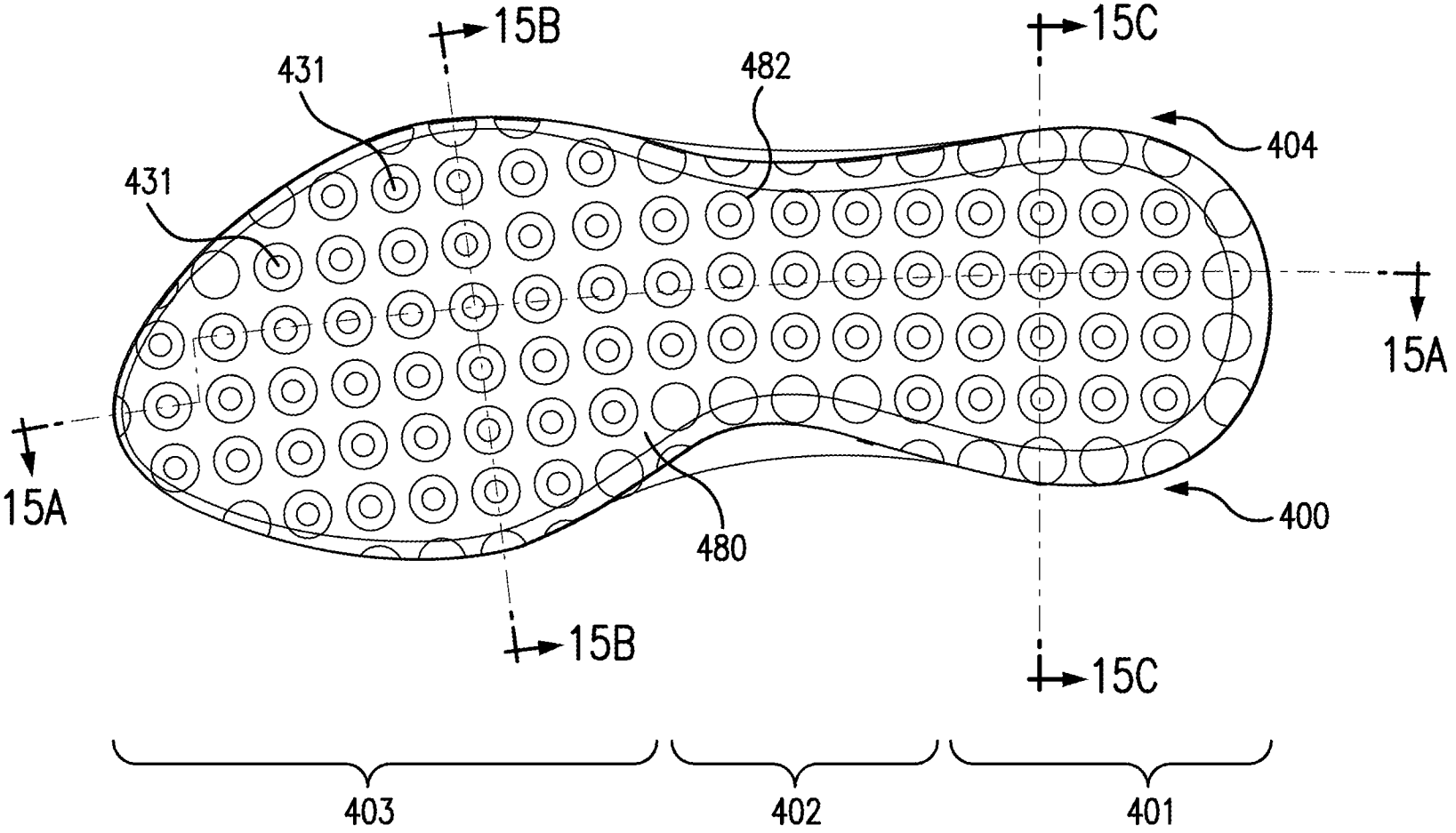
FIG. 14 shows a bottom view of the sole shown in FIG. 12 according to embodiments.

In some embodiments, first sole member 320 may include the same and/or similar features of first sole member 120 and 220 described herein. For example, in some embodiments, first sole member 320 may include a first web 330 having a plate 332 extending from a heel region 301 to a forefoot region 303 of sole 300, and first sole member 220 may include a plurality of first pillars 340 projecting upwardly from an upper surface of plate 332 to support the wearer's foot. In some embodiments, as shown in FIGS. 10A-10E and 11A-11E, the plurality of first pillars 340 may each include a curved sidewall 342 and a dome-shaped lid 344 extending from an upper end of curved sidewall 342, in which sidewall 342 and lid 344 define a void cavity 348. In some embodiments, lid 344 may include an aperture 346 opening into cavity 348. As shown in FIGS. 11A and 10A, the size (e.g., height and/or diameter) of first pillars 340 decreases from heel region 301 to forefoot region 303. For example, as shown in FIGS. 10E and 11E, first pillars 340 in heel region 301 may include a first height 349A, and as shown in FIGS. 10B and 11B, first pillars 340 in forefoot region 303 may include a second height 349B that is less than the first height 349A. In some embodiments, plate 332 of first web 330 may include a solid bottom surface 333 that does not include any holes. In some embodiments, first web 330 can include a plurality of strips 334 interconnecting the plurality of first pillars 340. In some embodiments, first web 330 and the plurality of first pillars 340 of first sole member 320 are unitary (e.g., a single-piece configuration), such that first web 330 and the plurality first pillars 340 are integrally made from the same material, such as, for example, the first elastomeric-based material described herein.

In some embodiments, as shown in FIGS. 10A-10E and 11A-11E, midsole 350 may include a sidewall 352 extending along a perimeter of sole 300, including along both lateral side 304 and medial side 305 of sole 300. In some embodiments, sidewall 352 of midsole 350 defines a chamber 354 extending along a length of sole 300. In some embodiments, the plurality of first pillars 340 of first sole member 320 are received in chamber 354 of midsole 350. In some embodiments, plate 332 of first web 330 is disposed underneath midsole 350. In some embodiments, a lateral end 336 of plate 332 may be coupled to a bottom surface of sidewall 352 along lateral side 304 of sole 300, and a medial end 338 of plate 332 may be coupled to a bottom surface of sidewall 352 along medial side 305 of sole 300.

In some embodiments, as shown in FIGS. 10A-10E, midsole 350 has an open top section 355 such that chamber 354 extends through the entire thickness of midsole 350 and the upper boundary of chamber 354 is bounded by insole 310. Accordingly, lids 344 of the plurality of first pillars 340 received in chamber 354 may engage the bottom surface of insole 310. In some embodiments, the height of first pillars 340 at a relaxed state (e.g., when no loads are applied to first pillar 140) may be greater than the height chamber 354 such that the plurality of first pillars 340 slightly sink to the profile of wearer's foot when the wearer is standing, thereby providing better cushioning to the wearer's foot.

In some embodiments, as shown in FIGS. 11A-11E, midsole 350 has a closed top section 356 such that the upper boundary of chamber 354 is bounded by a bottom surface 357 of closed top section 356 of midsole 350. Accordingly, lids 244 of the plurality of first pillars 240 received in chamber 354 may engage bottom surface 357 of midsole 350.

In some embodiments, midsole 350 may be made of a material different than the first elastomeric-based material of first sole member 320. For example, midsole 350 may be made of a foam-based material, such as, for example, an EVA foam material and/or a polyurethane foam material.

In some embodiments, outsole 380 may be coupled to selected portions of a bottom surface of web 330 of first sole member 320 and/or sidewall 352 of midsole 350. In some embodiments, outsole 380 may be made of a wear-resistant material, such as, for example, a second elastomeric material having a second modulus of elasticity that is greater than the first modulus of elasticity of first elastomeric material of first sole member 120. For example, the second elastomeric material for outsole 380 may include a synthetic or a natural rubber, thermoplastic polyurethane, a wear-resistant foam, or a combination thereof.

In some embodiments, the first sole member may form the sidewall of the sole and bosses for engaging the ground, without the use of additional cushioning materials. For example, FIGS. 12-15C illustrate a sole 400 according to one embodiment of the present disclosure. In some embodiments, sole 400 may include an insole 410, a first sole member 420 disposed below insole 410, and an outsole 480 disposed below first sole member 420.

Figure 15A:
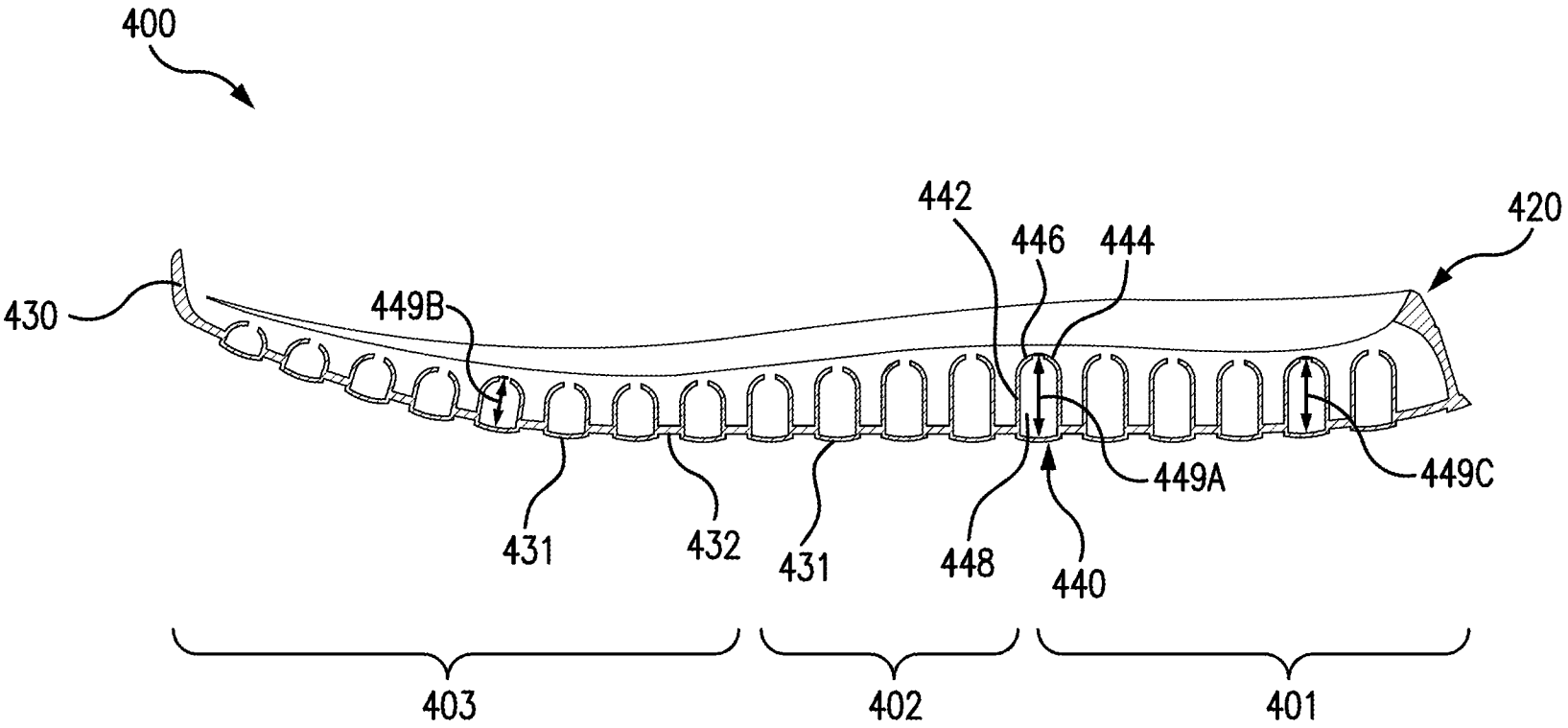
FIG. 15A shows a cross-section view of the sole taken along line 15A-15A in FIG. 14 according to embodiments.
Figure 15B:
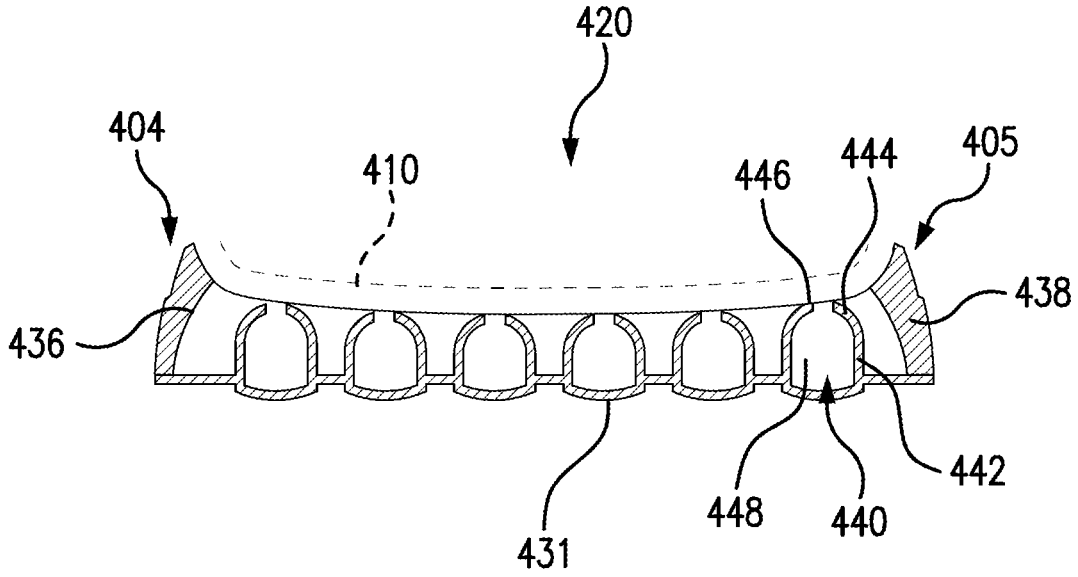
FIG. 15B shows a cross-section view of the sole taken along line 15B-15B in FIG. 14 according to embodiments.
Figure 15C:
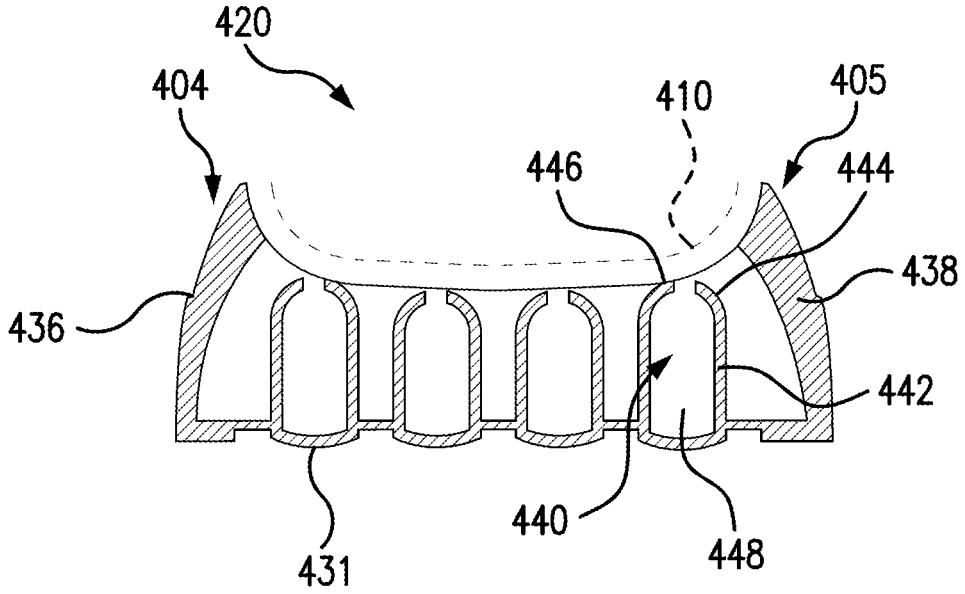
FIG. 15C shows a cross-section view of the sole taken along line 15C-15C in FIG. 14 according to embodiments.
Figure 16:
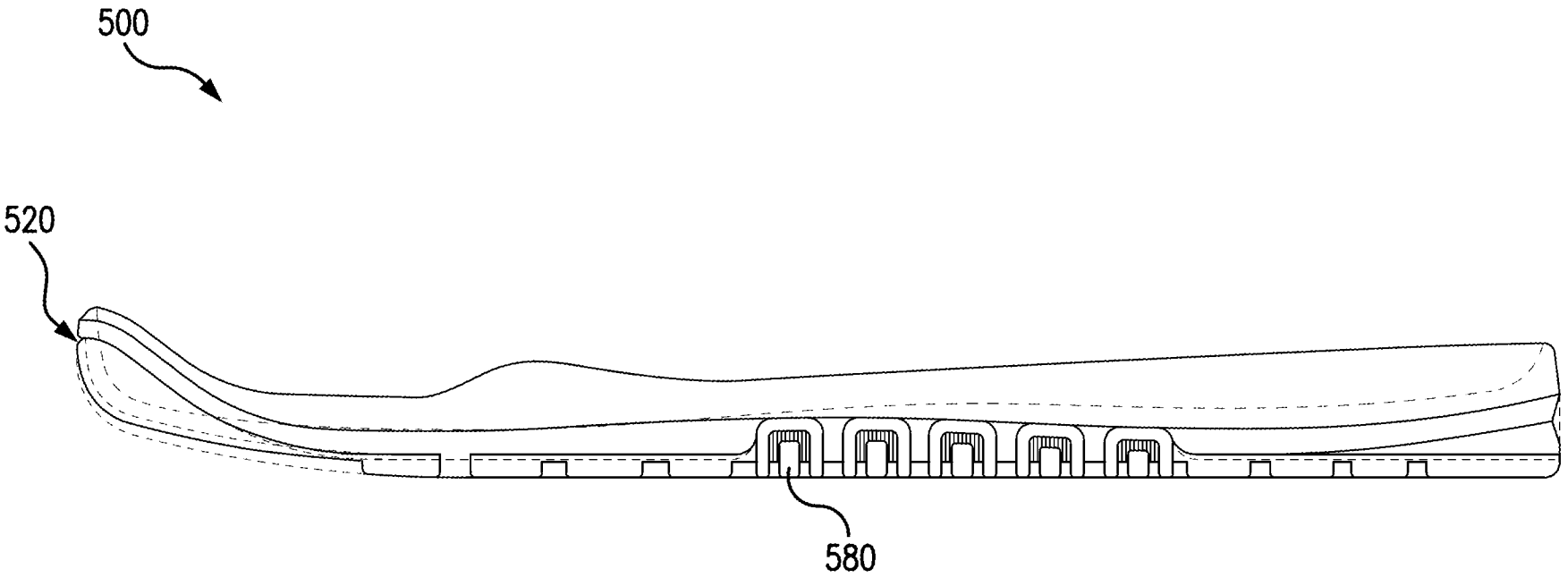
FIG. 16 shows a side view of a sole for an article of footwear according to some embodiments.
Figure 17:
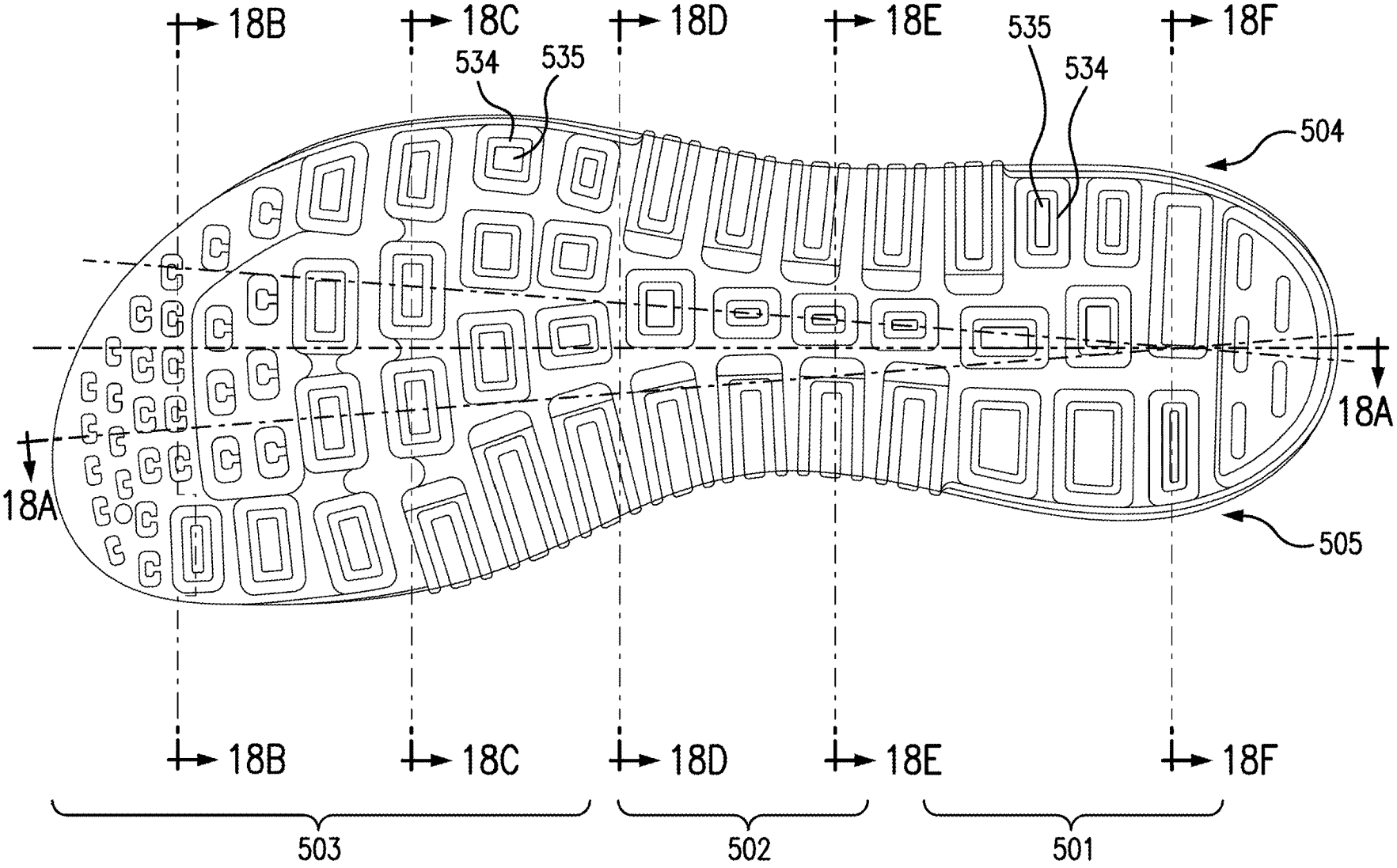
FIG. 17 shows a bottom view of the sole shown in FIG. 16 according to embodiments.

In some embodiments, first sole member 420 may include the same and/or similar features of first sole member 120, 220, and 320 described herein. For example, in some embodiments, first sole member 420 may include a first web 430 having a plate 432 extending from a heel region 401 to a forefoot region 403 of sole 400, and first sole member 420 may include a plurality of first pillars 440 projecting upwardly from an upper surface of plate 432 to support the wearer's foot. In some embodiments, as shown in FIGS. 15A-15C, the plurality of first pillars 440 may each include a curved sidewall 442 and a dome-shaped lid 444 extending from an upper end of curved sidewall 442, in which sidewall 442 and lid 444 define a void cavity 448. In some embodiments, lid 444 may include an aperture 446 opening into cavity 448. As shown in FIG. 15A, the size (e.g., height and/or diameter) of first pillars 440 varies from heel region 401 to forefoot region 403. For example, a height 449A of first pillars 440 located at a transition between arch region 402 and heel region 401 may be larger than the height of remaining first pillars 440, such as a height 449B of first pillars 440 in forefoot region 403 and a height 449C of first pillars 440 in heel region 401, to provide adequate support for the wearer's hear. In some embodiments, the size (e.g., height and/or diameter) of first pillars 440 disposed in forefoot region 403 may be smaller than the size (e.g., height and/or diameter) of the remaining first pillars 440. In some embodiments, lids 444 of the plurality of first pillars 440 engage a bottom surface of insole 410.

In some embodiments, first web 430 may include a plurality of strips 434 interconnecting the plurality of first pillars 440. In some embodiments, a strip 434 can extend between a pair of adjacent first pillars 440 such that first pillars 440 are supported adequately in an upright position. In some embodiments, a strip 434 can extend from a first pillar 440 to a sidewall of sole 400 to support first pillar 440 in an upright position. In some embodiments, plate 432 of first web 330 may include a solid bottom surface 433 that does not include any holes. In some embodiments, first web 430 may include a plurality of bosses 431 projecting from a bottom surface of plate 432. In some embodiments, the plurality of bosses 431 may be axially aligned with respect to the plurality of first pillars 440. In some embodiments, the plurality of bosses 431 may be dome-shaped to promote more lift when sole 400 strikes the ground during the wearer's gait cycle. In some embodiments, outsole 480 may include a plurality of apertures 482 corresponding to the location of the plurality of bosses 431 such that each of the bosses 431 projects through a respective aperture 482 of outsole 480.

In some embodiments, as shown in FIGS. 15B and 15C, for example, first web 430 may include a lateral sidewall 436 disposed on a lateral side 404 of plate 432 and a medial sidewall 438 disposed on a medial side 405 of plate 432. In some embodiments, lateral sidewall 436 and medial sidewall 438 are coupled to outer edge of insole 410. In some embodiments, lateral sidewall 436 and medial sidewall 438 extend along the entire length of sole 400. In some embodiments, the height of lateral sidewall 436 may correspond to the height of medial sidewall 438 (e.g., same height) along the length of sole 400. In some embodiments, lateral sidewall 436 and medial sidewall 438 merge at heel region 401 and at forefoot region 403 of sole 400, such that lateral sidewall 436 and medial sidewall 438 define a chamber 439 bounded by insole 410 and plate 432 of first web 430. In some embodiments, the plurality of first pillars 440 are arranged in a series of rows, where each row of first pillars 440 extends in a lateral direction along sole 400. In some embodiments, as shown in FIGS. 15B and 15C, the rows of first pillars 440 are disposed between lateral sidewall 436 and medial sidewall 438 of first web 430.

In some embodiments, first web 430 and the plurality of first pillars 440 of first sole member 420 are unitary (e.g., a single-piece configuration), such that first web 430 and the plurality first pillars 440 are integrally made from the same material, such as, for example, the first elastomeric-based material described herein. In some embodiments, outsole 480 may be coupled to selected portions of a bottom surface of first web 430 and may be made of a wear-resistant material, such as, for example, a second elastomeric material described herein. In some embodiments, the height of lateral sidewall 436 may be different than the height of medial sidewall 438 along the length of sole 400.

FIGS. 16-18F illustrate a sole 500 according to one embodiment of the present disclosure. In some embodiments, sole 500 may include an insole 510, a first sole member 520 disposed below insole 510, and an outsole 580 disposed below first sole member 520.

Figure 18A:
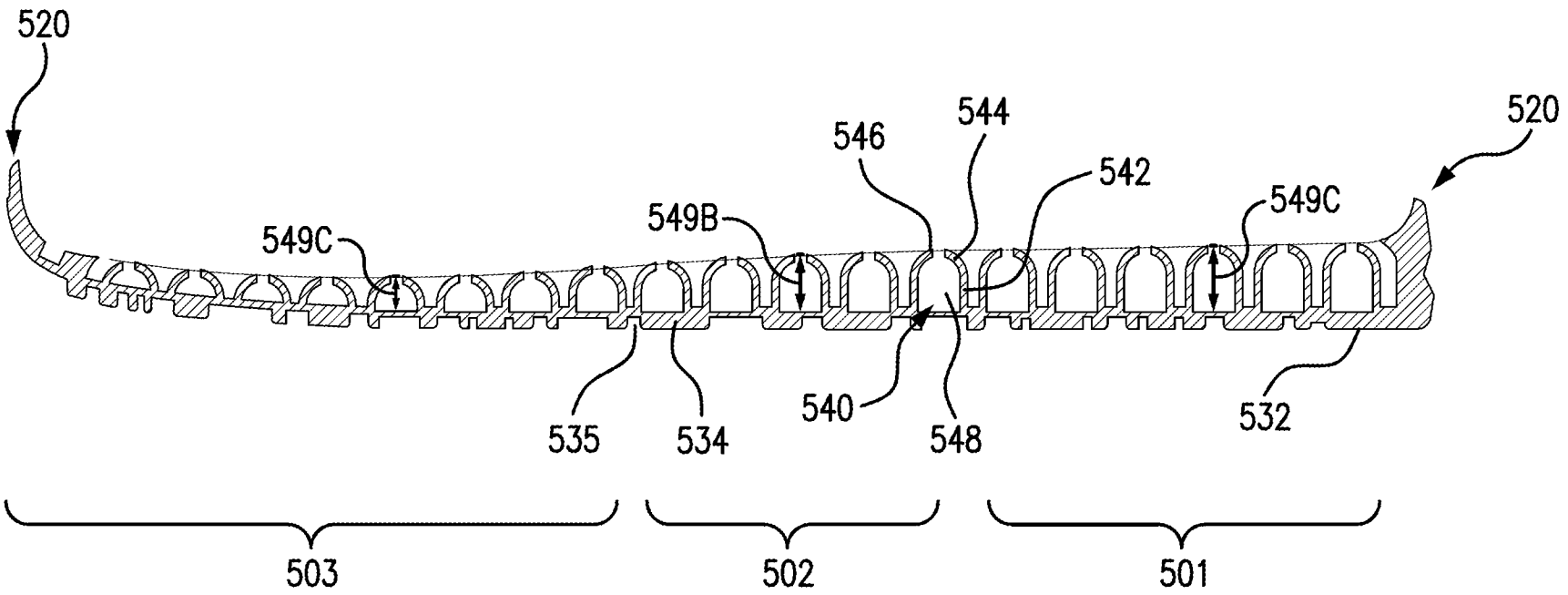
FIG. 18A shows a cross-section view of the sole taken along line 18A-18A in FIG. 17 according to embodiments.

In some embodiments, first sole member 520 may include the same and/or similar features of first sole member 120, 220, 320, and 420 described herein. For example, in some embodiments, first sole member 520 may include a first web 530 having a plate 532 extending from a heel region 501 to a forefoot region 503 of sole 500, and first sole member 520 may include a plurality of first pillars 540 projecting upwardly from an upper surface of plate 532 to support the wearer's foot. In some embodiments, as shown in FIGS. 18A-18F, the plurality of first pillars 540 may each include a curved sidewall 542 and a dome-shaped lid 544 extending from an upper end of curved sidewall 542, in which sidewall 542 and lid 544 define a void cavity 548. In some embodiments, lid 544 may include an aperture 546 opening into cavity 548. As shown in FIG. 18A, the size (e.g., height and/or diameter) of first pillars 540 may decrease from heel region 501 to forefoot region 503. For example, a height 549A of first pillars 540 in heel region 501 may be greater than a height 549B of first pillars 540 in arch region 502 and a height 549C of first pillars 540 in forefoot region 503. In some embodiments, plate 532 of first web 530 may include a solid bottom surface having a plurality of protuberances 534 and a plurality of recesses 535 defined between the plurality of protuberances 534. In some embodiments, one or more of recesses 535 may extend around a respective protuberance 534. In some embodiments, the plurality of protuberances 534 are configured to engage the ground during foot strike of the wearer's gait cycle.

Figure 18B:
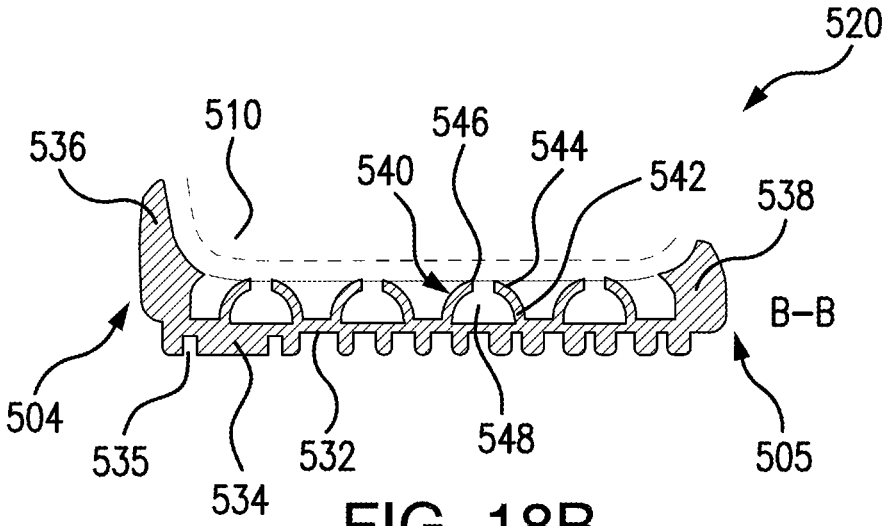
FIG. 18B shows a cross-section view of the sole taken along line 18B-18B in FIG. 17 according to embodiments.
Figure 18C:
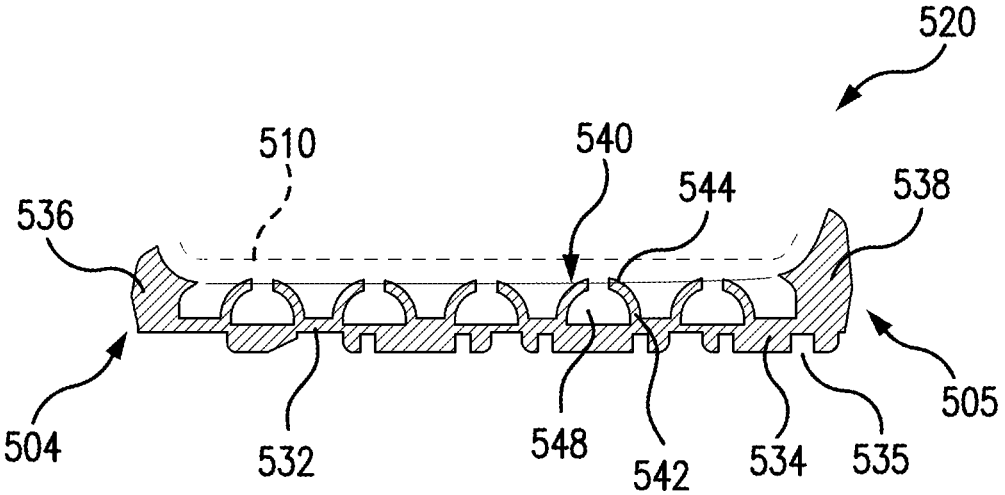
FIG. 18C shows a cross-section view of the sole taken along line 18C-18C in FIG. 17 according to embodiments.
Figure 18D:
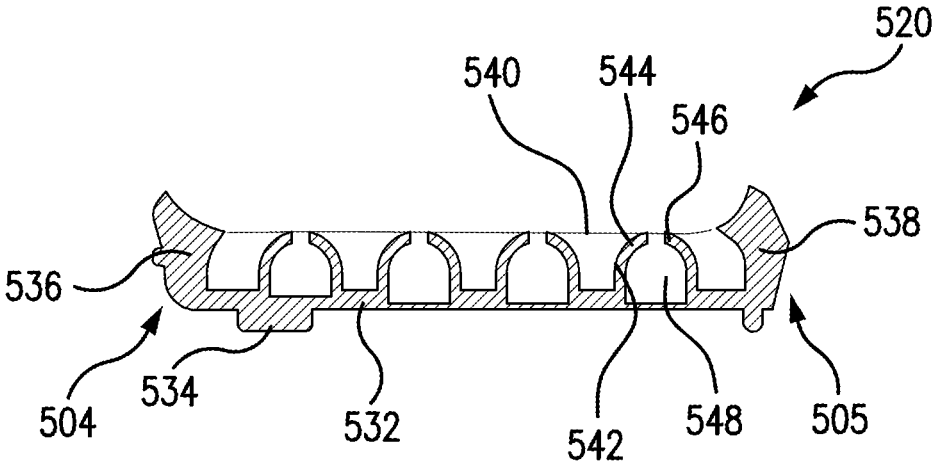
FIG. 18D shows a cross-section view of the sole taken along line 18D-18D in FIG. 17 according to embodiments.
Figure 18E:
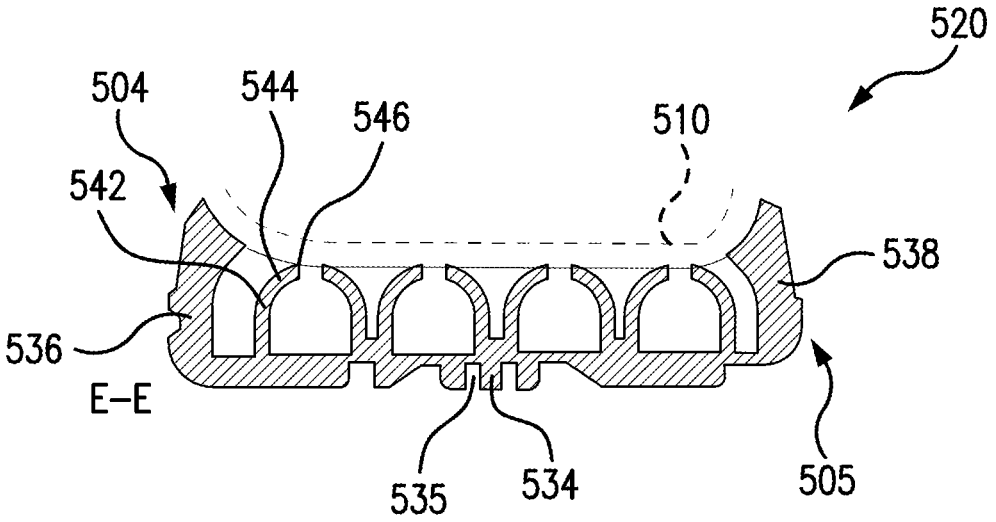
FIG. 18E shows a cross-section view of the sole taken along line 18E-18E in FIG. 17 according to embodiments.
Figure 18F:
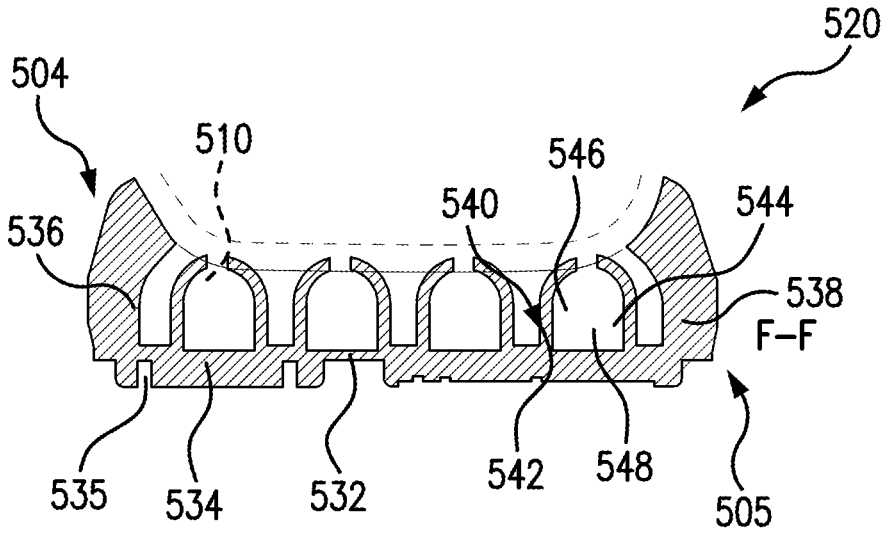
FIG. 18F shows a cross-section view of the sole taken along line 18F-18F in FIG. 17 according to embodiments.

In some embodiments, as shown in FIGS. 18B-18F, for example, first web 530 may include a lateral sidewall 536 disposed on a lateral side 504 of plate 532 and a medial sidewall 538 disposed on a medial side 505 of plate 532. In some embodiments, lateral sidewall 536 and medial sidewall 538 are coupled to outer edge of insole 510. In some embodiments, lateral sidewall 536 and medial sidewall 538 extend along the entire length of sole 500. In some embodiments, the height of lateral sidewall 536 may be different than the height of medial sidewall 538 along the length of sole 500. For example, as shown in FIG. 18B, the height of lateral sidewall 536 is greater than the height of medial sidewall 538 at a first location in forefoot region 503 of sole 500. In some embodiments, as shown in FIG. 18C, the height of lateral sidewall 536 is less than the height of medial sidewall 538 at a second location in forefoot region 503 of sole 500. In some embodiments, as shown in FIGS. 18E and 18F, the height of lateral sidewall 536 may correspond to the height of medial sidewall 538 (e.g., the same height) along arch region 502 and heel region 501 of sole 500.

In some embodiments, lateral sidewall 536 and medial sidewall 538 merge at heel region 501 and at forefoot region 503 of sole 500, such that lateral sidewall 536 and medial sidewall 538 define a chamber 539 bounded by insole 510 and plate 532 of first web 530. In some embodiments, the plurality of first pillars 540 are arranged in a series of rows, where each row of first pillars 540 extends in a lateral direction along sole 500. In some embodiments, as shown in FIGS. 18B-18F, the rows of first pillars 540 are disposed between lateral sidewall 536 and medial sidewall 538 of first web 530.

In some embodiments, first web 530 and the plurality of first pillars 540 of first sole member 520 are unitary (e.g., a single-piece configuration), such that first web 530 and the plurality first pillars 540 are integrally made from the same material, such as, for example, the first elastomeric-based material described herein. In some embodiments, outsole 580 may be coupled to selected portions of a bottom surface of first web 530 and may be made of a wear-resistant material, such as, for example, a second elastomeric material described herein.

Figure 19:
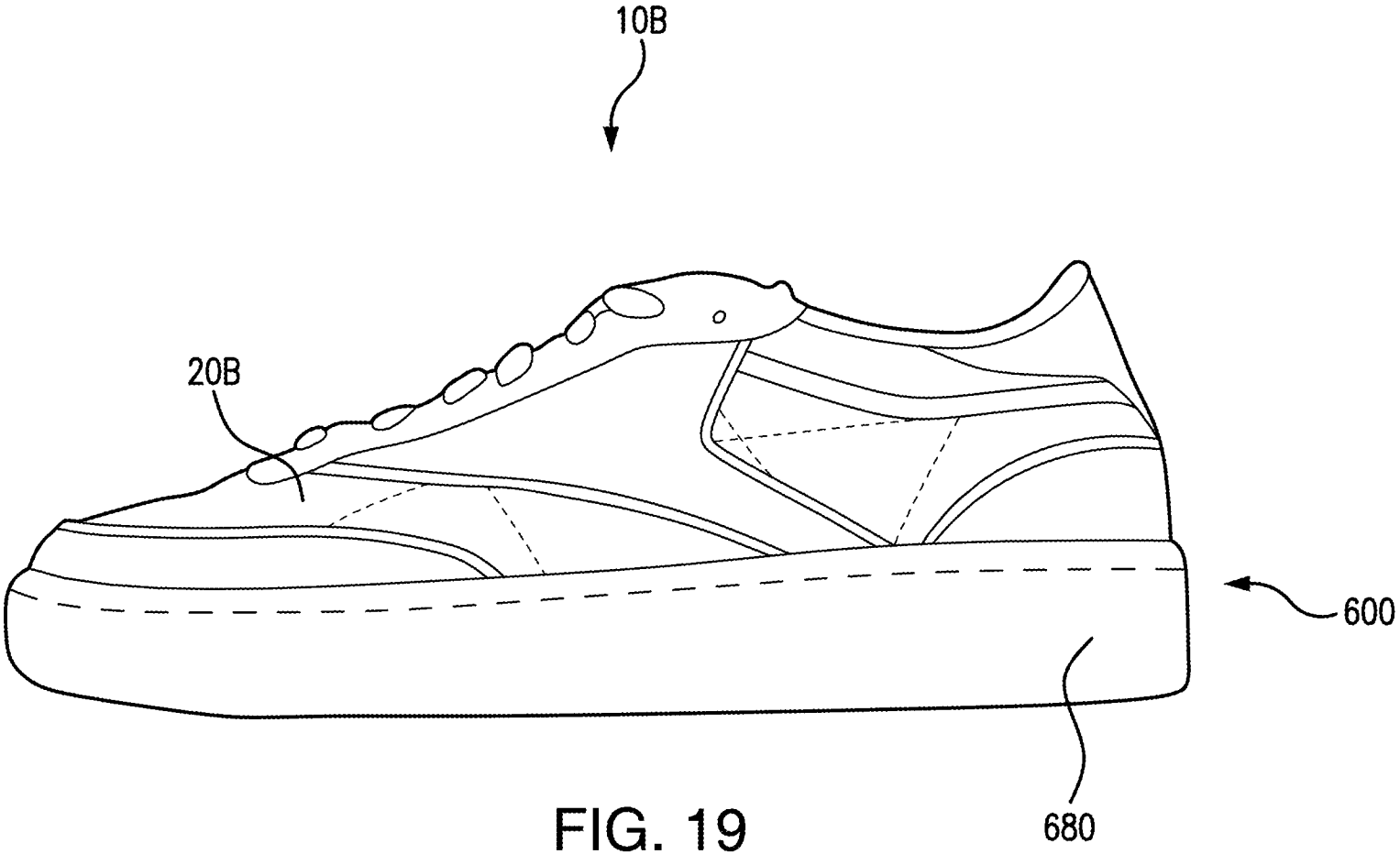
FIG. 19 shows a side view of an article of footwear according to embodiments.
Figure 20:
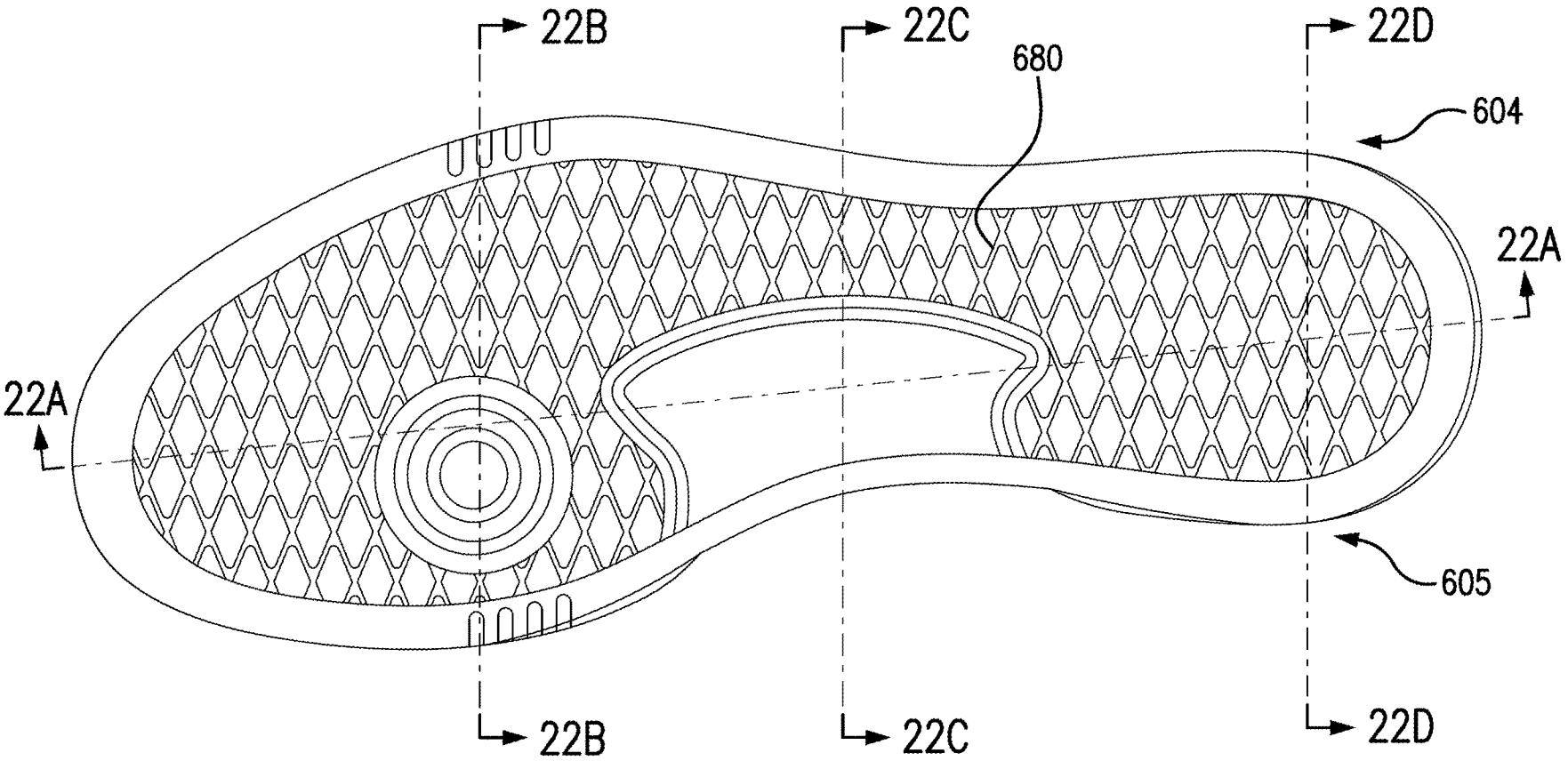
FIG. 20 shows a bottom view of a sole for the article of footwear shown in FIG. 19 according to embodiments.
Figure 21:
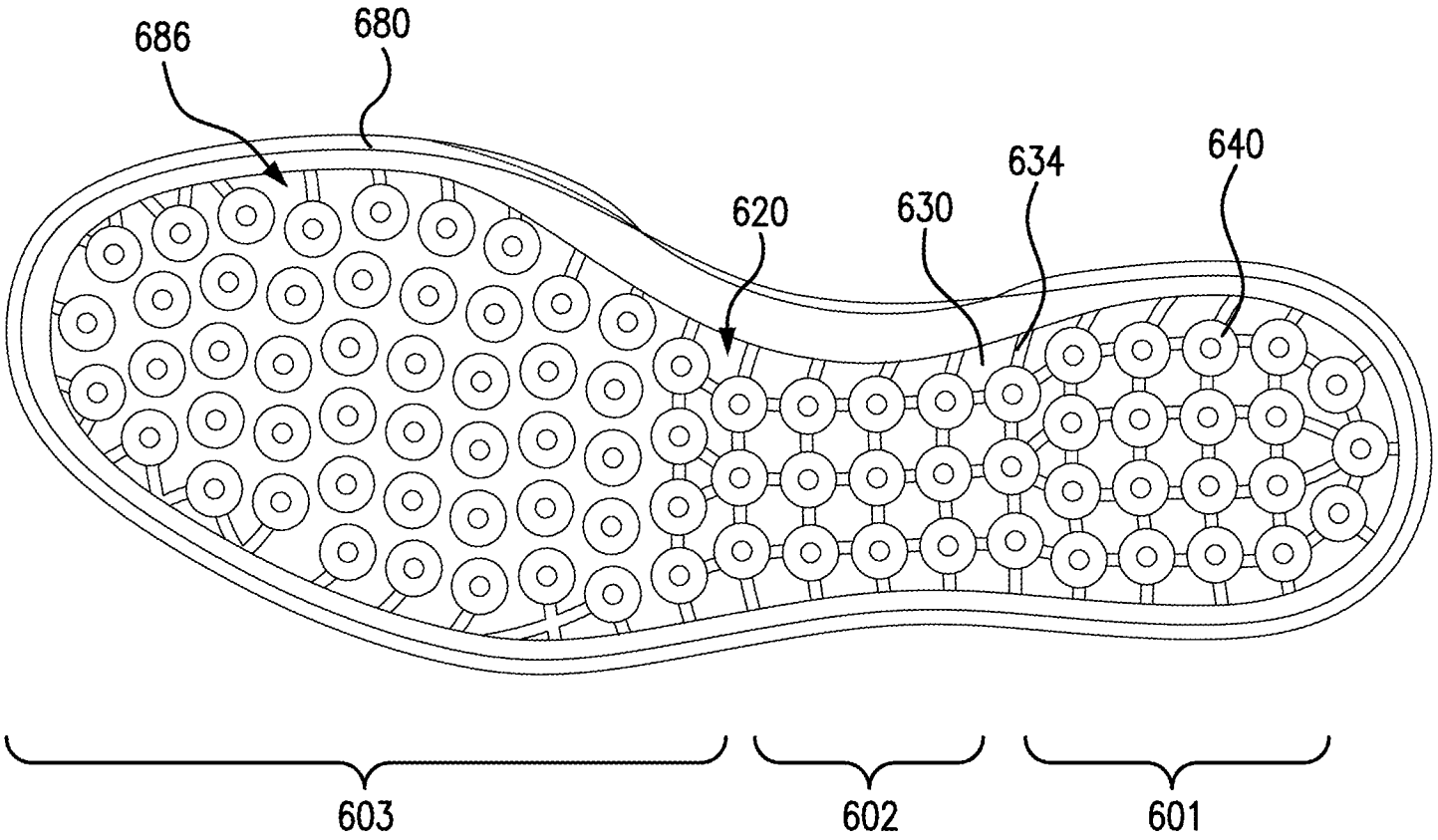
FIG. 21 shows a top view of the sole shown in FIG. 20 according to embodiments.

In some embodiments, the outsole of the sole may define a wear-resistant cupsole for encapsulating the first sole member and engaging the ground, and the first sole member may be molded directly on the bottom cupsole or received on the bottom cupsole as an insert. For example, FIG. 19 illustrates an article of footwear 10B having an upper 20B and a sole 600 coupled to the upper 20B according to some embodiments of the present disclosure. FIGS. 20-25 illustrate sole 600 according to some embodiments of the present disclosure. In some embodiments, sole 600 may include an insole 610, a first sole member 620 disposed below insole 610, and an outsole 680 disposed below first sole member 620.

Figure 22A:
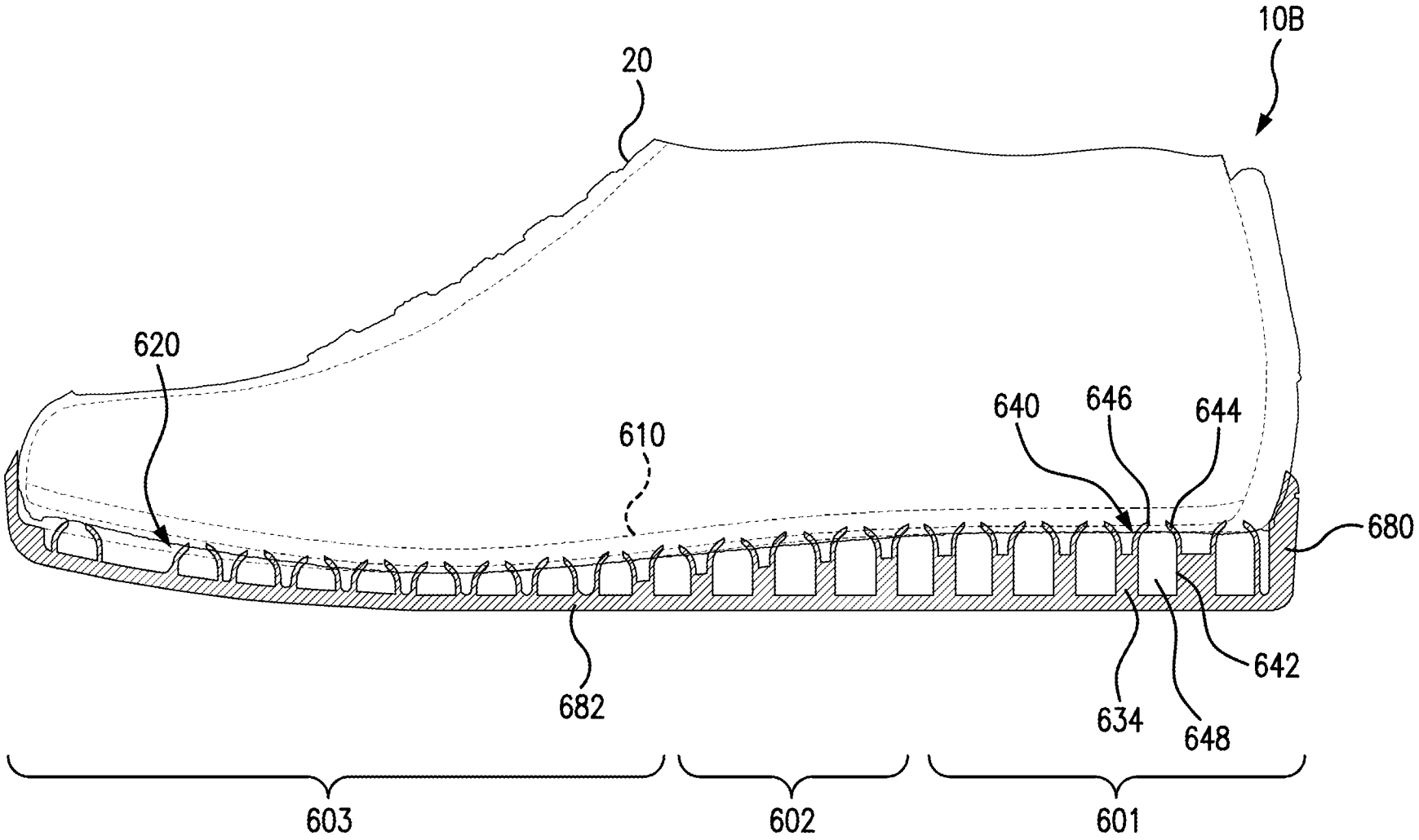
FIG. 22A shows a cross-section view of the sole taken along line 22A-22A in FIG. 20 according to embodiments.
Figure 22B:
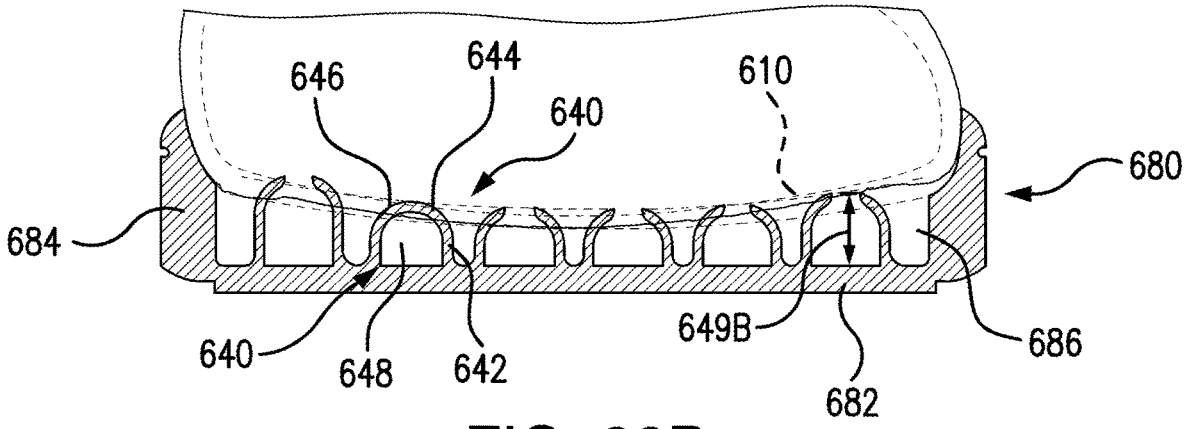
FIG. 22B shows a cross-section view of the sole taken along line 22B-22B in FIG. 20 according to embodiments.
Figure 22C:
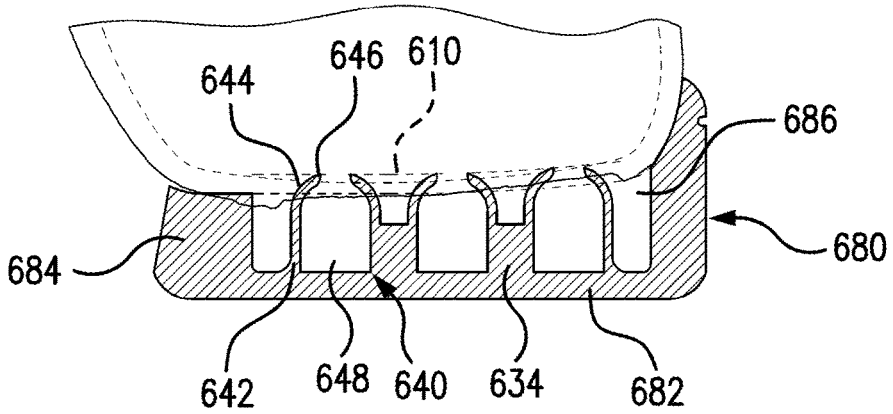
FIG. 22C shows a cross-section view of the sole taken along line 22C-22C in FIG. 20 according to embodiments.
Figure 22D:
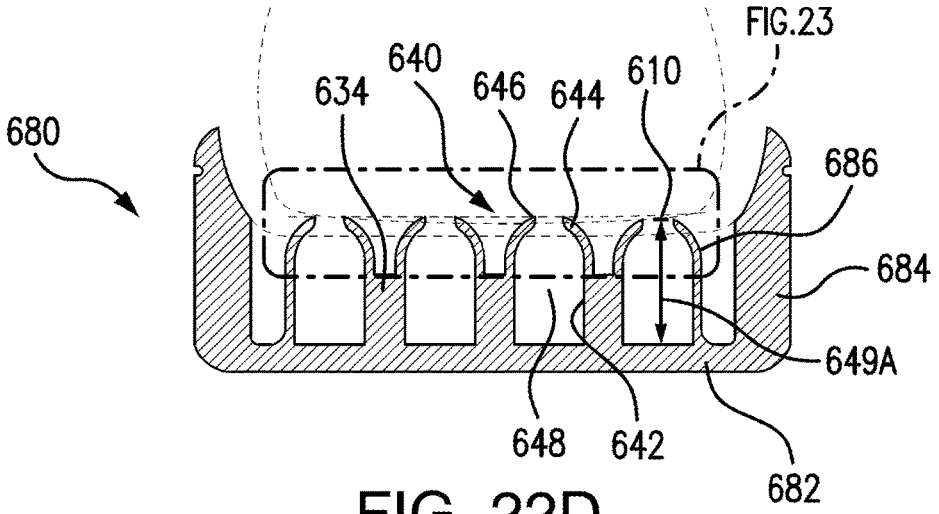
FIG. 22D shows a cross-section view of the sole taken along line 22D-22D in FIG. 20 according to embodiments.
Figure 23:
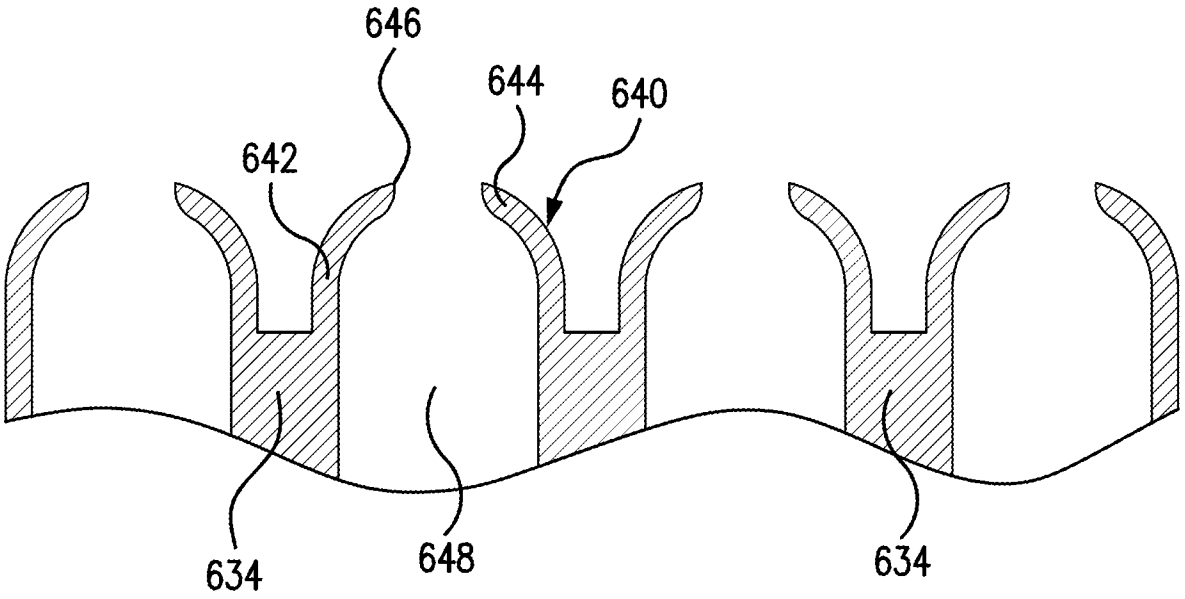
FIG. 23 shows an enlarged cross-section view of sole taken along line 23-23 in FIG. 22B according to embodiments.

In some embodiments, first sole member 620 may include the same and/or similar features of first sole member 120, 220, 320, 420, and 520 described herein. For example, in some embodiments, first sole member 620 may include a plurality of first pillars 640 and a first web 630 having a plurality of strips 634 interconnection first pillars 640. In some embodiments, as shown in FIGS. 22A-22D, the plurality of first pillars 640 may each include a curved sidewall 642 and a dome-shaped lid 644 extending from an upper end of curved sidewall 642, in which sidewall 642 and lid 644 define a void cavity 648. In some embodiments, lid 644 may include an aperture 646 opening into cavity 648. As shown in FIG. 22A, the size (e.g., height and/or diameter) of first pillars 640 may decrease from heel region 601 to forefoot region 603. For example, as shown in FIG. 22D, first pillars 640 in heel region 603 may include a first height 649A, and as shown in FIG. 22B, first pillars 640 in forefoot region 603 may include a second height 649B that is less than the first height.

In some embodiments, outsole 680 may include a base 682 extending along the length of sole 600. In some embodiments, outsole 680 may include a sidewall 684 projecting upwardly from base 682 and extending along a perimeter of sole 600. In some embodiments, sidewall 684 may be coupled to insole 610 and an upper of the article of footwear. In some embodiments, base 682 and sidewall 684 collectively define a chamber 686 that is bounded by insole 610.

In some embodiments, first sole member 620 may be disposed in chamber 686 of outsole 680. In accordance with the embodiment shown in FIGS. 21-23, first sole member 620 may be coupled directly to upper surface of base 682. For example, the plurality of strips 634 and the plurality of first pillars 640 may be molded directly into an upper surface of base 682, such that first sole member 620 and outsole 680 are unitary (e.g., configured as a single piece). Any molding technique suitable for molding first sole member 620 to outsole 680 may be used, such as, for example, compression molding, thermoforming, and/or injection molding. In some embodiments, first sole member 620 may be made of the highly-resilient first elastomeric-based material, as described herein, and outsole 680 may be made of the wear-resistant second elastomeric-based material, as described herein.

Figure 24:
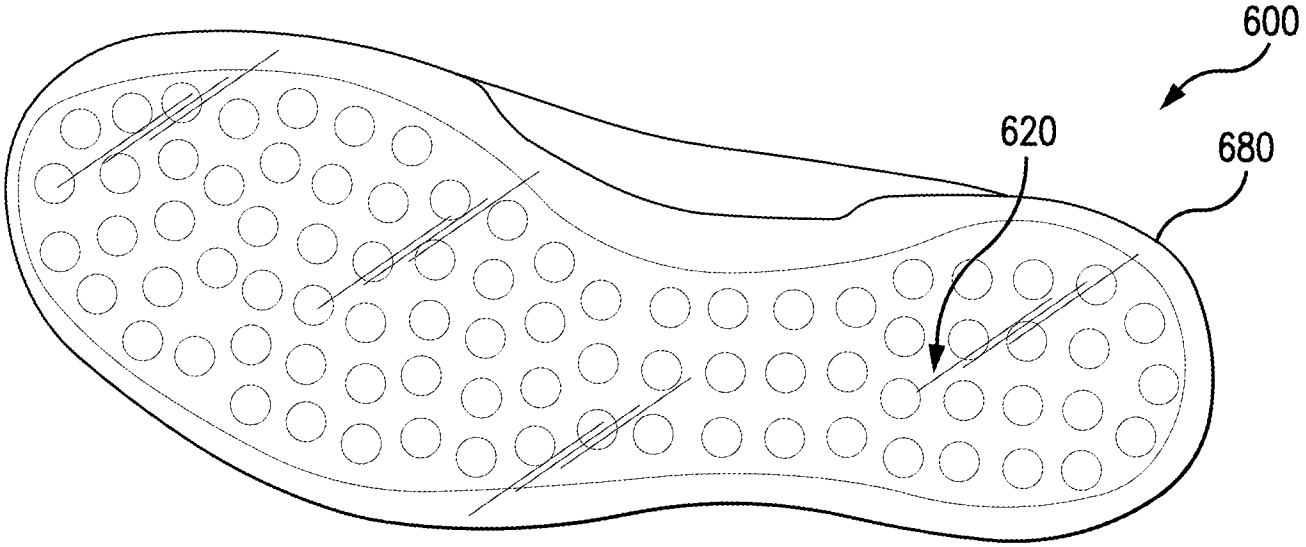
FIG. 24 shows a bottom view of a sole according to embodiments.
Figure 25:
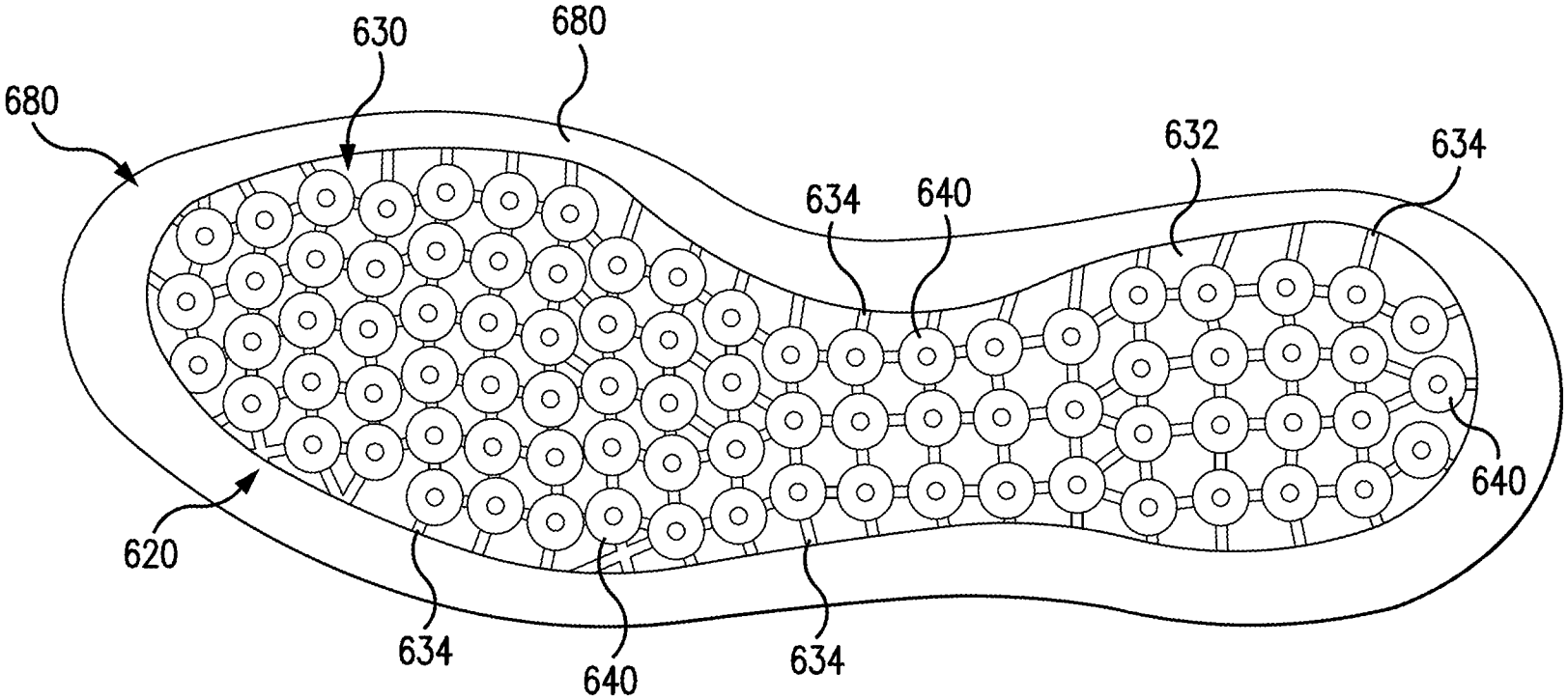
FIG. 25 shows a top view of the sole shown in FIG. 24 according to embodiments.

In accordance with the embodiment shown in FIGS. 24 and 25, first sole member 620 may be configured as an insert received in chamber 686 of outsole 680. For example, in some embodiments, first web 630 may include a sheet 632 extending from heel region 601 to forefoot region 603 of sole 600. In some embodiments, the plurality of first pillars 640 may project upwardly from sheet 632 toward insole 610. In some embodiments, a bottom surface of sheet 632 may be bonded to upper surface of base 682 of outsole 680 to secure first sole member 620 to outsole 680.

Whether molded directly into outsole 680 or received as an insert in chamber 686 of outsole 680, first sole member 620 provides support to the wearer's foot and absorbs shock imparted from sole 600 striking the ground, similar to the other embodiments described herein. By providing adequate cushion and support for the wearer's foot, first sole member 620 allows sole 600 to be void of any additional cushioning materials, such as foam, to reduce the cost of sole 600.

Figure 26:
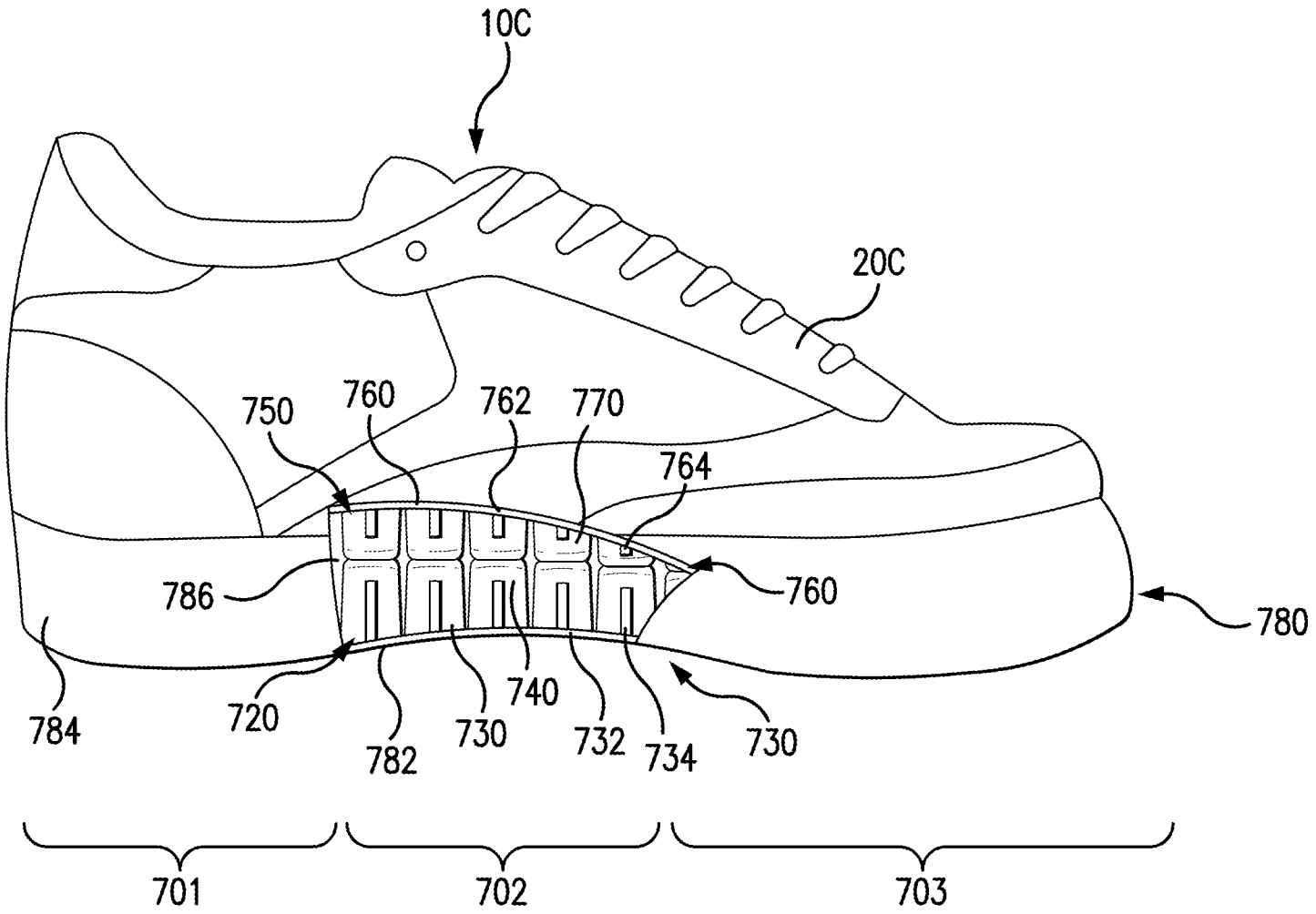
FIG. 26 shows a side view of an article of footwear according to embodiments.

In some embodiments, a first sole member and a second sole member may be encapsulated by a bottom wear-resistant cupsole such that two layers of pillars are received in the cupsole. For example, FIG. 26 illustrates an article of footwear 10C having an upper 20C and a sole 700 coupled to the upper 20C according to some embodiments of the present disclosure. In some embodiments, sole 700 may include an insole 710, a first sole member 720 disposed below insole 710, a second sole member 750 disposed above first sole member 720 and below insole 710, and an outsole 780 disposed below first sole member 720.

Figure 27:
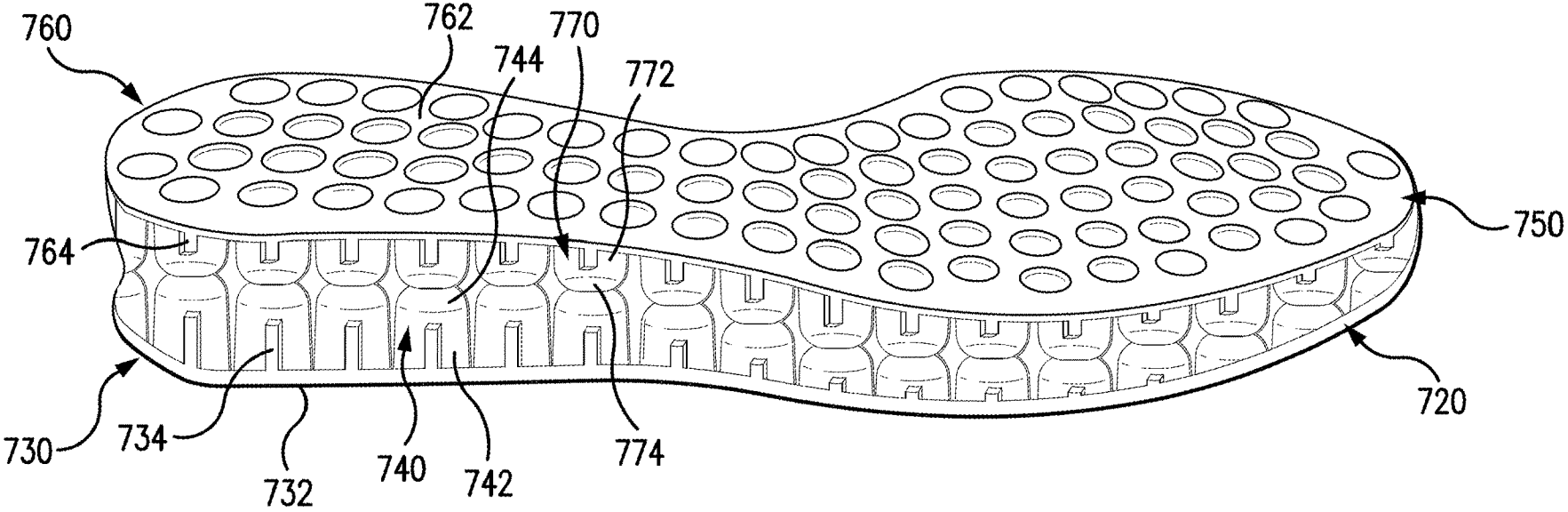
FIG. 27 shows a perspective view of a first sole member and a second sole member according to embodiments.

In some embodiments, first sole member 720 may include the same and/or similar features of first sole member 120, 220, 320, 420, 520, and 720 described herein. For example, as shown in FIGS. 26 and 27, first sole member 720 may include a first web 730 having a plate 732 extending from heel region 701 to forefoot region 703 of sole 700 and a plurality of first pillars 740 projecting from an upper surface of plate 732. In some embodiments, first web 730 may include a plurality of strips 734 interconnecting first pillars 740. In some embodiments, the plurality of first pillars 740 may each include a curved sidewall 742 and a dome-shaped lid 744 extending from an upper end of curved sidewall 742, in which sidewall 742 and lid 744 define a void cavity. In some embodiments, lid 744 may include an aperture opening into cavity.

In some embodiments, second sole member 750 may include the same or similar features of second sole member 150 and 250 as described herein. For example, as shown in FIGS. 26 and 27, second sole member 750 may include a second web 760 having a plate 762 and a plurality of second pillars 770 projecting downwardly from a bottom surface of plate 762. In some embodiments, second web 760 may include a plurality of strips 764 interconnecting second pillars 770. In some embodiments, the plurality of second pillars 770 may each include a curved sidewall 772 and a base 774 extending from a lower end of sidewall 772. In some embodiments, second sole member 750 may be stacked on first sole member 720, such that the plurality of second pillars 770 are axially aligned with respect to the plurality of first pillars 740. In some embodiments, lids 744 of first pillars 740 may be interlocked and/or bonded to bases 774 of second pillars 770 so that second sole member 750 is secured to first sole member 720 as single piece insert.

In some embodiments, outsole 780 may include the same or similar features of outsole 180 and 680 described herein. For example, in some embodiments, outsole 780 may include a base 782 extending along the length of sole 700. In some embodiments, outsole 780 may include a sidewall 784 projecting upwardly from base 782 and extending along a perimeter of sole 700. In some embodiments, sidewall 784 may be coupled to insole 710 and upper 20C of the article of footwear 10C. In some embodiments, base 782 and sidewall 784 collectively define a chamber 786 that is bounded by insole 710.

In some embodiments, first sole member 720 and second sole member 750 may be received in chamber 786 of outsole 780. First sole member 720 and second sole member 750 collectively function as a cushion insert for sole 700 by providing support to the wearer's foot and absorbing shock imparted from sole 700 striking the ground, similar to the other embodiments described herein. By providing adequate cushion and support for the wearer's foot, first sole member 720 and second sole member 750 allow sole 700 to be void of any additional cushioning materials, such as foam, to reduce the cost of sole 700.

Figure 28:
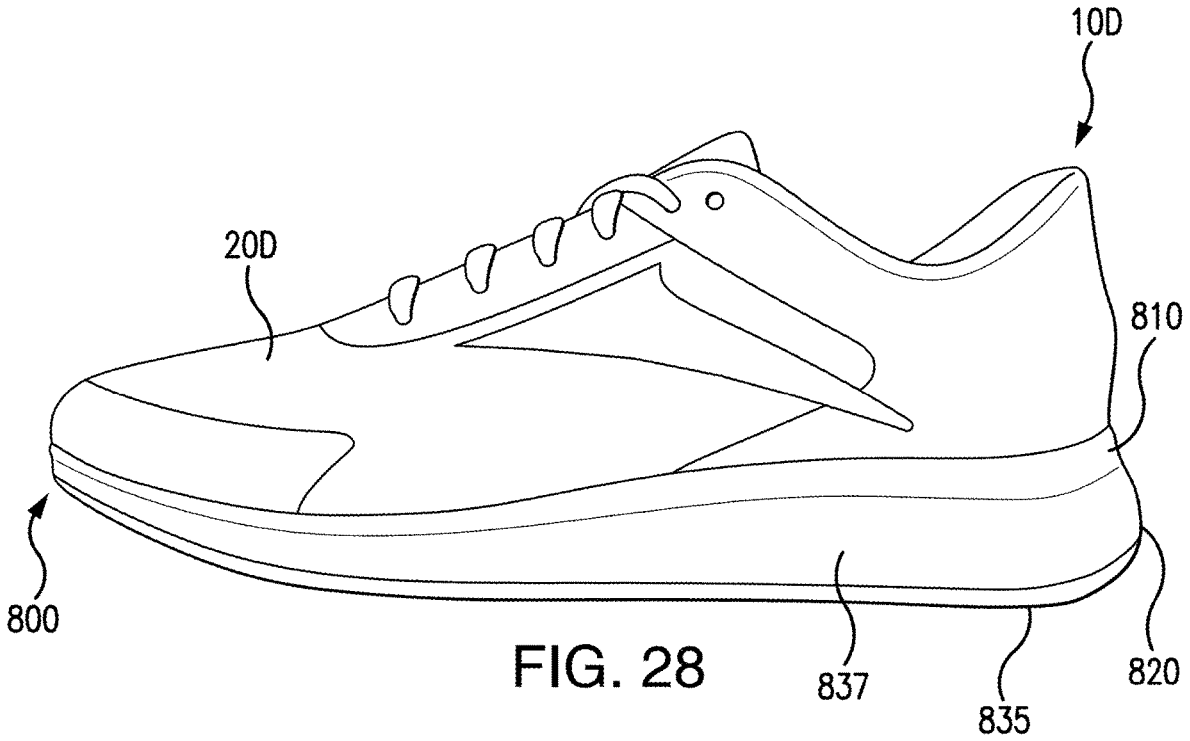
FIG. 28 shows a side view of an article of footwear according to embodiments.
Figure 29:
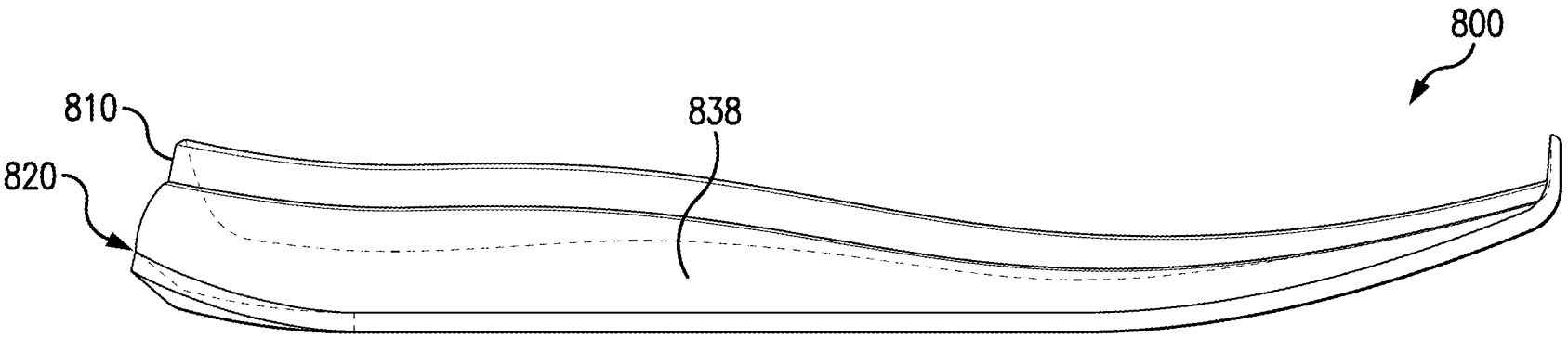
FIG. 29 shows a side view of a sole for the article of footwear shown in FIG. 28 according to embodiments.
Figure 30:
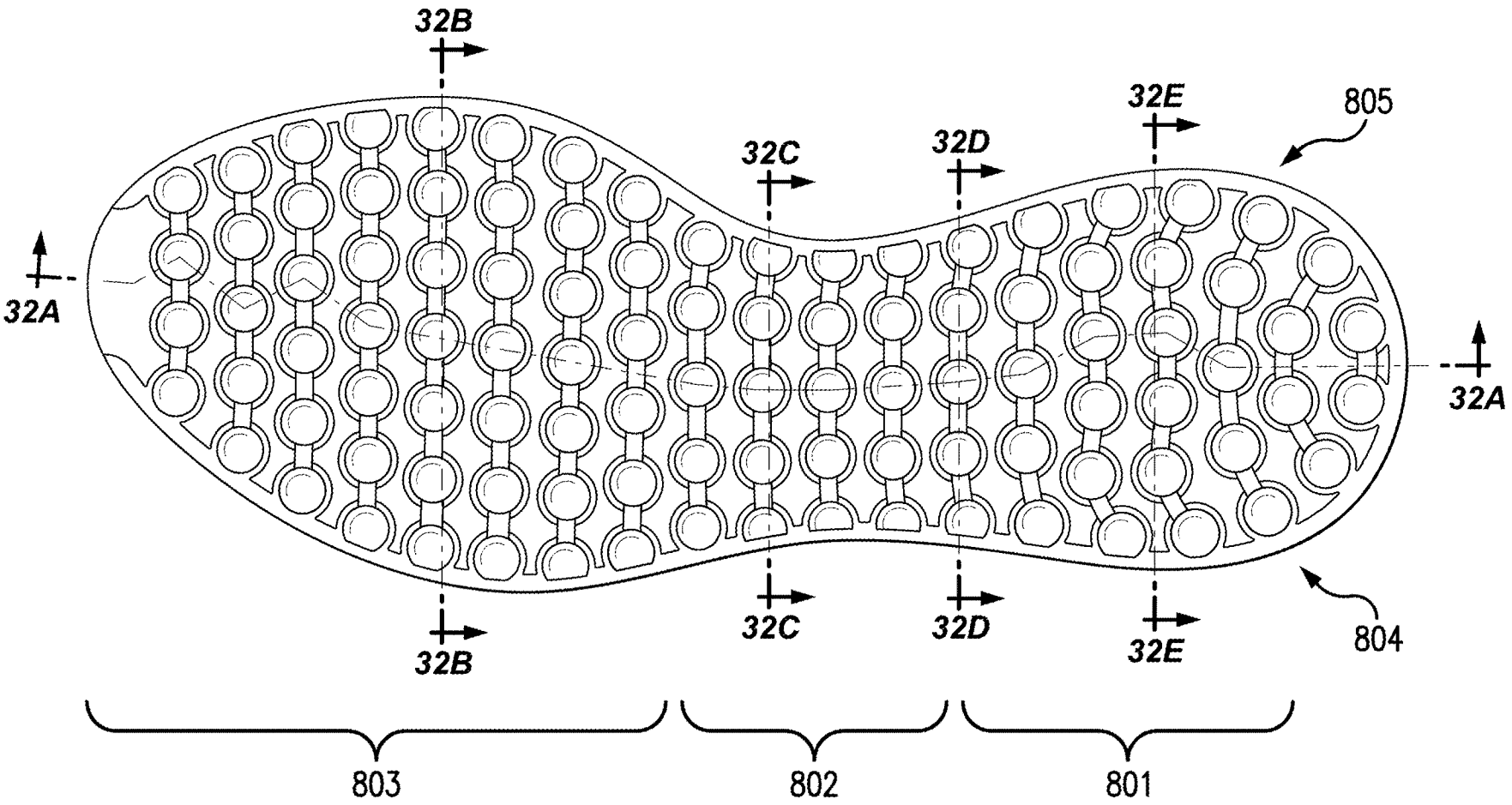
FIG. 30 shows a bottom view of the sole shown in FIG. 29 according to embodiments.
Figure 31:
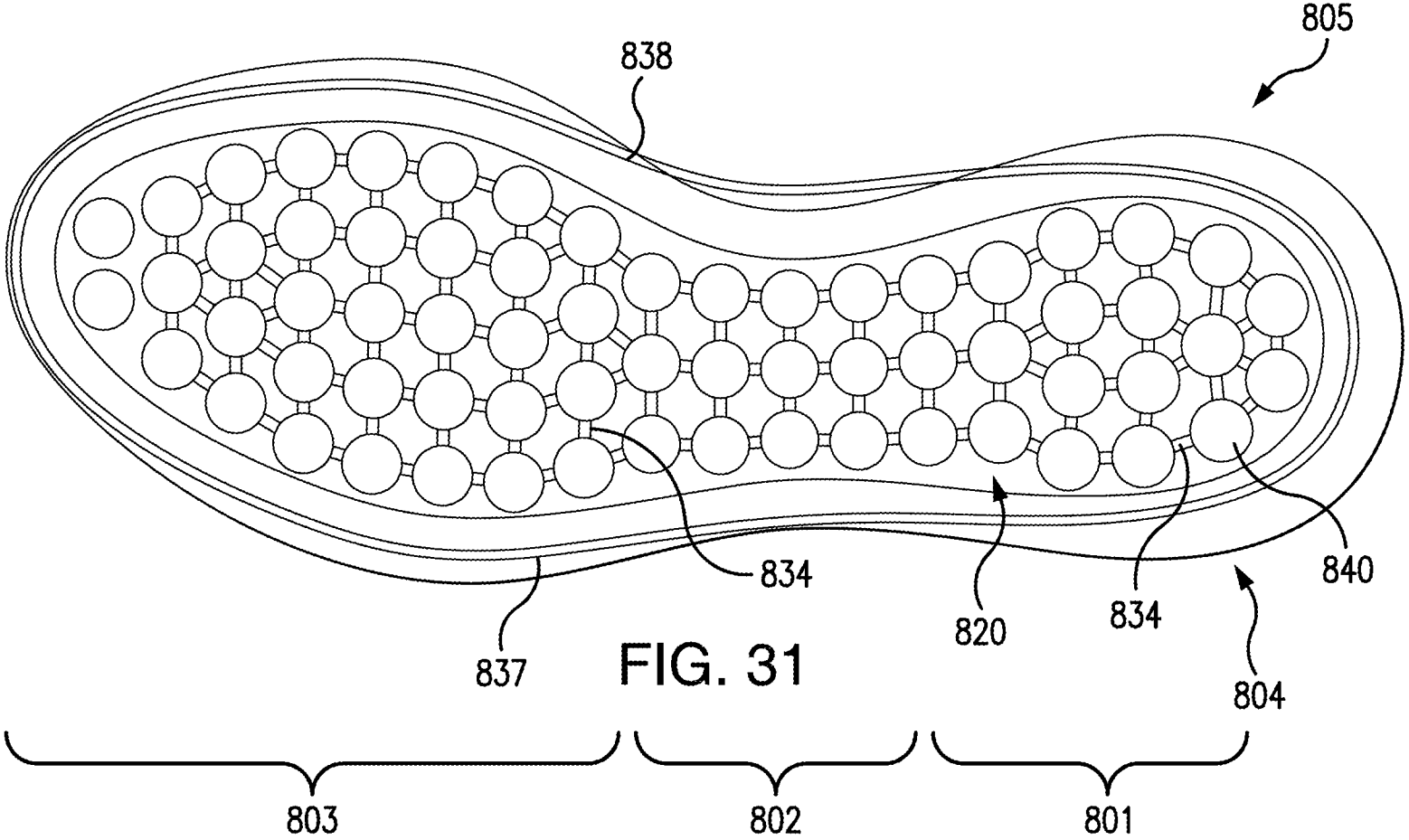
FIG. 31 shows a top of the sole shown in FIG. 29 according to some embodiments.

In some embodiments, the sole may include a single sole member defining the bottom surface of the sole and having a web interconnecting a plurality of hollow pillars that are engaged against a bottom surface of an insole such that the plurality of hollow pillars can sink to the profile of wearer's foot when the wearer is standing, thereby providing better cushioning to the wearer's foot. In some embodiments, the web of the sole member may include a plurality of through holes axially aligned with respect to the plurality of hollow pillars such that the cavities of the pillars are exposed at the bottom of the sole via the through holes. For example, FIG. 28 illustrates an article of footwear 10D having an upper 20D and a sole 800 coupled to the upper 20D according to some embodiments of the present disclosure. In some embodiments, sole 800 may include an insole 810 and a first sole member 820 disposed below insole 810. In some embodiments, first sole member 820 may define both the sidewalls (e.g., lateral sidewall 837 and medial sidewall 838) and a bottom surface 835 of sole 800.

In some embodiments, first sole member 820 may include the same and/or similar features of first sole member 120, 220, 320, 420, 520, 620, and 720 described herein. For example, in some embodiments, first sole member 820 may include a first web 830 having a plate 832 extending from a heel region 801 to a forefoot region 803 of sole 800, and first sole member 820 may include a plurality of hollow first pillars 840 projecting upwardly from an upper surface 836 of plate 832 to support the wearer's foot. In some embodiments, the plurality of first pillars 840 are arranged in a series of rows, where each row of first pillars 840 extends in a lateral direction along sole 800.

In some embodiments, as shown in FIGS. 32A-E, the plurality of first pillars 840 may each include a curved (e.g., cylindrical) sidewall 842 and a dome-shaped lid 844 extending from an upper end of curved sidewall 842, in which sidewall 842 and lid 844 define a void cavity 848. In some embodiments, lids 844 of the plurality of first pillars 840 may engage a bottom surface of insole 810. In some embodiments, plate 832 of first web 830 may include a plurality of holes 833 that are axially aligned with the plurality of first pillars 840 and open into cavity 848. In some embodiments, the plurality of holes 833 extend through plate 832 from upper surface 836 to bottom surface 835 such that cavities 848 of first pillars 840 are exposed at the bottom of sole 800. In some embodiments, the shape of bottom surface 835 may be tuned to maintain the structural integrity of first pillars 840 during foot strike. For example, as shown in FIGS. 32A-32E, plate 832 may include a plurality of posts 835A disposed along bottom surface 835 and a plurality of curved edges 835B, where each curved edge 835B extends from an edge of a respective hole 833 to the top of a respective post 835A. The plurality of posts 835A and the plurality of curved edges 835B displace the opening of hole 833 from lying flush against a ground surface during foot strike, thereby avoiding a seal from forming within cavities 848 of first pillars 840, ultimately preventing first pillars 840 from significantly collapsing during foot strike and potentially creating a vacuum within cavities 848 (e.g., a suction-cup-like effect).

In some embodiments, first web 830 may include a plurality of strips 834 disposed along portions of plate 832 interconnecting the plurality of first pillars 840. In some embodiments, a strip 834 can extend from an upper surface 836 of plate 832 between a pair of adjacent first pillars 840 such that first pillars 840 are supported adequately in an upright position. In some embodiments, a strip 834 can extend from a first pillar 840 to a sidewall of sole 800 to support first pillar 840 in an upright position.

In some embodiments, as shown in FIGS. 32A-D, for example, first web 830 may include a lateral sidewall 837 disposed on a lateral side 804 of plate 832 and a medial sidewall 838 disposed on a medial side 805 of plate 832. In some embodiments, lateral sidewall 837 and medial sidewall 838 are coupled to outer edge of insole 810. In some embodiments, lateral sidewall 837 and medial sidewall 838 extend along the entire length of sole 800. In some embodiments, the height of lateral sidewall 837 may correspond to the height of medial sidewall 838 (e.g., same height) along the length of sole 800. In some embodiments, lateral sidewall 837 and medial sidewall 838 merge at heel region 801 and at forefoot region 803 of sole 800, such that lateral sidewall 837 and medial sidewall 838 define a chamber 839 bounded by insole 810 and plate 832 of first web 830. In some embodiments, as shown in FIGS. 32A-D, the rows of first pillars 840 are disposed between lateral sidewall 837 and medial sidewall 838 of first web 830.

Figure 32A:
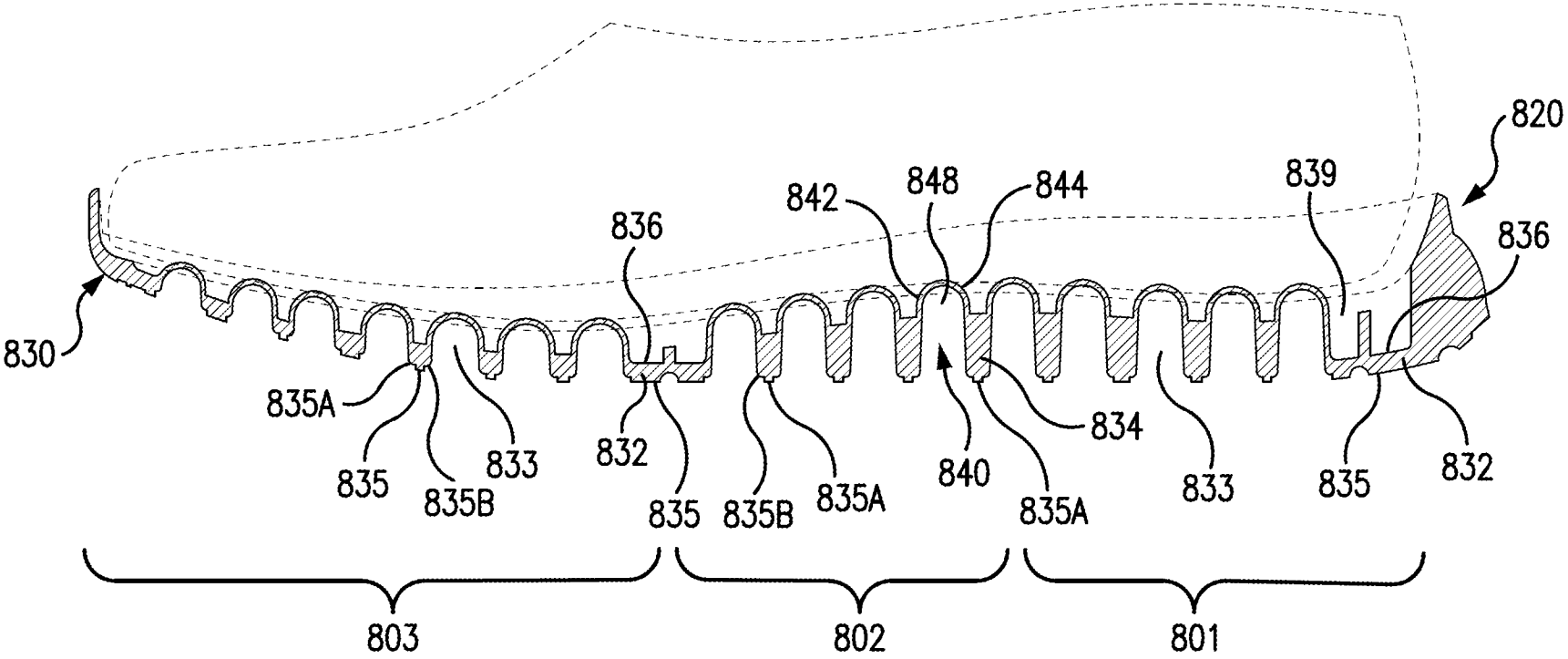
FIG. 32A shows a cross-section view of a first sole member taken along line 32A-32A in FIG. 30 according to embodiments.
Figure 32B:
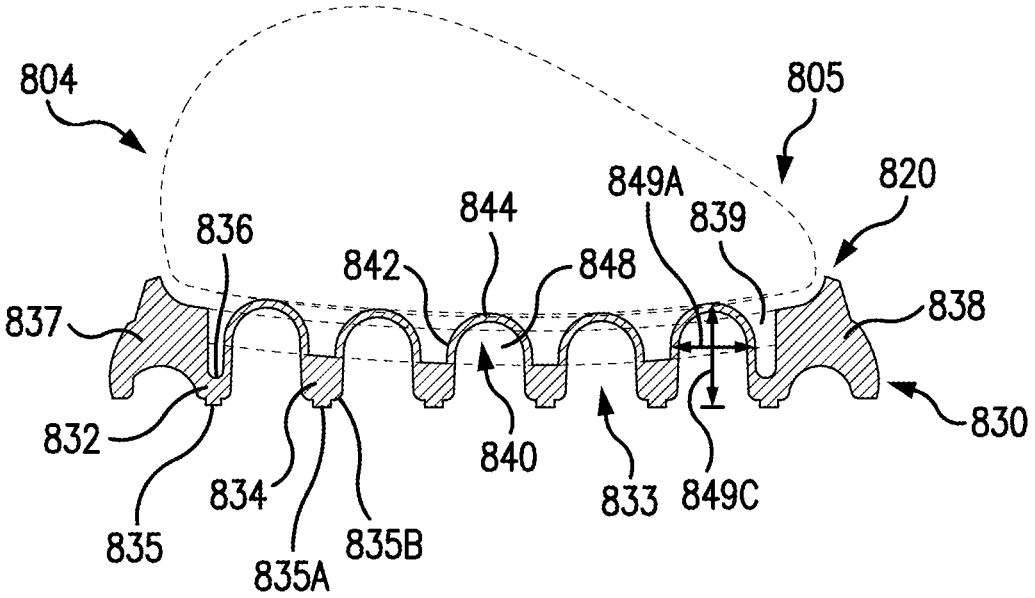
FIG. 32B shows a cross-section view of the first sole member taken along line 32B-32B in FIG. 30 according to embodiments.
Figure 32C:
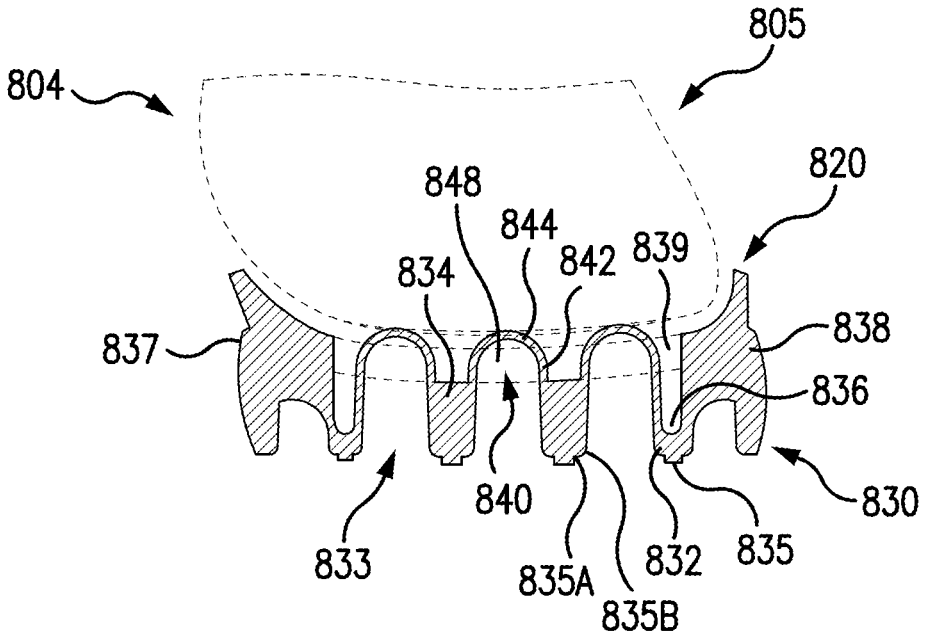
FIG. 32C shows a cross-section view of the first sole member taken along line 32C-32C in FIG. 30 according to embodiments.
Figure 32D:
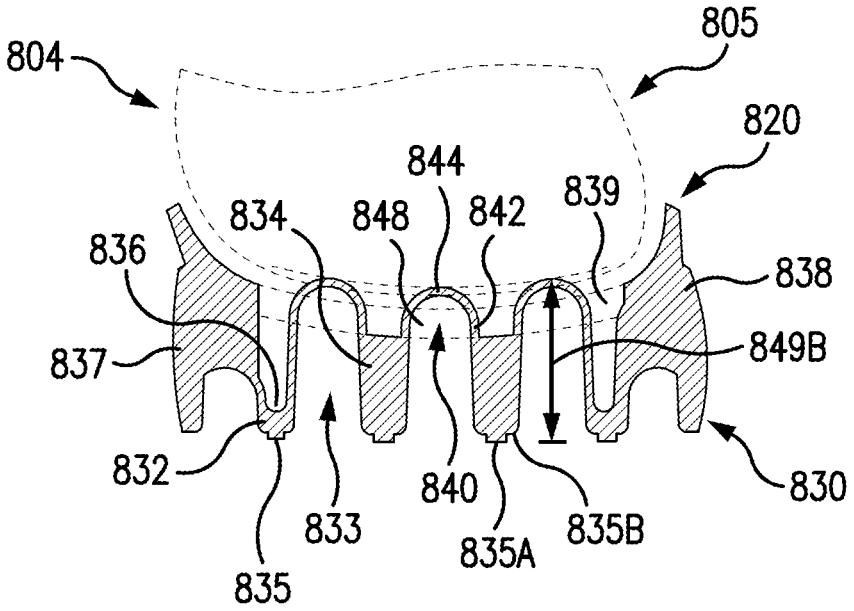
FIG. 32D shows a cross-section view of the first sole member taken along line 32D-32D in FIG. 30 according to embodiments.
Figure 32E:
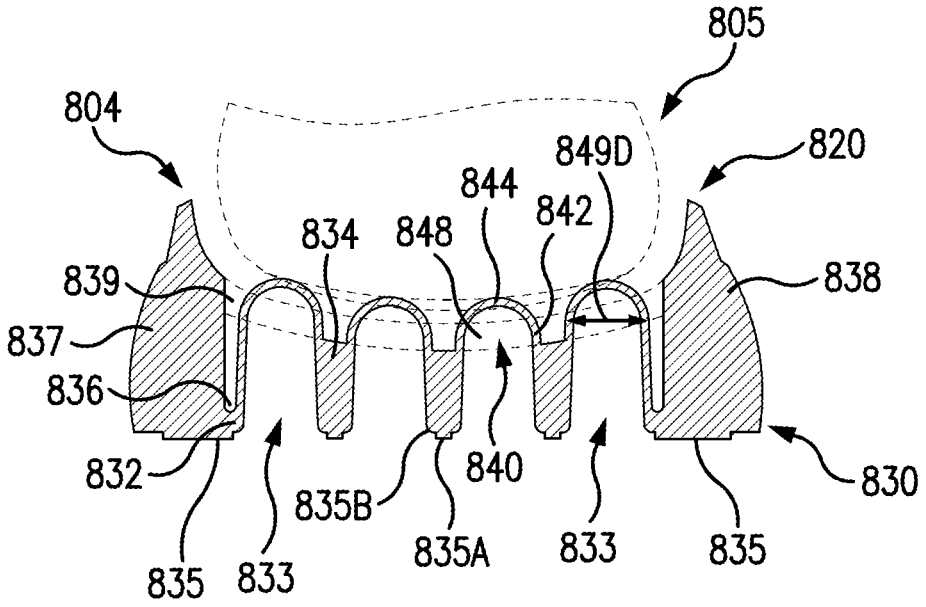
FIG. 32E shows a cross-section view of the first sole member taken along line 32E-32E in FIG. 30 according to embodiments.

As shown in FIGS. 32A-E, the size (e.g., height and/or diameter) of first pillars 840 varies from heel region 801 to forefoot region 803. For example, as shown in FIG. 32B, first pillars 840 in forefoot region 803 may include a first height 849C, and as shown in FIG. 32D, first pillars 840 in arch region 802 may include a second height 849B that is greater than the first height 849C to provide more support against the arch of the wearer's foot. In some embodiments, as shown in FIG. 32B, first pillars in forefoot region 803 may include a first width 849A, and as shown in FIG. 32E, first pillars 840 in heel region 801 may include a second width 849D greater than the first width 849A to provide more cushioning for the wearer's heel. In some embodiments, the size of first pillars 840 disposed in forefoot region 803 may include a smaller height and/or diameter than the height and/or diameter of the remaining first pillars 840.

In some embodiments, first web 830 and the plurality of first pillars 840 of first sole member 820 are unitary (e.g., a single-piece configuration), such that first web 830, including plate 832, strips 834, lateral sidewall 837, and medial sidewall 838 of first web 830, and the plurality of first pillars 840 are integrally made from the same material, such as, for example, the first elastomeric-based material described herein. In some embodiments, sole 800 may include a second material, such as a foam-based material, to form lateral sidewall 837 and medial sidewall 838 of sole 800, in which the plurality of first pillars 840 of the first elastomeric-based material and the medial and lateral sidewalls of the second material are molded together to form first sole member 820. In some embodiments, sole 800 may include an outsole coupled to selected portions of bottom surface 835 and may be made of a wear-resistant material, such as, for example, the second elastomeric material described herein.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An article of footwear, comprising:
an upper; and
a sole coupled to the upper, the sole comprising:
an insole configured to receive a foot of a wearer, and
a first sole member disposed below the insole and configured to support the foot of the wearer, the first sole member comprising:
a first web including a plate extending along a length of the sole,
a plurality of first pillars projecting upwardly from the first web toward the insole, the plurality of first pillars each include:
a curved sidewall projecting upwardly from an upper surface of the plate;
a lid extending from an upper end of the curved sidewall, wherein the curved sidewall and the lid define a cavity; and
an aperture disposed at a center of the lid and opening into the cavity;
a plurality of dome-shaped walls, each axially aligned with one of the plurality of first pillars, and each including:
a concave interior surface bounding the cavity of its respective first pillar, and
a convex exterior surface surrounded by a rim recessed from a ground-contacting surface of the plate; and
strips projecting upwardly from the upper surface of the plate, each of the strips extending from a curved sidewall of a respective first pillar to a curved sidewall of an adjacent first pillar,
wherein the first web and the plurality of first pillars of the first sole member are unitary and made of a first elastomeric material having a first modulus of elasticity configuring the plurality of first pillars to flex or deform upon an application of a compressive force by the wearer and return to their original shape upon a removal of the compressive force.

2. The article of footwear of claim 1, wherein the lid of each first pillar is dome-shaped, and the aperture of each first pillar is disposed at an apex of the dome-shaped lid.

3. The article of footwear of claim 1, wherein the cavity of each first pillar is filled with ambient air.

4. The article of footwear of claim 1, wherein the sole further comprises an outsole coupled to the first web of the first sole member, and the outsole is made of a second elastomeric material having a second modulus of elasticity that is greater than the first modulus of elasticity.

5. The article of footwear of claim 1, further comprising:
a second sole member disposed below the insole and above the first sole member, the second sole member comprising:
a second web coupled to the insole and extending along the length of the sole, and
a plurality of second pillars projecting downwardly from the second web toward the first sole member, the plurality of second pillars each include:
a curved sidewall, and
a base extending from a lower end of the curved sidewall,
wherein the second web and the plurality of second pillars of the second sole member are unitary,
wherein the plurality of second pillars are axially aligned with respect to the plurality of first pillars, and the base of each second pillar engages the lid of a respective first pillar.

6. The article of footwear of claim 5, wherein the plurality of second pillars each include a pin projecting downwardly from a center of the base and received in the aperture of the respective first pillar.

7. The article of footwear of claim 1, wherein the first sole member includes a central pillar projecting upwardly from the upper surface of the plate in a central portion of an arch region of the sole, and the plate of the first sole member includes a hole opening into a cavity of the central pillar.

8. The article of footwear of claim 7, wherein a length of the central pillar defined in a longitudinal direction of the sole is larger than a length of each of the first pillars defined in the longitudinal direction of the sole.

9. A sole for an article of footwear, comprising:
an insole configured to receive a foot of a wearer, and
a first sole member disposed below the insole and configured to support the foot of the wearer, the first sole member comprising:
a first web comprising a plate extending along a length of the sole, and
a plurality of first pillars projecting upwardly from the first web toward the insole, the plurality of first pillars each include:
a curved sidewall projecting upwardly from an upper surface of the plate,
a lid extending from an upper end of the curved sidewall, wherein the curved sidewall and lid define a cavity;
a plurality of dome-shaped walls, each axially aligned with one of the plurality of first pillars, and each including:
a concave interior surface bounding the cavity of its respective first pillar, and
a convex exterior surface surrounded by a rim recessed from a ground-contacting surface of the plate; and
strips projecting upwardly from the upper surface of the plate, each of the strips extending from a curved sidewall of a respective first pillar to a curved sidewall of an adjacent first pillar, wherein one or more of the strips includes an upper surface defining an arch-shaped contour.

10. The sole of claim 9, wherein the plate of the first web comprises a hole opening into the cavity of one of the first pillars.

11. The sole of claim 9, wherein the first web comprises:
a first lateral sidewall disposed on a lateral side of the plate of the first web, and
a first medial sidewall disposed on a medial side of the plate of the first web.

12. The sole of claim 11, wherein the plurality of first pillars are arranged in a series of rows, and at least one of the rows of the first pillars are disposed between the first lateral sidewall and the first medial sidewall of the first web.

13. The sole of claim 11, further comprising:

a second sole member disposed below the insole and above the first sole member, the second sole member comprising:

a second web coupled to the insole, the second web comprising a plate extending along the length of the sole, and a plurality of second pillars projecting downwardly from a lower surface of the plate of the second web toward the first sole member, the second pillars each include:

a curved sidewall, and a base extending from a lower end of the curved sidewall, wherein the second web and the plurality of second pillars of the second sole member are unitary, wherein the plurality of second pillars are axially aligned with respect to the plurality of first pillars, and the base of each second pillar is interlocked with the lid of a respective first pillar.

14. The sole of claim 13, wherein the second web comprises:

a second lateral sidewall disposed on a lateral side of the plate of the second web, and a second medial sidewall disposed on a medial side of the plate of the second web, wherein a bottom surface of the second lateral sidewall engages an upper surface of the first lateral sidewall, and a bottom surface of the second medial sidewall engages an upper surface of the first medial sidewall.

15. The sole of claim 9, wherein the first web and the plurality of first pillars of the first sole member are unitary and made of a first elastomeric material having a first modulus of elasticity configuring the plurality of first pillars to flex or deform upon an application of a compressive force by the wearer and return to their original shape upon a removal of the compressive force.

* * * * *